US005325690A

United States Patent [19]

Adler et al.

[11] Patent Number: 5,325,690

[45] **Date of Patent: * Jul. 5, 1994**

[54] LOCK ADJUSTABLE TO OPERATE WITH DIFFERENT KEYS

[75] Inventors: Richard S. Adler, 910 Franklin Lakes Rd., Franklin Lakes, N.J. 07417; Paul F. Morris, New York, N.Y.; Karl D. Kirk, New York, N.Y.; John Milich, Hastings on Hudson, N.Y.; Gerard M. Perichon, New York, N.Y.

[73] Assignee: Richard S. Adler, New York, N.Y.

[ * ] Notice: The portion of the term of this patent subsequent to Jul. 25, 2004 has been disclaimed.

[21] Appl. No.: 809,554

[22] PCT Filed: Jul. 24, 1989

[86] PCT No.: PCT/US89/03196

§ 371 Date: Feb. 24, 1992

§ 102(e) Date: Feb. 24, 1992

Related U.S. Application Data

[63] Continuation-in-part of Ser. No. 99,099, Aug. 21, 1987, Pat. No. 4,850,210.

[51] Int. Cl.[5] ..... E05B 25/00

[52] U.S. Cl. ..... 70/383; 70/373; 70/375

[58] Field of Search ..... 70/382-384, 70/373-375

[56] References Cited

U.S. PATENT DOCUMENTS

| | | | |
|---|---|---|---|
| 1,565,557 | 12/1925 | Fremon | 70/339 |
| 2,023,847 | 12/1935 | Liss | 70/47 |
| 2,603,081 | 7/1952 | Pelle | 70/382 |
| 4,094,175 | 6/1978 | Pechner | 70/383 X |
| 4,185,480 | 1/1980 | Pechner | 70/383 X |
| 4,372,139 | 2/1983 | Laake | 70/383 |
| 4,850,210 | 7/1989 | Adler et al. | 70/383 |
| 4,912,953 | 4/1990 | Wobig | 70/383 |

*Primary Examiner*—Peter M. Cuomo
*Assistant Examiner*—Suzanne L. Dino
*Attorney, Agent, or Firm*—Rosen, Dainow & Jacobs

[57] ABSTRACT

A lock which is rekeyable or programmable to operate with a different key from the exterior thereof without disassembling it or removing it from a lock assembly in which it is assembled is disclosed. The lock may be rekeyed through the keyway so that the lock appears from the exterior thereof to be a conventional lock, or from the end opposite the keyway from the interior of a door, or from a side of the lock which requires disassembly of the lock from its lock assembly. The lock includes structure defining a movable shear line that can be adjusted from the exterior of the lock without disassembling the lock itself. Such structure may comprise a rotatable cam and a pin tumbler and an axially adjustable set screw. Security of the lock is improved by selectively restricting or blocking access to the rekeying of the lock in the interior thereof with a gate or shutter, or various combinations of gates or shutters.

36 Claims, 29 Drawing Sheets

Fig. 5.
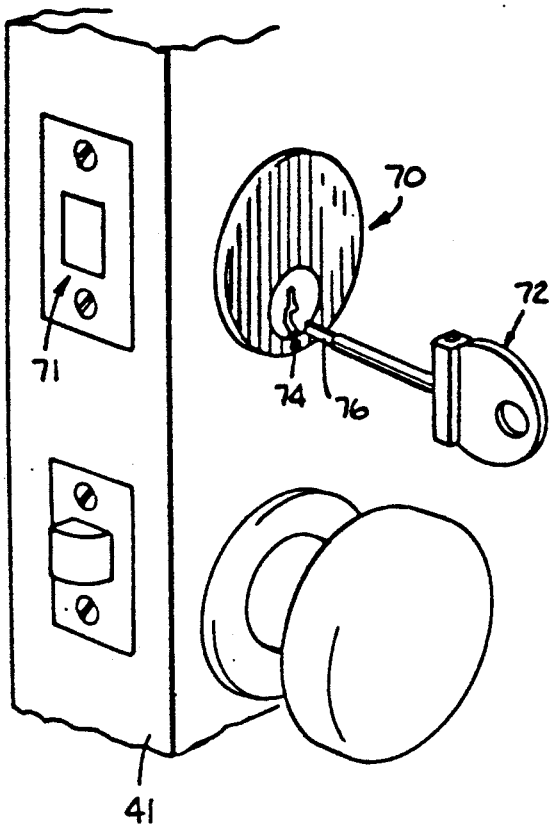
Fig. 19.
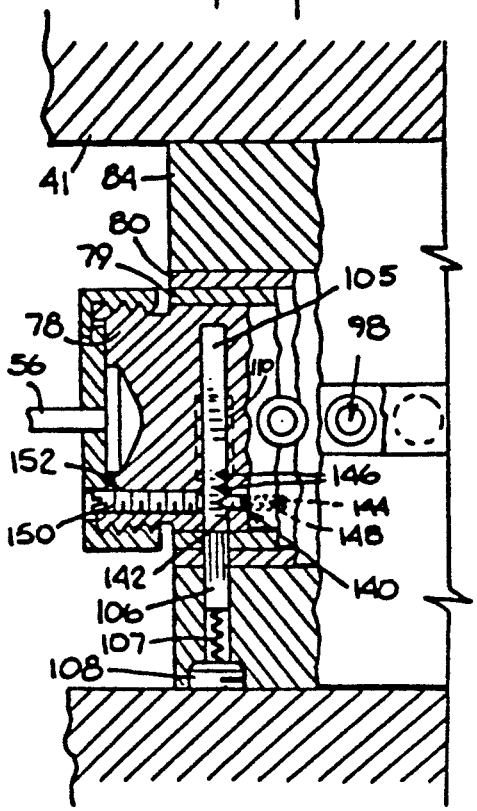
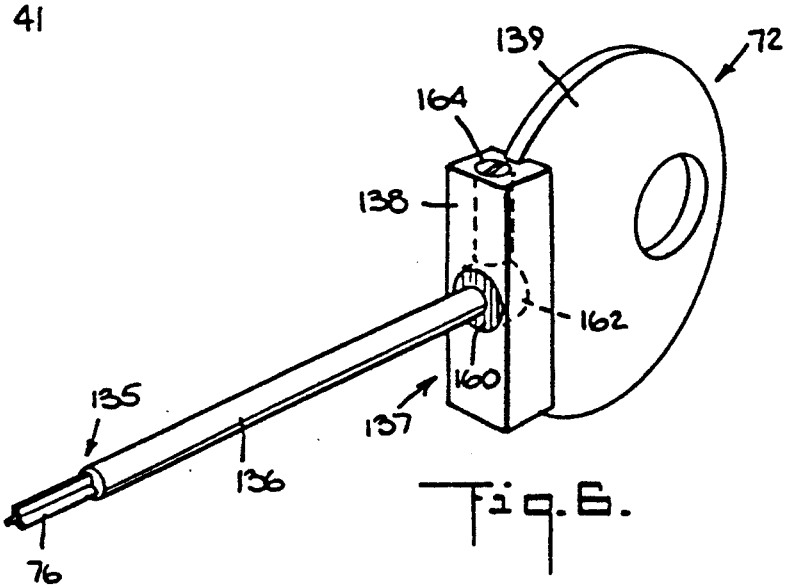
Fig. 6.

Fig. 14.
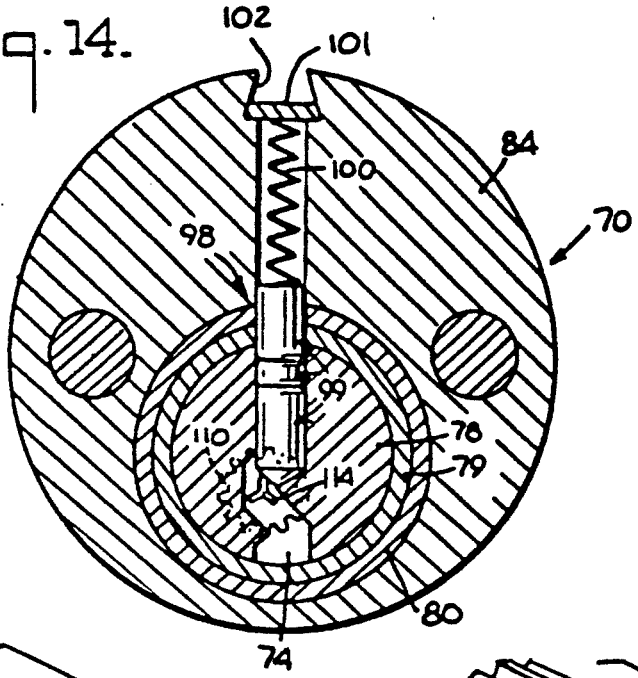
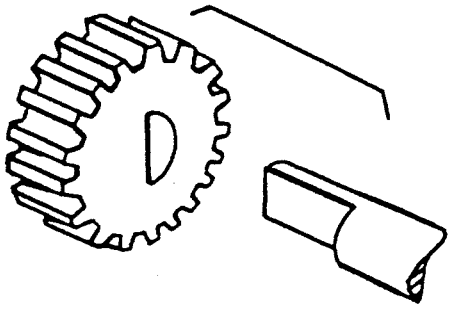
Fig. 21.
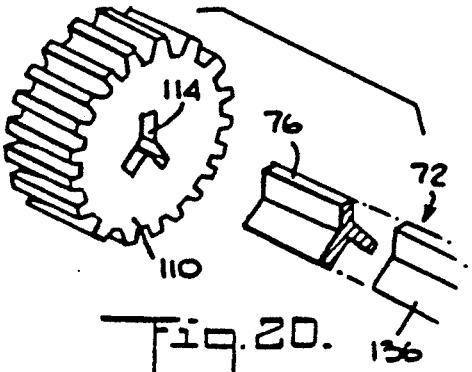
Fig. 20.
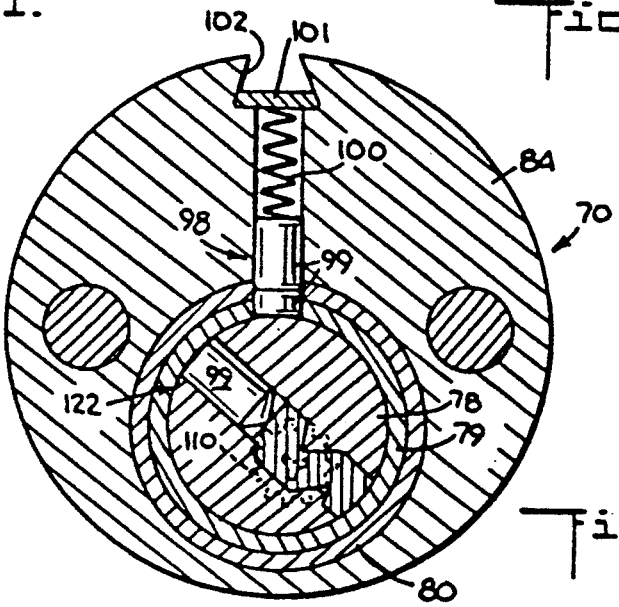
Fig. 15.

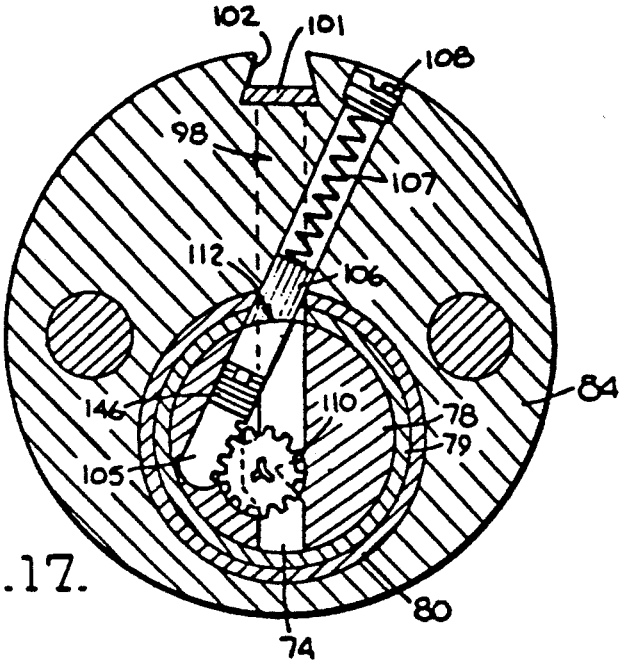
Fig. 17.
Fig. 16.
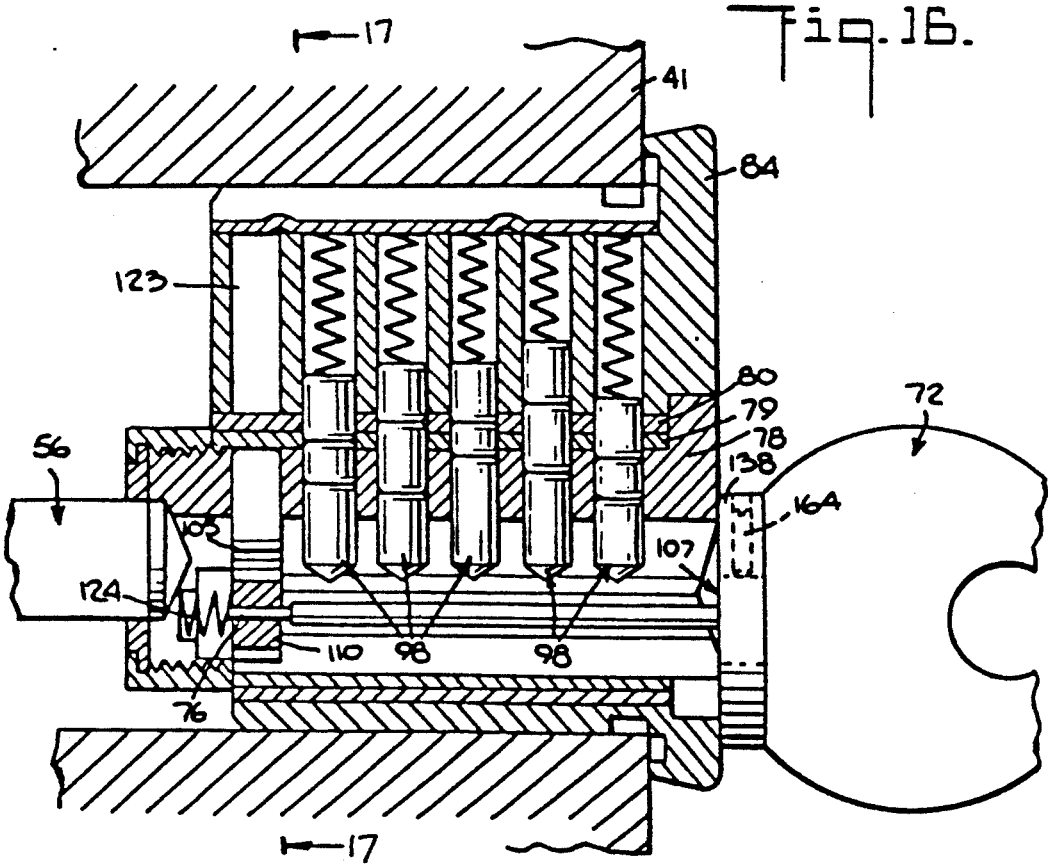

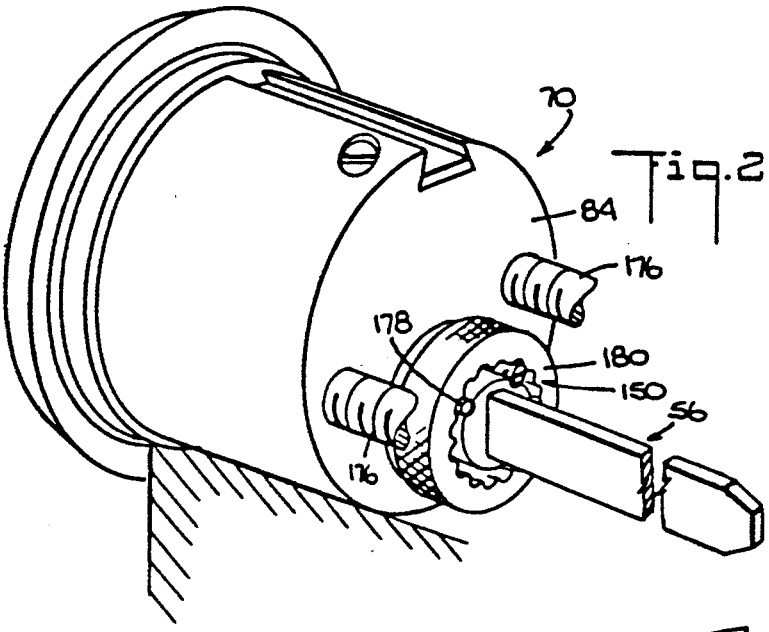
Fig.22.
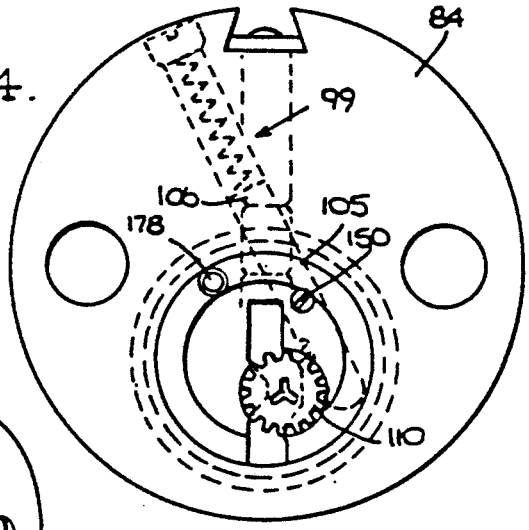
Fig.24.
Fig.23.
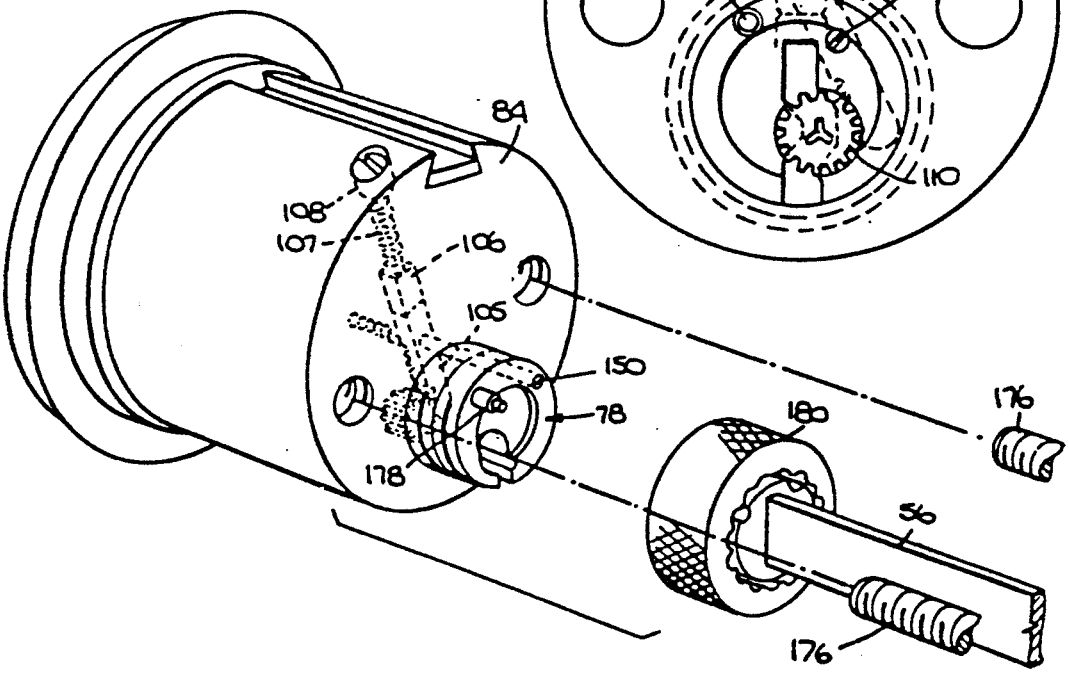

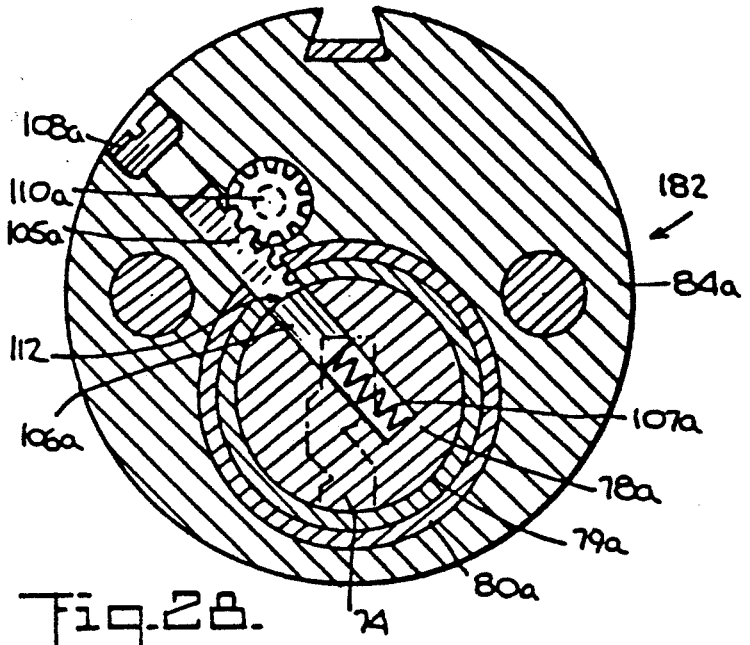
Fig. 28.
Fig. 29.
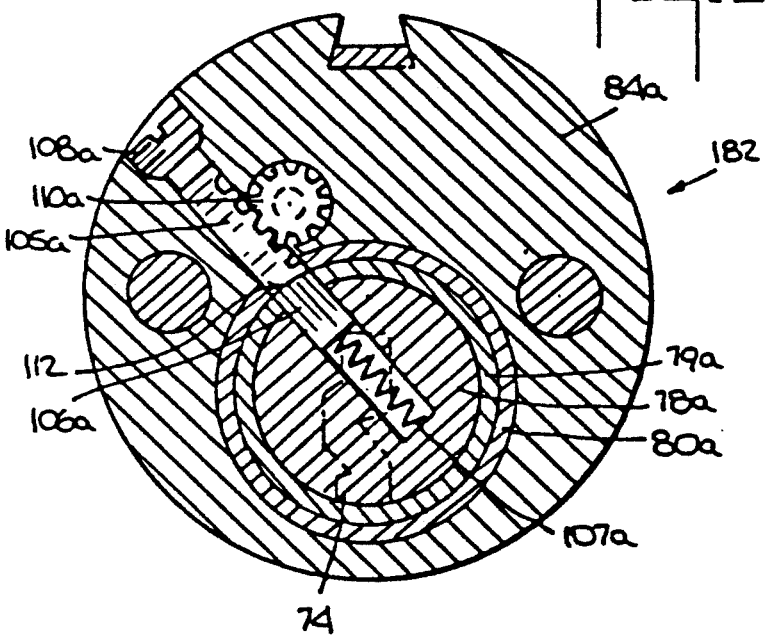

FIG. 42
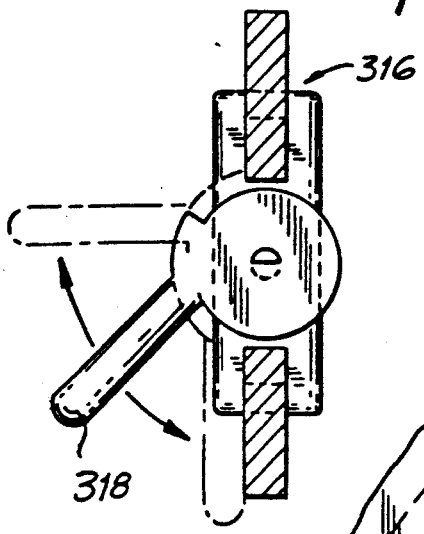
FIG. 43
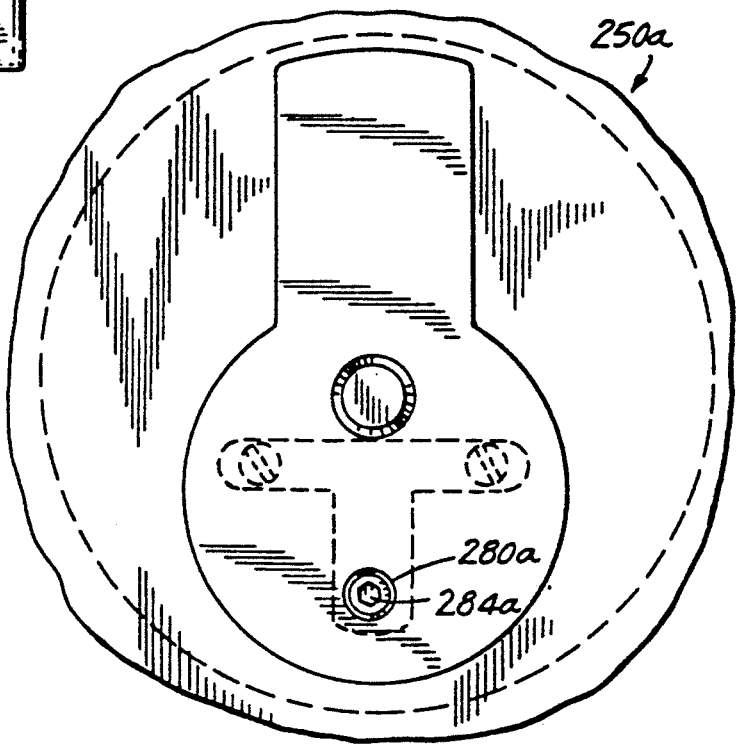
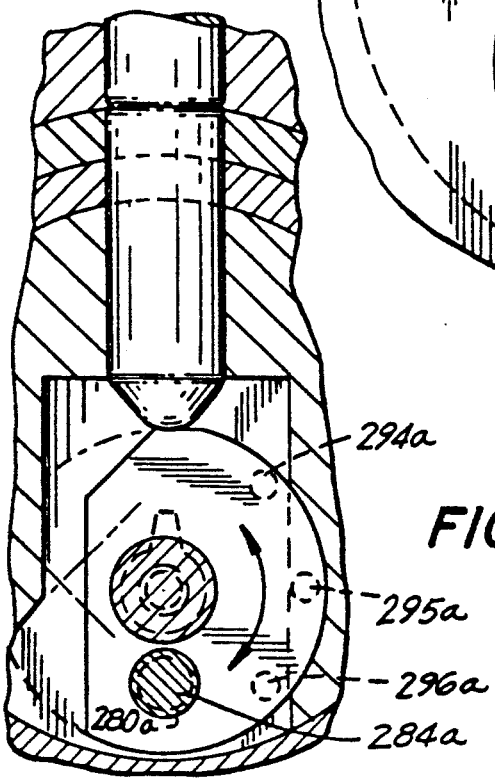
FIG. 44

FIG. 48
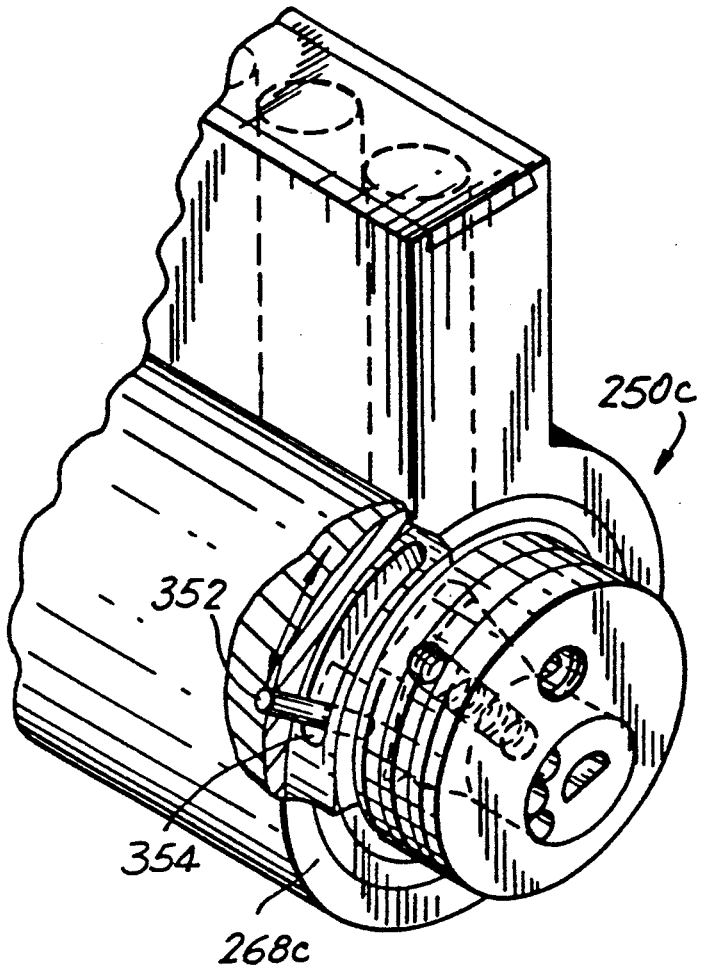
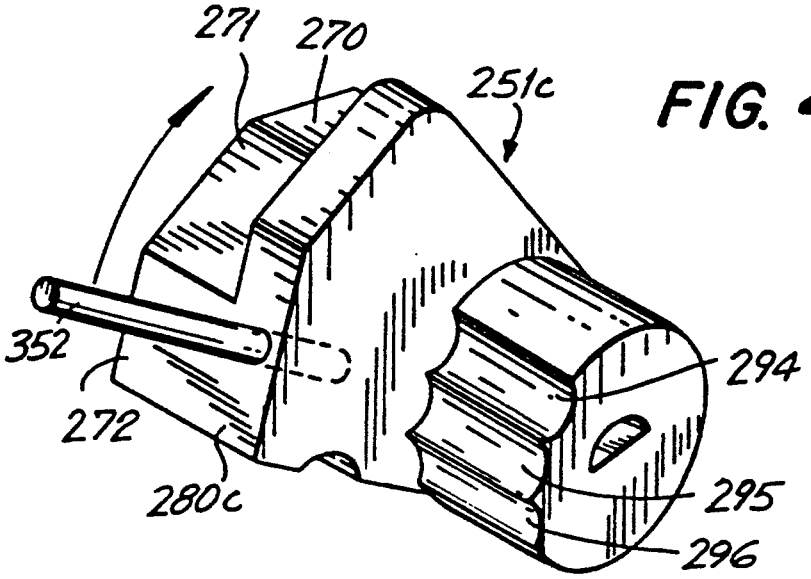
FIG. 49

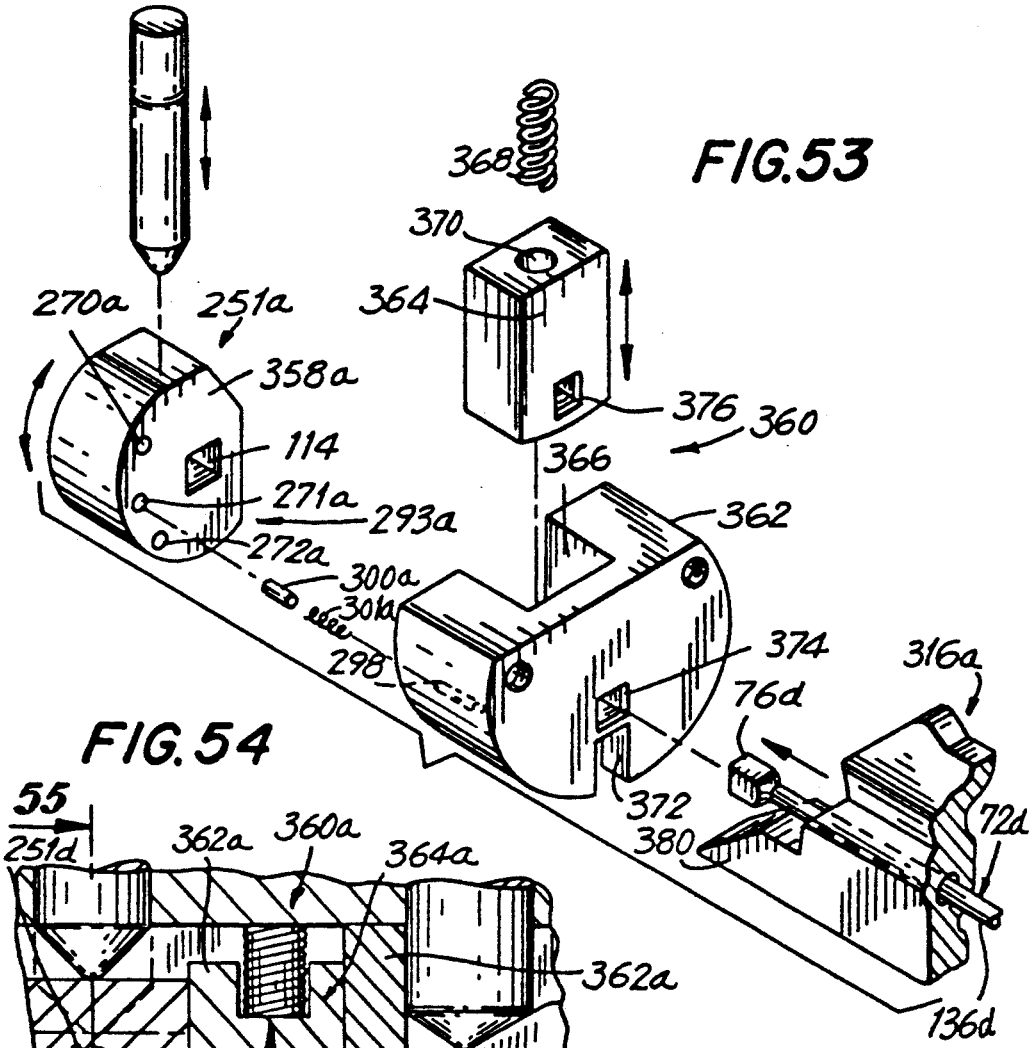
FIG. 53
FIG. 54
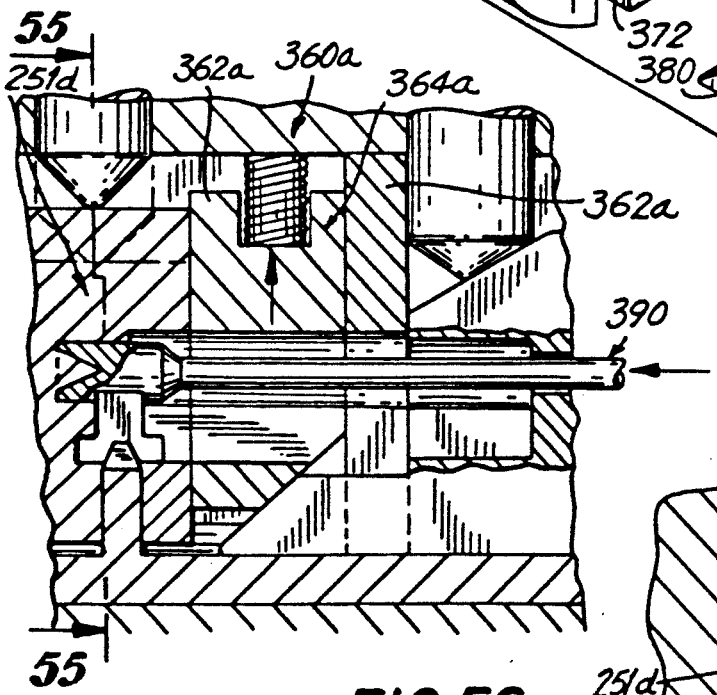
FIG. 55
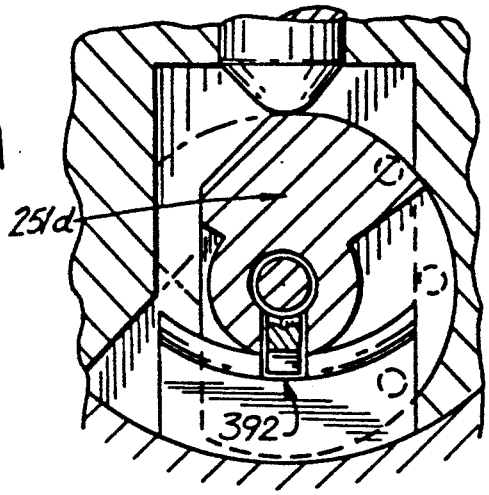
FIG. 56
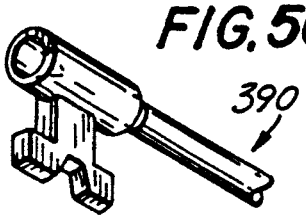

FIG. 57
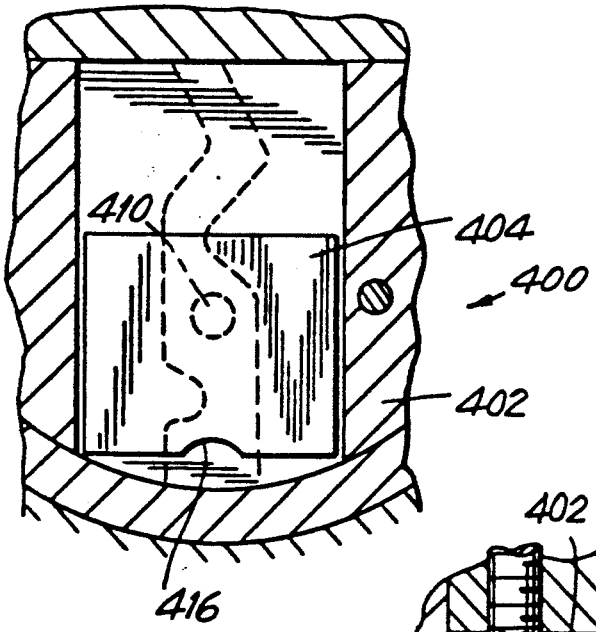
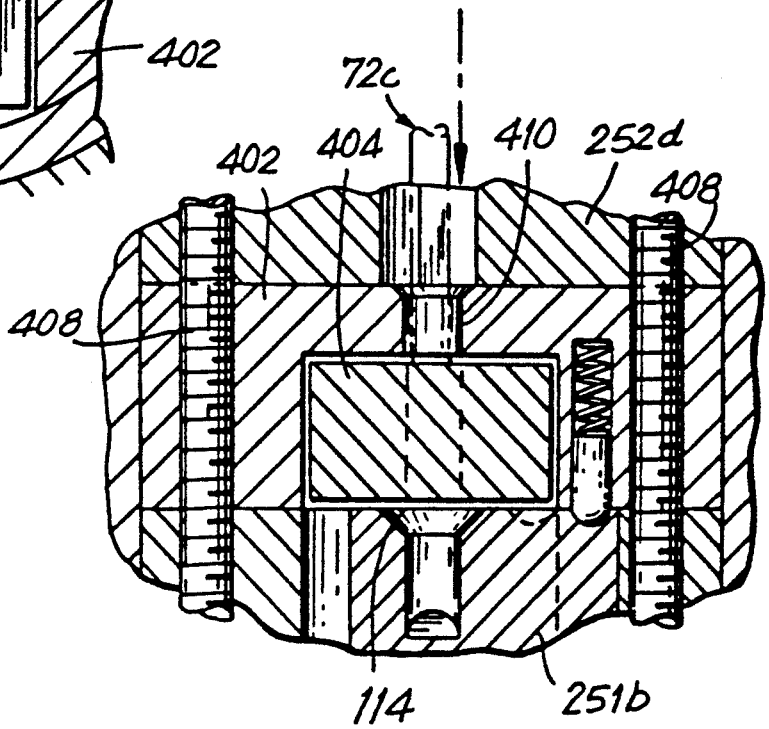
FIG. 58
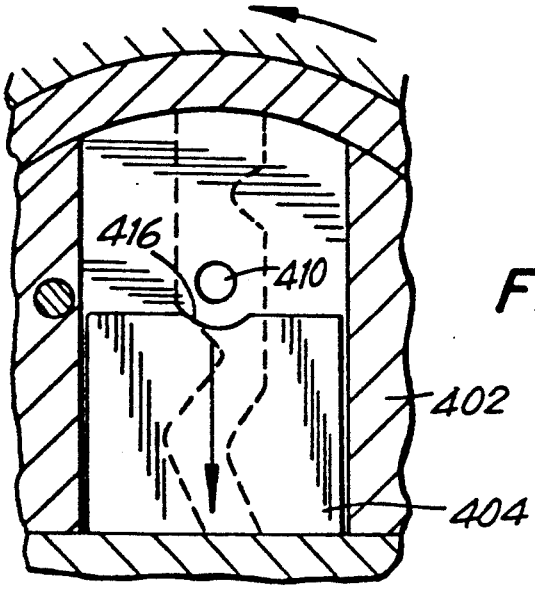
FIG. 59

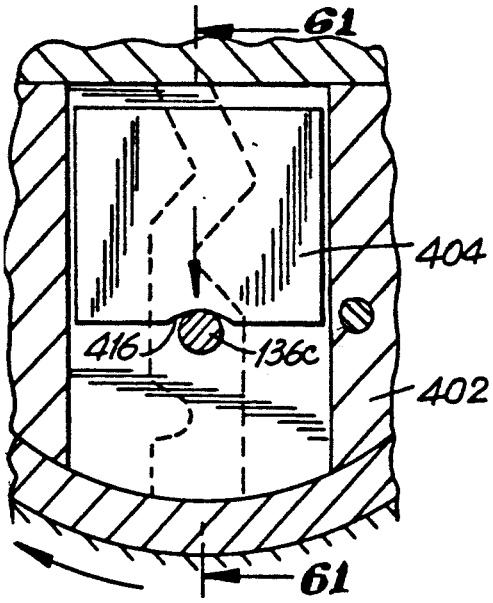
FIG. 60
FIG. 61
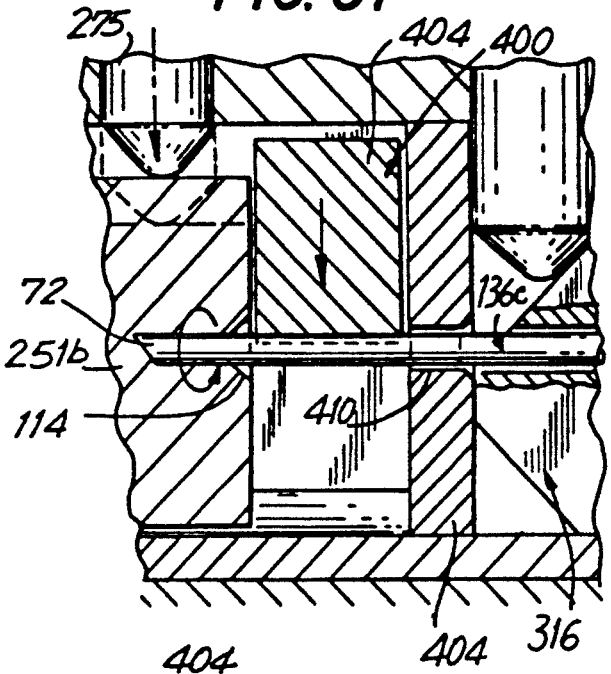
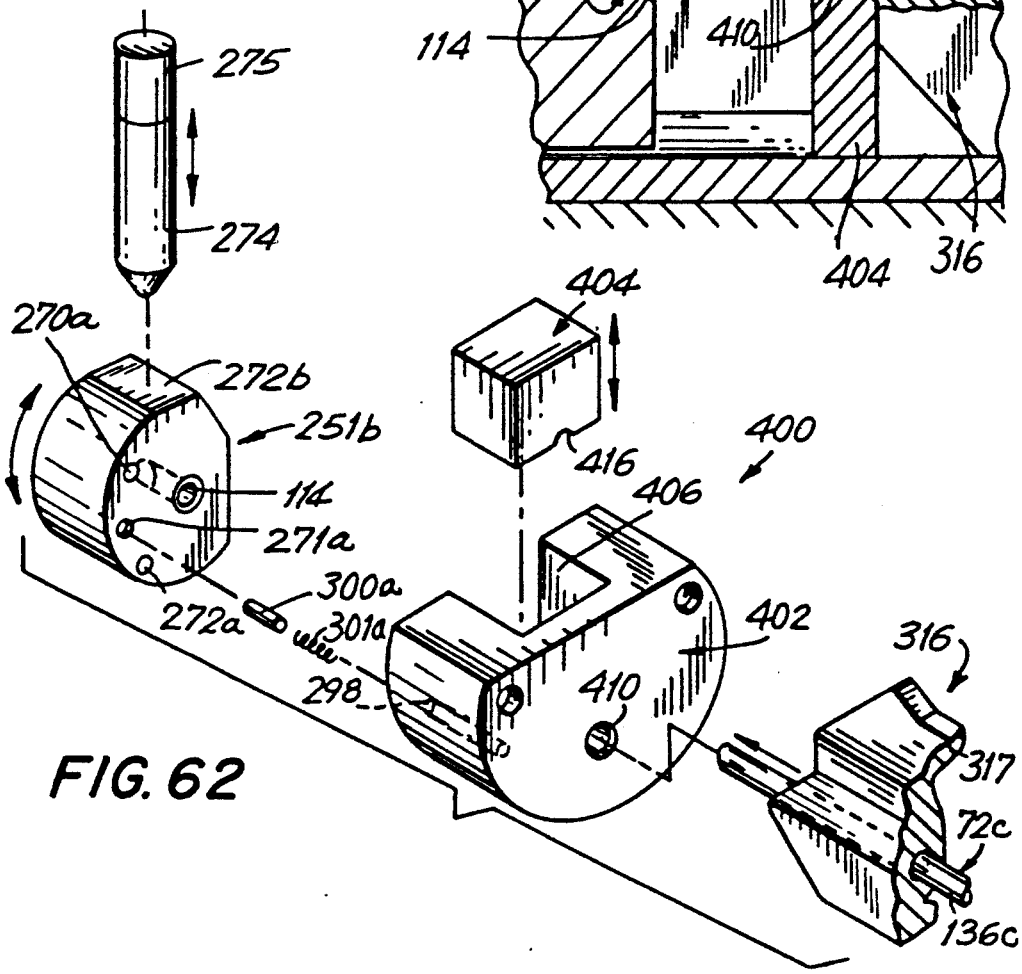
FIG. 62

LOCK ADJUSTABLE TO OPERATE WITH DIFFERENT KEYS

This application is a continuation-in-part of application Ser. No. 07/099,099, filed Aug. 21, 1987, now U.S. Pat. No. 4,850,210.

TECHNICAL FIELD

The present invention relates to a lock adjustable or programmable to operate with different keys and to methods of providing and operating such a lock.

There are many instances in which it is desirable to change the keying of a lock. For example, when one loses a key to a lock, particularly a door lock the primary concern is often not with unlocking the lock since duplicate keys are usually left with relatives, neighbors, landlords, superintendents, building agents, etc., but that the finder of the key will be able to identify the location of the lock and unlock it. That concern becomes more serious when the key was lost or stolen under circumstances which permit an identification of the key owner, such as when a woman's handbag is lost or stolen, or when a set of keys is taken, for example, from an automobile. In such instances, the lock must either be rekeyed or changed to prevent the lost or stolen key from operating the lock. In either case, a locksmith was usually called to change the keying of the lock or to replace the lock itself.

Pin tumbler locks which may be rekeyed without removing the tumblers, and therefore rekeyed without a locksmith, are known. U.S. Pat. No. 1,565,556 of Fremon, issued Dec. 15, 1925, and U.S. Pat. No. 2,603,081, of Pelle, issued Jul. 15, 1952 disclose locks which must be removed from the lock assembly in which they have been assembled in order to effect rekeying. Therefore, while those locks may not require a locksmith for rekeying, rekeying would not ordinarily be attempted by someone who is not mechanically inclined.

The '556 Fremon Patent discloses a pin tumbler lock which is selectively operable with two keys. In one condition of the lock it is only operable with one of the two keys, and in another condition of the lock it is only operable with the other of the two keys. The lock includes an annular ring which encloses a lock plug having a keyway therein. Both the ring and the plug are rotatable relative to the lock casing. A pair of radially extending pins engage either the ring and plug together so that both rotate relative to the casing, or the ring to the casing so that only the plug rotates relative to the casing. A bar is movable to cause the pins to engage the ring and plug together or the ring to the casing. In order to change the condition of the lock, i.e., rekey it, the lock has to be removed from a lock assembly in which it is-assembled to gain access to the movable bar so that its position may be changed.

The Pelle '081 Patent discloses a rekeyable lock in which the longitudinal position of one of the tumbler assemblies is changed by a gear assembly to rekey the lock. However, access to the gear assembly which repositions that tumbler assembly is obtained from the rear of the lock which requires that the lock be removed from a lock assembly in which it is installed.

A lock which may be rekeyed from the exterior thereof without removing it from a lock assembly in which it is assembled is disclosed in U.S. Pat. No. 3,257,831 of Schlage, issued Jun. 28, 1966. The lock disclosed in the '831 Schlage Patent is selectively operable with primary and secondary keys, initially only with the secondary key, and rekeyable by the primary key to operate with the primary key instead of the secondary key. The lock can not be rekeyed from the exterior of the lock by the secondary key to operate again with the secondary key, but may be rekeyed by the primary key to operate with the secondary key. Thus, the same key which is used to operate the lock also rekeys the lock. As a result, the functions of rekeying and operating the lock can not be separated so that anyone authorized to rekey the lock can also operate it. Rekeying is accomplished in the '831 Schlage Patent by reconfiguring the keyway to limit the distance that the secondary key may be inserted, thereby preventing the secondary key from properly positioning the tumblers for operation of the lock.

Another lock which may be rekeyed from the exterior thereof without removing it from a lock assembly in which it is assembled is disclosed in U.S. Pat. No. 4,372,139 of Laake issued Feb. 8, 1983. The lock disclosed in the '139 Laake Patent includes a main cylinder and a movable control shaft associated therewith which may be adjusted to different predetermined levels to create different shear lines across which the main cylinder is rotatable. Each shear line requires a different predetermined key to rotate the main cylinder. When the shear line is changed, a prior key becomes inoperable, unless it is a master key. Access to the control shaft to adjust it is obtained by rotating an outer cylinder that encircles the main cylinder. A special key is required to rotate the outer cylinder to register a cut out in the outer cylinder with a cut out in the housing through which access to the movable shaft is obtained. In a disclosed embodiment, the movable shaft is adjusted by means of a rack and pinion mechanism.

A lock which may be rekeyed from the exterior by a reset key which adjusts the positioning of the tumblers is disclosed, for example, in U.S. Pat. No. Re. 28,319 of Kerr, which was reissued on Jan. 28, 1975 (original patent issued on Sep. 4, 1973). The '319 Kerr Patent discloses an axial pin tumbler lock which includes a number of pin tumbler sets that extend circumferentially about the lock, each of the tumbler sets including three axially-extending tumblers. One set of circumferentially-extending tumblers is rotated relative to the other two sets by the reset key to form new combinations of three tumblers for each tumbler set, thereby rekeying the lock. The reset key must be inserted into the lock in the same angular position relative to the lock that it was in when it was last withdrawn from the lock, otherwise the lock can not be rekeyed. In order to facilitate proper introduction of the reset key, the '319 Kerr Patent suggests that the front of the lock be marked with indicia to indentify the positions of the axial tumbler sets. However, such indicia may distinguish the exterior appearance of the lock from a non-rekeyable lock of the same type and thereby suggest that the lock may be rekeyed.

A lock commercially available from U-Change Lock Industries, Inc. of Oklahoma City, Okla. is rekeyable from the exterior thereof by adjusting the positioning of the tumblers. In order to rekey the lock, both a change tool which repositions the pin-tumblers that operate the lock and a key with which the lock is to operate must be inserted into the lock. While the key is inserted in the keyway of the lock, a slot is provided at the exterior of the lock adjacent the keyway through which the change tool is inserted. The slot, however, distinguishes the exterior of the lock from conventional locks and may suggest that the lock is rekeyable.

A lock commercially available from Winfield Locks, Inc. of Costa Mesa, Calif. is rekeyable from the exterior thereof to operate with different master keys. The lock includes one keyway for the usual unlocking key and a second keyway for an emergency or master key. The lock is rekeyed to accept a new master key by inserting the current master key into the second keyway, turning it a quarter turn, and then inserting the new master key and turning it back the quarter turn. The presence of two keyways is evident and distinguishes the exterior of the lock from a conventional lock.

There is thus a need for a lock rekeyable from the exterior thereof, which appears from the exterior thereof to be a conventional lock, and which permits rekeying with the capability of preventing operation of the lock during rekeying and/or by the person rekeying, and which provides security against unauthorized rekeying. There is also a need for an increased security lock which may not be rekeyed unless the lock is removed from the lock assembly, but without disassembling it and without requiring the services of a locksmith. Such a lock would provide increased security against unauthorized rekeying and yet allow a person who is not a locksmith and who possesses minimal mechanical skills to rekey the lock.

DISCLOSURE OF THE INVENTION

It is an object of the present invention to provide a lock which can be rekeyed or programmed to operate with a different key simply and quickly from the exterior of the lock without removing the lock from a lock assembly in which it is assembled.

It is another object of the present invention to provide a lock which is rekeyable from the exterior thereof and which from the exterior of the lock and a lock assembly in which the lock may be assembled appear conventional.

It is another object of the present invention to provide a lock which can be rekeyed from the exterior thereof through the same keyway used to operate the lock.

It is another object of the present invention to provide a lock which can be rekeyed from the exterior thereof from the interior side of a door or other object in which it is installed.

It is another object of the present invention to provide a lock which may be repeatedly rekeyed to selectively operate with different keys, i.e., rekeyed to prevent operation with a first key and permit operation with a second key and then rekeyed to operate again with the first key but not with the second key.

It is another object of the present invention to provide a lock which may be rekeyed from the exterior thereof without permitting the person rekeying the lock to operate it, unless it is specifically desired that the person rekeying the lock also be able to operate it.

It is another object of the present invention to provide a method of improving security in the use of rekeyable locks by providing a lock which may be rekeyed from the exterior thereof without requiring a key which operates the lock.

It is another object of the present invention to provide a rekeyable lock which may have a number of keyed positions, at least one of which may be used for permitting access on a limited security basis for short, selected periods of time, and at least one of which permits access on a higher security basis for longer periods of time.

It is another object of the present invention to provide a lock system including a plurality of locks each rekeyable from the exterior thereof in which one or more of the keys operable with each lock may act as a master key for the lock system.

It is another object of the present invention to provide such a lock system in which another key may operate as a sub-master key for a sub-group of the plurality of locks.

It is another object of the present invention to improve security in the use of master lock systems by providing a lock which must be activated to operate with a master key but which does not require the master key in order to activate the lock for master key operation.

It is another object of the present invention to provide a lock rekeyable from the exterior thereof which utilizes standard cut keys.

It is another object of the present invention to provide a lock rekeyable from the exterior thereof in which the lock may be locked against rekeying without disassembling the lock itself.

It is another object of the present invention to provide a lock which is rekeyable from the exterior thereof, which indicates during rekeying, for example by feel, audibly, etc., the position to which the lock is keyed, and which after rekeying appears from the exterior thereof to be a non-rekeyable lock.

It is another object of the present invention to provide a rekeyable lock which distinguishes keyed positions of the lock and visually indicates from the secure side of the lock the present keyed position-of the lock, and which from the unsecured side of the lock appears to be a non-rekeyable lock.

It is another object of the present invention to provide a lock which may be rekeyed without changing the position or configuration of the pin tumblers which operate the lock.

It is another object of the present invention to provide locks of the type referred to in the above objects of the invention in which security against unauthorized rekeying is improved.

It is another object of the present invention to improve security against such unauthorized rekeying while at the same time permitting the lock to be rekeyed from the exterior thereof without disassembling the lock from the assembly.

It is another object of the present invention to increase the security against such unauthorized rekeying by requiring that the lock be disassembled from a lock assembly but not itself disassembled in order to rekey.

It is another object of the present invention to provide a lock which may be rekeyed from a first position to a second position but may not be rekeyed back to the first position without disassembling the lock from a lock assembly and disassembling the lock itself.

It is another object of the present invention to provide a lock which may be rekeyed from one position to a second position but not back to the first position without disassembling the lock from a lock assembly and disassembling the lock itself, in which rekeying is accomplished from the exterior of the lock without removing the lock from a lock assembly.

Other objects of the present invention are to provide a lock referred to in the above objects from a commercially-available conventional lock which is modified in accordance with the invention, to manufacture the lock from scratch, and/or to manufacture the lock from both conventional, standard lock parts and specially-designed lock parts.

Other objects of the present invention are methods for providing a lock referred to in the above objects, and for providing the lock from a standard lock modified in accordance with the invention.

The invention disclosed herein in its various aspects accomplishes the above and other objects by providing a pin tumbler lock which is assemblable into a lock assembly, rekeyable from the exterior of the lock assembly to be selectively operable by each of a plurality of different keys, i.e., keys of different bit configurations, and which from the exterior of the lock and the lock assembly, at least from the unsecured side of the lock, appear as a conventional lock and conventional lock assembly. In a preferred embodiment, the lock is rekeyed through the lock keyway.

The lock comprises a pin tumbler system including a plurality of pin tumblers and a plurality of rotatable members which cooperate to define a plurality of common shear lines across which selected rotatable members may be rotated by selected keys, and means defining an adjustable shear line adjustable from the exterior of the lock, the lock being operable with only a selected key which positions the pin tumblers to form that common shear line aligned with the adjustable shear line.

The adjustable shear line after adjustment rekeys the lock to require a different one of the plurality of keys to operate the lock. The pin tumblers of the lock when positioned by respective ones of the plurality of keys which operate the lock define respective ones of a plurality of common tumbler shear lines. In order to operate the lock, the adjustable shear line and a common pin tumbler shear line must be aligned to form a lock shear line. Even though a number of common tumbler shear lines may be formed, the only one which permits operation of the lock is the one aligned with the adjustable shear line. The lock is thus operable along only one of the common tumbler shear lines at a time depending upon the position of the adjustable shear line; and once the adjustable shear line is adjusted to a given position, operation of the lock requires a key which will position the pin tumblers to form that common pin tumbler shear line which is aligned with the given adjustable shear line.

In a preferred embodiment, the adjustable shear line is adjusted, as mentioned, through the keyway of the lock by a an actuating member such as a change key insertable into the keyway, so that no additional slots or other entry or access structure is required to rekey, which enables the lock from the exterior thereof at least from the unsecured side of the lock to appear conventional. Once rekeying has been effected, the change key may be removed and the lock remains rekeyed. In another embodiment, the adjustable shear line is adjusted from an end of the lock opposite the end in which the keyway is disposed, for example in a door lock, from the inside of the door.

In a specific embodiment, the rotatable members referred to above are a plurality of cylinders, one disposed in the other, with which the pin tumblers when properly positioned define the plurality of common tumbler shear lines. The lock comprises a casing, the plurality of cylinders, which are rotatably disposed one in the other in the casing, structure closing one end of the lock in which the keyway is disposed, the plurality of pin tumblers and means in the casing and the plurality of cylinders for movably receiving the plurality of pin tumblers. The pin tumblers are positionable by respective keys inserted in the keyway and are configured to form first and second common tumbler shear lines when positioned by first and second properly configured but different keys, respectively.

Specifically, the first common tumbler shear line is formed between a first and a second of the plurality of cylinders when the tumblers are positioned by the first key inserted in the keyway, the first common tumbler shear line permitting rotation of the first cylinder relative to the second cylinder. The second common tumbler shear line is formed between the second cylinder and the casing when the pin tumblers are positioned by the second key inserted in the keyway, the second common pin tumbler shear line permitting rotation of the second cylinder relative to the casing.

The lock includes means for engaging selected cylinders and which defines the adjustable shear line selectively positionable between two selected cylinders and between a selected cylinder and the lock casing. The engaging means may also engage the casing and a selected cylinder or cylinders. In a first position, the adjustable shear line is positioned between the first and second cylinders, and the engaging means may engage the second cylinder and the casing independently of the positioning of the pin tumblers. In a second position, the adjustable shear line is positioned between the second cylinder and the casing, and the engaging means engages the first and second cylinders independently of the positioning of the pin tumblers. In the first position of the adjustable shear line, the first key but not the second key is operable to rotate the first cylinder relative to the second cylinder and the casing. In the second position of the adjustable shear line, the second key but not the first key is operable to rotate the first and second cylinders together relative to the casing.

In a specific embodiment, the engaging means defining the adjustable shear line includes at least one engaging member which is movable from the exterior of the lock and from the exterior of the lock assembly into preselected, fixed but readjustable positions. In a preferred embodiment, two movable engaging members are provided which are disposed adjacent to each other and form the adjustable shear line between the two members. In effect, the at least one engaging member or the two engaging members function as an externally adjustable tumbler which, however, when adjusted remains fixed until readjusted. In that specific embodiment, adjustment per se of the adjustable tumbler, i.e., the at least one or the two engageable members, does not change the positioning and configuration of the pin tumblers.

The engaging means includes structure engageable through the keyway and/or engageable through an end of the lock opposite the one end for operating the engaging means from the exterior of the lock assembly to position the adjustable shear line and selectively engage the cylinders and the casing. The first and second cylinders include means for movably receiving the at least one engaging member, and the engaging means includes structure for moving the at least one engaging member between the first position in which the adjustable shear line is between the first and second cylinders, and the second position in which the adjustable shear line is between the second cylinder and the casing.

According to a presently preferred embodiment, the structure in the engaging means for moving at least one of the engaging members comprises a rotatable cam and the at least one engaging member comprises a spring loaded pin tumbler positioned relative to the rotatable cam to be moved by rotation of the rotatable cam between first and second positions defining the first and second positions of the adjustable shear line.

According to another embodiment, the structure in the engaging means for moving the at least one engaging member comprises a pinion gear and the at least one engaging member comprises a rack positioned relative to the pinion gear to be moved between first and second positions defining the first and second positions of the adjustable shear line by rotation of the pinion gear. A second movable engaging member is provided in the form of a spring-loaded rack extension disposed adjacent the rack and moved by the rack. The rack and the rack extension meet to form the adjustable shear line.

In another embodiment, the at least one engaging member itself is directly movable from the exterior of the lock rather than via structure such as a rotatable cam or a pinion gear. In this embodiment, the engaging member may be a set screw which may be advanced through threaded structure in the cylinders and casing to selectively engage respective cylinders and the casing.

The engaging means also comprises an actuating member which in one embodiment is removably coupleable to the rotatable cam (pinion gear) through the keyway, and in another embodiment, extends when coupled to the rotatable cam (pinion gear) beyond an end of the lock opposite the end in which the keyway is disposed, and is rotatable from the exterior of the lock assembly. The rotatable cam (pinion gear) and the actuating member include mutually engageable structure for engaging and rotating the rotatable cam (pinion gear) upon rotation of the actuating member.

In still another embodiment, the engaging means defining the adjustable shear line may only be adjusted when the lock has been disassembled from a lock assembly. In specific embodiments, a rotatable cam, pinion gear or set screw is provided as described above, but access to rotate the cam, gear or screw is provided only upon disassembly of the lock from the lock assembly. However, the lock itself need not be disassembled in order to rotate the cam, gear or screw to thereby rekey the lock.

In the illustrated embodiment, the lock includes three cylinders, one disposed in the other. In addition to the first and second cylinders referred to above, the lock includes a third cylinder. The first cylinder may be an inner cylinder, the second cylinder an intermediate cylinder and the third cylinder an outer cylinder, the first and second cylinders being rotatably disposed in the third cylinder. The third cylinder also includes means for movably receiving the pin tumblers.

The pin tumblers are configured to form the first common pin tumbler shear line between the first and second cylinders to permit rotation of the first cylinder relative to the second and third cylinders and the casing when the pin tumblers are positioned by the first key. The pin tumblers are also configured to form the second common pin tumbler shear line between the second and third cylinders to permit the first and second cylinders to rotate relative to the third cylinder and the casing when the pin tumblers are positioned by the second key. The pin tumblers are also configured to form a third common pin tumbler shear line between the third cylinder and the casing when the pin tumblers are positioned by a third key different from the first and second keys inserted in the keyway. The third common pin tumbler shear line permits rotation of the first, second and third cylinders relative to the casing. The engaging means also selectively engages the first, second and third cylinders independently of the positions of the pin tumblers.

The first key but not the second and third keys is operable to rotate the first cylinder relative to the second and third cylinders and the casing across the first common pin tumbler shear line when the engaging means positions the adjustable shear line in its first position; the second key but not the first and third keys is operable to rotate the first and second cylinders together relative to the third cylinder and the casing across the second common pin tumbler shear line when the engaging means positions the adjustable shear line in its second position; and the third key but not the first and second keys is operable to rotate the first, second and third cylinders together relative to the casing across the third common pin tumbler shear line when the engaging means positions the adjustable shear line in its third position while at the same engaging the first, second and third cylinders.

According to one aspect of the invention, the lock includes means operable from an end of the lock opposite the closed end for positively engaging the at least one engaging member to resist movement thereof and thereby lock the at least one engaging member in a selected position. In one embodiment, the means for positively engaging comprises a set screw and a threaded hole in the lock positioned to open adjacent the at least one engaging member, the set screw being selectively tightenable in the hole into engagement with the engaging member to prevent repositioning of the at least one engaging member.

According to another aspect of the invention, the lock includes means cooperating with the at least one engaging member for indicating at least when the at least one engaging member is in one of the positions. The indication may be visual, and/or audible and/or felt manually. In the embodiment in which the rotatable cam and the pin tumbler are provided, the means for indicating comprises a detent arrangement including a spring-loaded detent member urged against the rotatable cam and structure on the cam which receives and seats the detent member in the positions of the cam. In the embodiment in which the rack and the rack extension are provided, the means for indicating comprises a detent arrangement including a spring-loaded detent member urged against the rack and structure on the rack which receives and seats the detent member in the positions of the rack. In those embodiments, the detent arrangement provides a manually sensible indication and/or an audible indication that the detent member is seated in the detent structure of the cam (rack). In another embodiment, the means for indicating comprises a pointer and a scale which visually indicate the position of the cam (rack), the pointer being moved to uniquely indicate positions corresponding to the positions of the cam (rack).

According to another aspect of the invention, a rotatable member of the engaging means (e.g., cam, pinion gear, set screw) includes structure engageable by a specially-configured key inserted in the keyway. According to one embodiment, the specially-configured key comprises a bit having a specially-configured tip which engages mating structure in the rotatable member for rotating the rotatable member, the bit when engaged with the rotatable member not moving the tumblers from a rest position thereof.

The security of rekeyable locks which are rekeyed from the exterior thereof may be improved by restricting or blocking access to the rekeying means in the interior of the lock which is adjusted from the exterior of the lock to rekey it. In specific embodiments, security or restricting or blocking means are provided which restrict or block access to such rekeying means and which must be moved before the lock can be rekeyed from the exterior thereof. In specific embodiments, the rekeying means is the engaging means described above and the security means block access thereto and must be moved before an actuating member may engage the engaging means to rekey the lock.

In one embodiment, the security or blocking means comprises a spring-loaded gate or shutter which blocks access to the engaging means (e.g. the rotatable cam). The gate is movable against the spring by a camming member. The gate is disposed in the slot of a stationary shield member which provides limited access to the gate to cam it. Holes are provided in the gate and shield which must be registered upon movement of the gate to provide access to the engaging means.

In another embodiment, the security means comprises a gate or shutter which blocks access to the engageable means and is movable in a slot of a shield member which rotates with the inner cylinder. Rotation of the inner cylinder rotates the shield which causes the gate to move, and holes in the gate and shield to register to provide access to the engaging means. An actuating member must be inserted into the shield and gate prior to completion of rotation. Thus, it is necessary to have a key which operates the lock in order to rotate the inner cylinder and at the same time insert the actuating member into the shield.

In another embodiment, the security or blocking means comprises a plurality of spring loaded gates, one of which must be rotated and the other of which must be moved linearly to register holes in the two gates through which access is provided to the engaging means. In this embodiment, the linearly moved gate may be spring-loaded in a stationary shield member as described in the first security means embodiment described above. Preferably, the rotatable gate is also spring-loaded in the shield.

In another embodiment, the security means comprises a lock structure in the engaging means requiring a properly configured key to unlock and rotate the engaging means. For example, the lock structure and key may be of the skeleton type. This security means structure may be provided in addition to or in place of other security means structure described herein.

Additional security against unauthorized rekeying may thus be provided by utilizing the security means described above. Alternatively, security against unauthorized rekeying may be provided according to the invention by requiring that a lock can only be rekeyed when it is disassembled from its lock assembly, but the lock itself need not be disassembled.

According to the invention, a method is provided of increasing the security of a rekeyable lock which comprises; providing a lock which is rekeyable from the exterior thereof with an actuating device inserted in the keyway of the lock; keying the lock to a first keyed position to be operable with a first key; giving the actuating device to one person; and giving a second key which operates the lock in a second keyed position thereof to another person; whereby both the one and the other persons must be present to operate the lock in the second keyed position thereof.

According to another method of the invention, a lock which may be adjusted from the exterior thereof to operate with selected ones of a plurality of different keys is provided by: providing a pin tumbler lock having a plurality of cylinders and a plurality of sets of pin tumblers, each set being capable of forming a plurality of individual pin tumbler shear lines; providing structure which forms an adjustable shear line which is adjustable into a plurality of positions from the exterior of the lock either through the keyway thereof or from the end of the lock opposite the end having the keyway; configuring and arranging the cylinders and the pin tumblers to be capable of aligning the individual pin tumbler shear lines to form a plurality of common pin tumbler shear lines in alignment with respective ones of the plurality of positions of the adjustable shear line when the pin tumblers are positioned by respective ones of the plurality of keys, which common pin tumbler shear lines permit rotation of a selected cylinder or cylinders relative to another cylinder or other cylinders and a casing of the lock and prevent rotation of the another cylinder or other cylinders relative to the casing; providing an actuating device capable of adjusting the adjustable shear line from the exterior of the lock through the keyway thereof or from the opposite end mentioned above; whereby the lock may be operated by a given one of the plurality of keys only if the common pin tumbler shear line formed by that given key is aligned with a position of the adjustable shear line.

According to another method of the invention, a lock which may be adjusted to operate with selected ones of a plurality of different keys from a conventional radial pin tumbler lock having a casing which includes structure cooperating with a plurality of pin tumblers is provided by: providing a plurality of cylinders, one disposed in the other, an inner cylinder including a keyway therein, the cylinders being configured to cooperate with the structure in the casing to receive a plurality of pin tumbler sets in communication with the keyway for actuation by a key inserted in the keyway; providing structure defining an adjustable shear line which is adjustable into a plurality of positions from the exterior of the lock through the keyway thereof or through an end of the lock opposite the end having the keyway; providing a plurality of pin tumbler sets each capable of forming a plurality of individual shear lines and when installed in the lock and actuated by a respective key, further capable of forming a plurality of common pin tumbler shear lines aligned with respective ones of the plurality of positions of the adjustable shear line, the common pin tumbler shear lines permitting rotation of a selected cylinder or cylinders relative to another cylinder or other cylinders and to a casing of the lock and prevent rotation of the another cylinder or other cylinders relative to the casing; providing an actuating device capable of adjusting the adjustable shear line from the exterior of the lock through the keyway thereof or from the opposite end; whereby the lock may be operated by a given one of the plurality of keys only if the common pin tumbler shear line formed by that given key is aligned with a position of the adjustable shear line.

A lock according to the present invention includes a number of features, and may advantageously be used under a wide variety of circumstances and for a number of applications. Because the lock is rekeyable from the exterior thereof and is so easy to rekey, almost anyone including a child can effect rekeying. A locksmith or a mechanically-inclined person is not required. For example, a parent, with a child at home, who loses a key or has a key stolen while out of the home on an errand or at work, may simply telephone home and request that the child rekey the lock. As mentioned, the lock may be rekeyed quickly and easily, and may even be rekeyed from the secured side of the lock, i.e., from the inside of a locked door without opening the door. As a general matter, a person who loses a key or has it stolen may telephone a neighbor, friend, his landlord, the superintendent, etc., who was given a change key, and request that the lock be rekeyed. The lock may later be rekeyed to accept the previous key so that the person may reenter his home, or if the person was already carrying the new key which the lock had been rekeyed to accept, the lock may be left rekeyed. In accordance with a feature of the invention, the person having the change key does not also have access to the home (or car, office, room, etc.) unless he was also given a key which operates the lock.

Quite often, access is required to a person's home for making repairs or for accepting a delivery. One keyable position of the lock may be reserved as an "access" position to allow for such access while at the same time reserving another keyable position as a "safe" position. Prior to leaving the home, the person would rekey the lock to the access position and leave an "access" key for that position with a friend, neighbor, the landlord, the repairman, etc. Later, after the access key was returned, the lock would be rekeyed to the safe position in which the access key would not work. Thus, even if a copy of the access key had been made, or if the access key had not been returned or was lost, rekeying of the lock to the safe position ensured security. As long as there was no reason to suspect that security was compromised by giving out the access key, the access position of the lock and the access key could be used again in the future.

There are many other instances for employing safe and access positions. For example, an access key may be given to a housekeeper, or to a neighbor for entry to care for pets or plants during the day or during a vacation or business trip. Automobile owners often worry about parking attendants making copies of home keys attached to the key ring holding the car keys. Should an automobile owner become concerned, he simply has to telephone a person to whom he has given a change key and request that the lock be rekeyed to a position which the key on the key ring will not operate. A rekeyable lock according to the invention may also be advantageously in automobiles, particularly as an ignition lock. As an ignition lock, the lock would usually be keyed to the safe position and only rekeyed to the access position when the automobile is to be left with a parking attendant at a garage, restaurant, etc., or left with a repair facility. Since the lock may be rekeyed quickly and easily from the exterior thereof, the lock may be rekeyed to the access position immediately prior to reaching, or right at, the garage, restaurant, repair facility, etc., and then rekeyed back to the safe position as soon as the automobile is returned or driven away. The invention also has application to increasing security in vehicle leasing operations. For example, the ignition lock may be rekeyed after each vehicle is returned to prevent operation of the vehicle with an ignition key which was not returned or copied.

Still further uses of the rekeyable lock according to the invention utilizing access and safe positions are possible. For example, if more security is desired before the lock may be unlocked in the access position thereof, the lock may be left in the safe position, and the change key given to one person and the access key given to another person. With the lock in the safe position, security is assured since no one has a safe key except the owner. However, to unlock the lock in the access position, both the person having the change key and the person having the access key must be present before the lock may be rekeyed to the access position and unlocked. This may be of use where a person does not know his neighbors well, but must provide access to his home in his absence, or where it is desired that two people be present before entry is permitted. For example, a landlord may not wish to have access to an apartment without another person being present so as not to be be in a position of being suspect if anything is missing from the tenant's apartment. In that case, the landlord may be given the access key, a neighbor the change key, and the lock be left in the safe position. Such use may also have industrial or military applications with respect to entry into restricted areas.

A lock in accordance with the invention may be provided with three rekeyable positions, and used, for example, with a first position being the access position, a second position being the safe position and a third position being an ultra-safe position. The access and safe positions may be utilized as described above. The ultra-safe position may be utilized in instances in which the highest security against entry by an authorized or formerly authorized key is desired. That is accomplished by simply not giving out the ultra-safe key and rekeying the lock to the ultra-safe position whenever the highest security is desired. The ultra-safe position may be utilized when a person is to be away from his home for extended periods, as, for example, when on vacation or a business trip. In a two-position rekeyable lock, the safe position may also function as an ultra-safe position if access to the safe key is severely restricted.

There are instances in which multiple copies of the same key are distributed for use, for example, by employees. Should an employee upon termination either refuse or forget to surrender his key, the employer need only rekey the lock, and not change it, and distribute new keys to the remaining employees to prevent entry by the terminated employee while still permitting entry by the remaining employees.

Under some circumstances, a landlord may wish to lock a tenant out of his apartment. Using a lock according to the invention allows that to be done by the landlord by rekeying the lock from the exterior of the apartment, which does not require that the landlord enter the apartment. In addition, such rekeying does not provide a visual indication that the tenant has been locked out, as opposed to padlocking the door or changing the lock.

A lock according to the invention which may be rekeyed from the inside of a door in which it is installed provides other advantages. Should one in his home wish to prevent someone else having an access key from entering, he may do so without opening the door and without the other person knowing, even as that person approaches the door.

A lock according to the invention may be provided having the capability for use as a construction lock, or an equipment lock which, is rekeyed after completion of construction or sale of the equipment, etc. Specifically, such a lock may be rekeyed from a first position to a second position and includes structure which prevents the lock from being rekeyed back to the first position unless the lock is disassembled. Thus, the lock may be keyed to the first position during construction and a number of keys issued to construction workers. Upon completion of construction, the lock is rekeyed to the second position so that the construction key issued to the construction workers no longer operates the lock. Since the lock cannot be rekeyed back to the construction position, the lock is secure against unlocking by the large number of outstanding construction keys. Similarly, prior to sale of equipment such as an automobile, a lock such as an ignition lock is keyed to the first position and "dealer" keys issued to dealer and service personnel. Upon sale of the equipment, the lock is rekeyed to the second position and can't be rekeyed back to the first position without disassembling the lock. Thus, the automobile is safe from theft by anyone possessing a "dealer" key after sale to a consumer.

Since a lock according to the invention may be rekeyed a number of times to accept different keys, e.g., three, the lock provides a multiplication factor over conventional locks which are not rekeyable. Thus, where locks are changed often (as conventional interchangeable core locks are), a lock according to the invention could replace three locks, which would allow the purchase of a higher quality lock since it would last three times longer.

A system of locks may be configured so that one of the keyable positions is opened by the same master key. The other keyable positions may be used as described above and in other ways. The master lock system may be configured to operate with two different master keys. In that case, the locks may be configured so that in a first keyed position, all locks are operable with a first master key, and in a second keyed position, all locks are keyed to be operated with a second master key different from the first master key. If desired, the second master key may be a sub-master key, which may operate only a sub-group of the system of locks.

Locks according to the invention may be used in door locks, car locks, mail box locks, locker locks, safety deposit boxes, padlocks, padlocks with interchangeable cores, and other locks. With respect to door locks, the lock may be used in mortise locks, rim cylinder locks, cylinder-in-knob locks, interchangeable core locks and other types of door locks.

As discussed above, the lock may be made from a standard commercially available lock which is modified as described herein, or the lock may be manufactured as a rekeyable lock at the factory from scratch, or manufactured from both specially-designed parts and standard lock parts.

BRIEF DESCRIPTION OF THE DRAWINGS

The present invention is illustrated by way of example and not limitation in the figures of the accompanying drawings in which like references indicate like parts, and in which:

FIG. 5 is a perspective view of a lock according to the invention, assembled into a lock assembly installed in a door, and a change key for rekeying the lock to cause it to operate with a different key;

FIG. 6 is an enlarged perspective view of the change key depicted in FIG. 5;

FIG. 14 is a radial section view of the lock depicted in FIG. 10 taken along line 14—14 of FIG. 10;

FIG. 15 is a radial section view similar to FIG. 14 of the lock and first key depicted in FIG. 11 with the first key being rotated to rotate the inner cylinder across the first lock shear line relative to the intermediate and outer cylinders and the casing;

FIG. 16 is an axial section view of the lock depicted in FIG. 10 with the change key inserted therein for adjusting the rack and the position of the adjustable shear line through the keyway from the exterior of the lock;

FIG. 17 is a radial section view of the lock depicted in FIG. 16 taken along line 17—17 of FIG. 16;

FIG. 18 is a radial section view similar to FIG. 16 depicting the lock and first key of FIG. 11 with the pin tumblers and rack being positioned to form the first lock shear line and with the first key being rotated to rotate the inner cylinder;

FIG. 19 is a section view of the lock of FIG. 17 taken radially therethrough depicting the detent arrangement and the set screw which cooperate with the rack to indicate the position of the rack (and adjustable shear line) and lock the rack in a given position, respectively, partly broken away to expose pin tumbler structure in the lock;

FIG. 20 is an enlarged perspective view of the pinion gear and the change key of the lock of FIG. 5 depicting the specially-configured mating structure of the pinion gear and the change key;

FIG. 21 is a perspective view of the pinion gear and the change key of the lock according to another embodiment of the invention in which the specially-configured mating structure of the pinion gear and the change key differ from that of FIG. 20;

FIG. 22 is a rear perspective view of the lock depicted in FIG. 5 in its fully assembled condition outside of the lock assembly;

FIG. 23 is a partially exploded, rear perspective view of the lock depicted in FIG. 22 illustrating disassembly thereof;

FIG. 24 is a rear view of the lock depicted in FIG. 23 in a further disassembled state thereof showing the pinion gear;

FIG. 28 is a radial section view of the lock of FIG. 25 depicting the lock in its first keyed position in which the rack is in its first position and the first adjustable shear line is in its first position between the inner and the intermediate cylinders;

FIG. 29 is a view similar to FIG. 28 depicting the lock rekeyed from the position in FIG. 28 to its second keyed position in which the rack is in its second position and the adjustable shear line is in its second position between the intermediate and the outer cylinders;

FIG. 42 is a section view of the key depicted in FIG. 41 taken along line 42—42 thereof;

FIG. 43 is a section view of the lock depicted in FIG. 41 taken along line 43—43 thereof;

FIG. 44 is a section view of the lock depicted in FIG. 41 taken along line 44—44 thereof;

FIG. 48 is a perspective view, partially cut away and partially in section, of a lock according to another embodiment of the invention in which the lock must be disassembled from a lock assembly in order to rekey it;

FIG. 49 is a perspective view of a rotatable cam in the lock of FIG. 48.

FIG. 53 is an exploded perspective view of the gate mechanism and rotatable cam depicted in FIG. 50;

FIG. 54 is an axial section view of a portion of a lock incorporating security means according to another embodiment comprising a gate mechanism similar to that depicted in FIG. 50 and lock structure in the rotatable cam;

FIG. 55 is a section view of the gate structure depicted in FIG. 54 taken along line 55—55 thereof;

FIG. 56 is a perspective view of a portion of a key for unlocking the rotatable cam lock structure depicted in FIGS. 54–55;

FIG. 57 is a radial section view of a portion of the lock of FIG. 41 taken along line 57—57 thereof showing security means according to another embodiment comprising a gate mechanism which includes a rotatable shield and a movable gate;

FIG. 58 is an axial section view of the gate mechanism of the lock of FIG. 41 taken along line 57—57 thereof;

FIG. 59 is a radial section view of the gate mechanism depicted in FIG. 57 showing the gate moved to an intermediate position during rekeying;

FIG. 60 is a radial section view of the gate mechanism depicted in FIG. 57 showing the gate moved to another position during rekeying;

FIG. 61 is a section view of the gate mechanism depicted in FIG. 60 taken along line 61—61 thereof;

FIG. 62 is an exploded perspective view of the gate mechanism depicted in FIG. 57;

MODES FOR CARRYING OUT THE INVENTION

Figure 1:
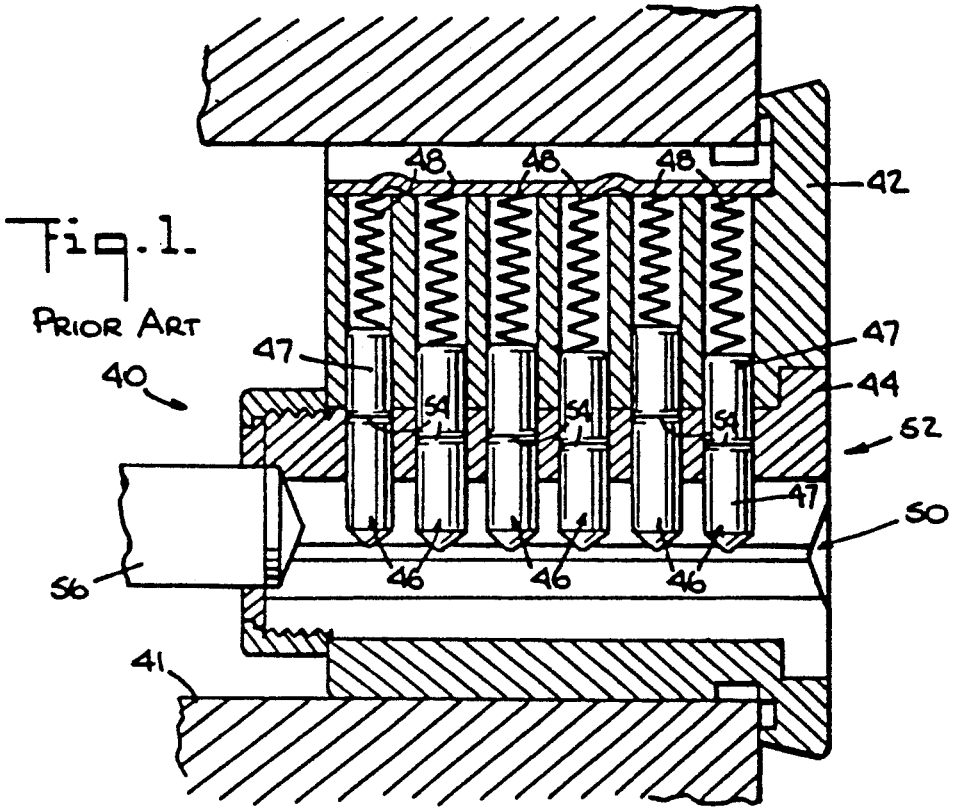
Fig. 1. Prior Art
FIG. 1 is a section view of a prior art pin tumbler lock taken axially through the lock depicting the lock in its locked condition without a key inserted therein and a portion of a door in which the lock is installed.

Referring now to the drawings, FIGS. 1–4 illustrate the construction and operation of a conventional single cylinder, single lock shear line, pin tumbler lock, and FIGS. 4–30 illustrate the construction and operation of presently preferred embodiments of the invention. The conventional lock of FIGS. 1–4 is described first as background, and as an aid to facilitate an understanding of the invention.

Figure 2:
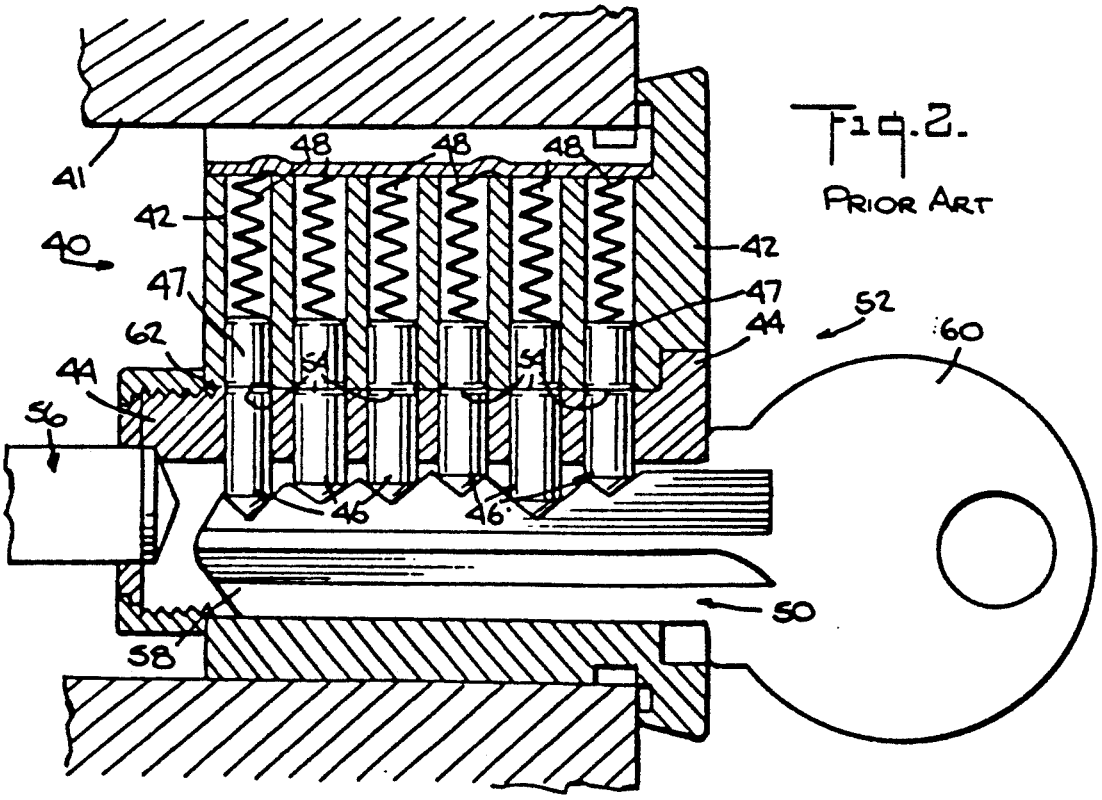
Fig. 2. Prior Art
FIG. 2 is an axial section view similar to FIG. 1 depicting the lock of FIG. 1 with a key inserted therein which positions the lock pin tumblers to form a shear line for unlocking the lock.
Figure 3:
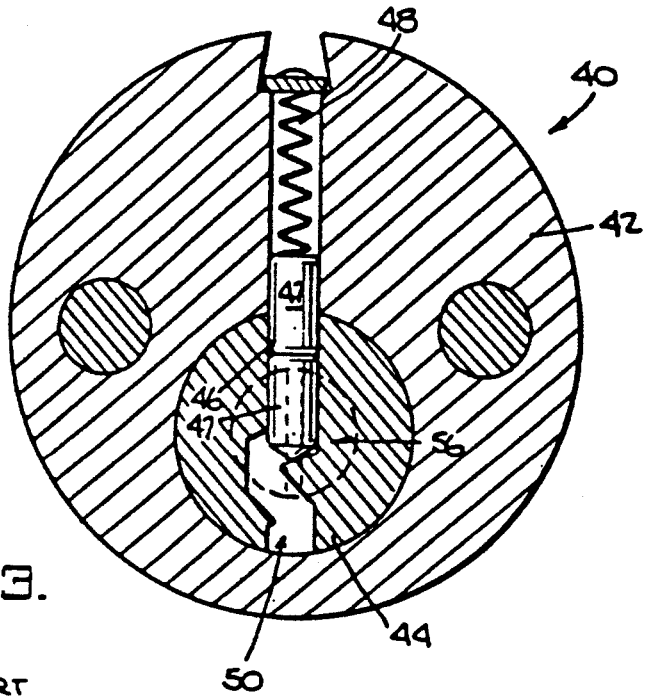
Fig. 3. PRIOR ART
FIG. 3 is a section view of the lock of FIG. 1 taken radially through the lock.

Conventional pin tumbler lock 40 in FIGS. 1 and 2 is depicted installed into a door 41 as part of a lock assembly that is not shown in the drawings. The lock assembly may be a conventional rim lock assembly or a conventional mortise lock assembly which are well known in the art. Lock 40 includes a casing 42, a single rotatable cylinder 44, six pin tumbler sets 46 and structure in the cylinder and the casing for receiving the pin tumbler sets. Each pin tumbler set 46 includes two pin tumblers 47, and a spring 48 to radially bias the pin tumblers of the respective set into a keyway 50 extending within cylinder 44 from end 52 of the lock. The two pin tumblers of each pin tumbler set 46 meet at a respective individual pin tumbler shear line 54. As depicted in FIG. 1, the individual pin tumbler shear lines 54 are offset one from the other so that a number of pin tumblers 47 extend across the adjacent circumferences of casing 42 and cylinder 44. As long as any one pin tumbler extends across the adjacent circumferences of cylinder 44 and casing 43 (see FIG. 3), rotation of cylinder 44 relative to casing 42 is prevented. The lock assembly in which lock 40 is assembled includes a mechanism for locking and unlocking a bolt or latch (not shown), only part of that mechanism being shown, as referenced generally by 56. Mechanism 56 is coupled to cylinder 44 to be rotated therewith and causes locking and unlocking of the bolt or latch of the lock assembly when cylinder 44 is rotated. Thus, lock 40 and the lock assembly in which it is installed can only be locked and unlocked by rotation of cylinder 44.

Figure 4:
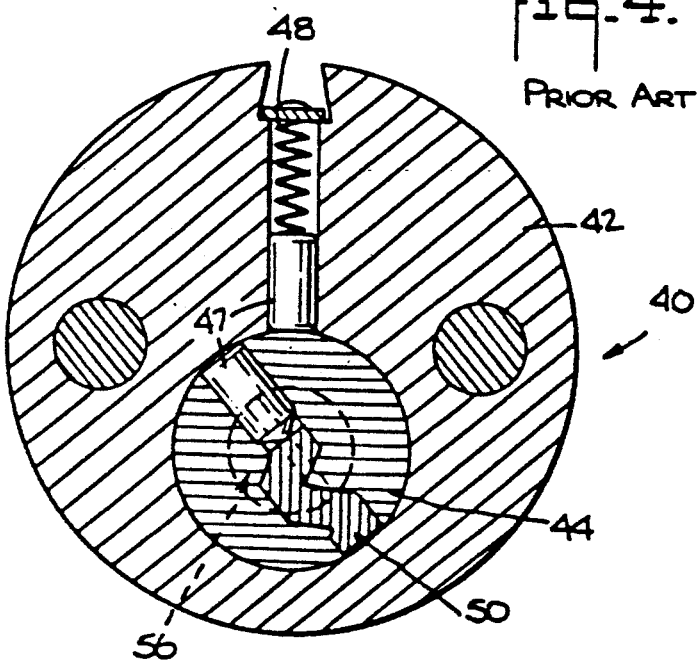
Fig. 4. PRIOR ART
FIG. 4 is a radial section view similar to FIG. 3 of the lock and key of FIG. 2 with the key rotated to rotate the lock cylinder through a common pin tumbler shear line formed by the pin tumblers.

Referring to FIG. 2, the bit 58 of a suitably-configured key 60 inserted in keyway 50 positions the respective tumblers 47 of tumbler sets 46 so that the respective individual tumbler shear lines 54 of the respective tumbler sets extend along a common tumbler shear line 62 located between the adjacent circumferences of cylinder 44 and casing 42. In that position of the tumblers, no tumbler extends across the adjacent circumferences of cylinder 44 and casing 42 so that cylinder 44 may be rotated relative to casing 42 across common tumbler shear line 62 (which is also the lock shear line) by key 60, as shown in FIG. 4, to lock or unlock lock 40. In lock 40, each tumbler set 46 includes two tumblers, but as is conventional in the art, the tumbler sets 46 may include a different number of tumblers.

In the lock construction depicted in FIGS. 1–4, only a single common tumbler (or lock) shear line 62 can be formed which will allow rotation of cylinder 44 in casing 42, and the common shear line 62 can only be changed by changing at least one of the tumblers of the tumbler sets 46. Thus, rekeying can only be accomplished by changing the configuration of the pin tumblers, which requires disassembly of the lock, which in turn almost always requires the services of a qualified locksmith, as discussed above. As also discussed above, this precludes easy rekeying of such locks to reject unlocking with an old, formerly authorized key and accept unlocking with a new key.

A lock made in accordance with the invention, however, as summarized above, permits easy rekeying of the lock from the exterior thereof to reject operation with a formerly authorized key and permit operation with a new key.

Referring now to FIG. 5, lock 70 according to the invention is assembled into a conventional mortise lock assembly 71 installed in door 41. No changes need be made to lock assembly 71 to accomodate lock 70, which may be installed in lock assembly 71 conventionally in place of current mortise lock cylinders. Although the lock assembly into which lock 70 is installed is depicted as a mortise lock assembly, lock 70 may be assembled into a rim lock assembly as well. When assembled into a rim lock assembly, the casing of lock 70 will be modified accordingly, for example by removing exterior screw threads on the casing used to mount the lock in a mortise lock assembly. A change key 72 (actuating member) is provided to rekey lock 70 to reject operation with an old key and permit operation with a new key. To accomplish that, change key 72 is inserted in keyway 74, which is a conventional keyway, but need not be, and rotated to move the adjustable shear line referred to above in lock 70. Operation of lock 70 requires that one of the common pin tumbler shear lines referred to above be formed in alignment with the adjustable shear line to operate the lock. Each adjustment of the adjustable shear line to a new position requires that a different key be used to position the tumblers to form a common pin tumbler shear line aligned with the new position of the adjustable shear line to operate lock 70. Since the adjustable shear line is easily adjusted without disassembly of the lock from the exterior of lock 70 and lock assembly 71 by change key 72, lock 70 may easily and simply be rekeyed to require a new key to operate the lock by almost anyone in the household, including young children. As shown in FIG. 6, tip 76 of key 72 is specially configured, e.g., in the shape of "Y", to engage a mating Y-shaped recess in lock 70 for effecting rekeying as described in more detail below. The use of a Y shape is illustrative, and other tip configurations may be used, as shown, for example, in FIG. 21. Since a change key alone can not lock or unlock lock 70, the particular tip configurations used are not critical. However, providing a number of different tip configurations which are mutually exclusive increases overall security in that someone with a formerly authorized key or an access key, etc., or a person who seeks to rekey the lock by tampering with it, will not be able to rekey the lock back to a keyed position which accepts the formerly authorized key or access key without a proper change key.

Figures 7, 10:
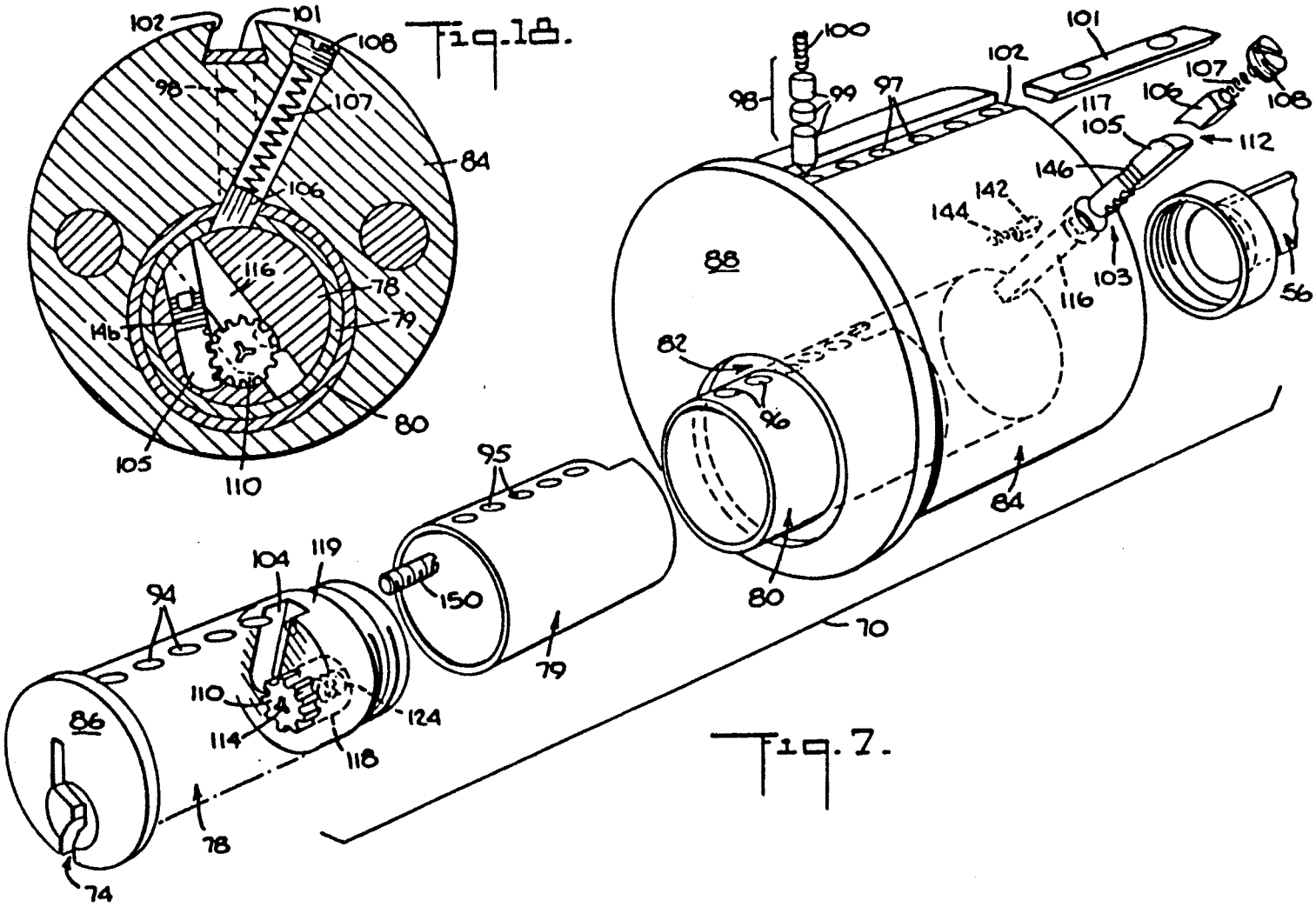
FIG. 7 is an exploded perspective view of the lock according to the invention.
FIG. 10 is a section view of the lock according to the invention taken axially through the lock depicting the lock in its first keyed position in which the rack is in its first position and the adjustable shear line is in its first position between the inner and intermediate cylinders, the lock being depicted without a key inserted therein installed in a door, a portion of which is also depicted.

Referring to FIG. 7, lock 70 includes a plurality of cylinders which permit a corresponding plurality of common pin tumbler shear lines to be formed by different keys which position properly configured conventional pin tumblers. In the embodiment depicted in FIG. 7, lock 70 includes three cylinders, first inner cylinder 78, second intermediate cylinder 79 and third outer cylinder 80. Cylinders 78, 79 and 80 are concentrically disposed, but need not be, relative to each other and are disposed in a bore 82 of casing 84 which extends eccentrically of casing 84. Inner cylinder 78 includes an end 86 and casing 84 includes an end 88 which together form a closed outer end of lock 70. End 86 of inner cylinder 78 is of enlarged diameter compared to the diameter of cylinder 78 and forms a shoulder against which the edges of cylinders 79 and 80 abut to form the closed end of the lock. Keyway 74 is conventional and is disposed in end 86 of cylinder 78. Each of cylinders 78, 79 and 80, and casing 84 includes a series of holes 94, 95 96 and 97, respectively, respective ones of which are registered in the assembled condition of the lock and receive therein pin tumblers of respective tumbler sets referenced generally by 98, only one of which is shown in FIG. 7. Pin tumbler set 98 depicted in FIG. 7 and the other tumbler sets of lock 70 include three pin tumblers 99 which at adjacent ends thereof form three individual pin tumbler shear lines, which facilitate the formation of three common pin tumbler shear lines, as described in more detail below. Pin tumbler sets 98 may include more than three pin tumblers to increase the total number of key configurations which will form common pin tumbler shear lines and operate the lock. If desired, in a particular lock system, the size of one or more cylinders may be varied among locks or groups of locks to increase the total number of key configurations available in the system to operate the different locks. Pin tumbler sets 98 also include a spring 100 for urging the pin tumblers radially inwardly. Elongated plate 101 and elongated recess 102 in casing 84 are provided to maintain tumbler sets 98 in their respective holes.

In the embodiment depicted in FIG. 7, casing 84 and inner cylinder 78 were part of a conventional lock, such as lock 40 depicted in FIGS. 1–4. As compared to lock 40, casing 84 was bored out to receive additional cylinders 79 and 80, and casing 84 and cylinder 78 were further modified to accept a rack and pinion arrangement 103, which is described below. In order to accomodate rack and pinion arrangement 103, a slot 104 is formed in cylinder 78 where a tumbler hole was formerly located. As a result, cylinder 78 has five tumbler holes 94 while casing 84 has six tumbler holes 97 corresponding to the six tumbler holes in casing 44 of lock 40. While lock 70 may thus be fabricated from a conventional lock by modifying it and adding parts, lock 70 may also be specially manufactured as a unit.

Figure 8:
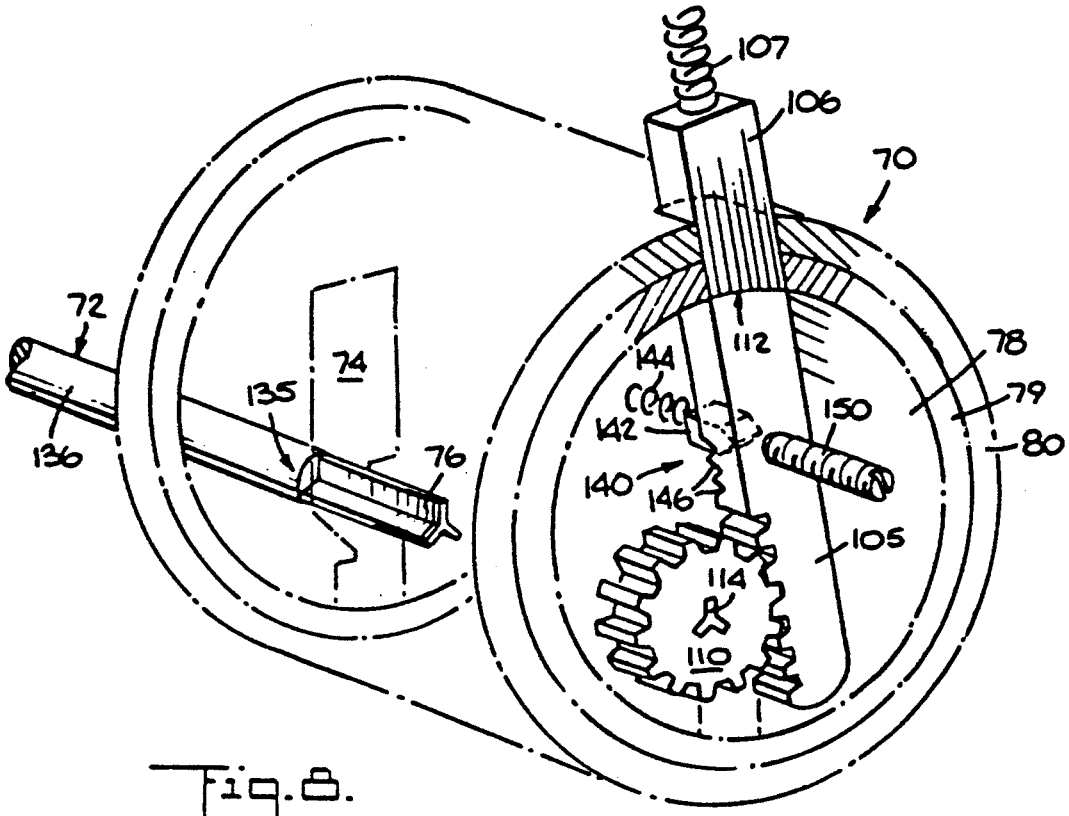
FIG. 8 is perspective view partially in phantom of a portion of the lock according to the invention depicting an inner cylinder, an intermediate cylinder and an outer cylinder of the lock, and a rack and pinion arrangement for forming a shear line adjustable from the exterior of the lock through the keyway by the change key, the rack being positioned in its first position to place the adjustable shear line in its first position between the inner and intermediate cylinders.
Figure 9:
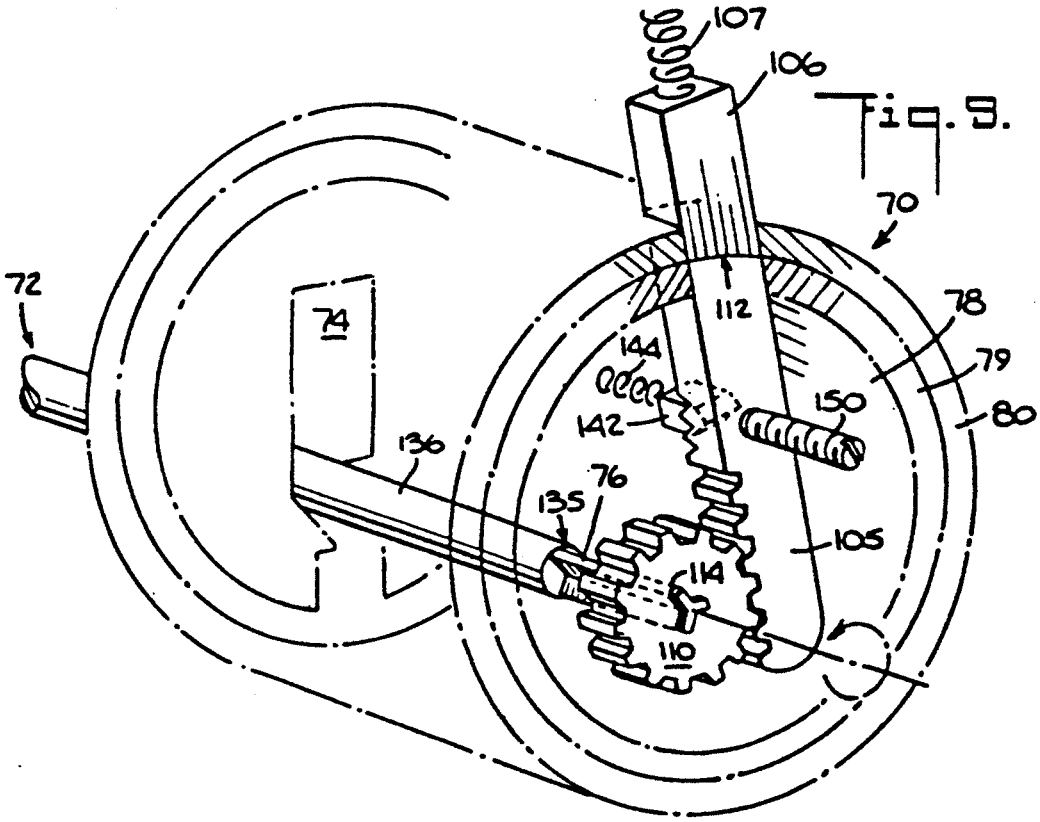
FIG. 9 is a view similar to FIG. 8 depicting adjustment of the adjustable shear line by rotation of the change key inserted in the pinion gear of the rack and pinion arrangement to position the rack in its second position which places the adjustable shear line in its second position between the intermediate and outer cylinders.
Figure 10:
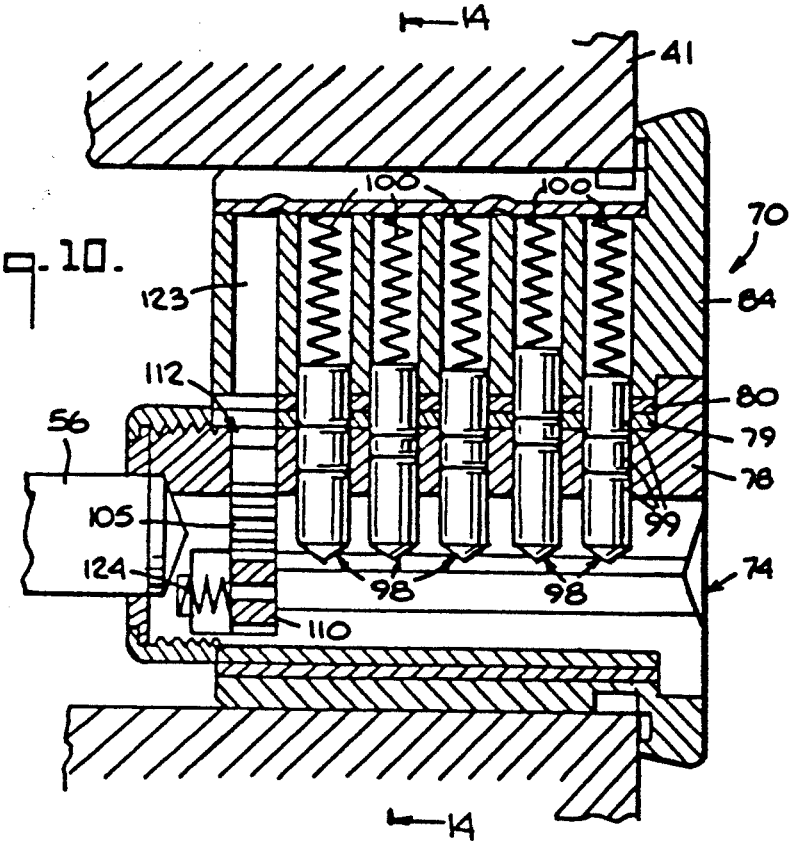

As depicted in FIGS. 7–9, rack and pinion arrangement 103 (means for engaging) includes a rack 105 (at least one movable member), a rack extension 106 (another movable member), a spring 107, a screw 108, a pinion gear 110 (rotatable member) and structure in lock 70 for receiving those parts. Rack 105 and rack extension 106 abut and form a rack shear line 112 which is the adjustable shear line referred to above. Rack 105 and rack extension 106 function as a tumbler which, however, is not operated by a key, but rather is moved by pinion gear 110 to adjust the position of adjustable shear line 112. Pinion gear 110 in turn is rotated from the exterior of lock 70 by change key 72, as described above. Pinion gear 110 includes structure in the form of a specially-configured recess 114 which matingly receives and is engaged by the correspondingly shaped tip 76 of change key 72, as described above. As the sequence of FIGS. 8 and 9 illustrates, the tip 76 of change key 72 is inserted in keyway 74 into engagement with pinion gear 110 and rotated to rotate pinion gear 110 and move rack 105 and rack extension 106.

To accommodate rack 105, rack extension 106, spring 107 and screw 108, a slot 116 is formed in casing 84 adjacent an end 117 thereof opposite end 88. A cylindrical recess 118 is formed in end 119 of cylinder 78 communicating with slots 104 and with slot 116 of casing 84 in the assembled condition of the lock so that rack 105 and pinion gear 110 may mesh when assembled into slot 104 and recess 118, respectively. When constructing lock 70 from a conventional lock, care must be exercised in positioning slot 104 and recess 118 because of the limited space available in the cylinder supplied with the conventional lock. A suitable angle for slot 104 in cylinder 78 (and slot 116 in casing 84) has been found to be 15 degrees with respect to the vertical, i.e., with respect to the axis of the lock, with slots 104 and 116 extending to one side of the central axis of the lock. At that angle, slot 104 passes through a line running through or adjacent the tumbler holes of cylinder 78, which requires that the hole adjacent end 119 of cylinder 78 be slotted. Cylinders 79 and 80 are slotted at corresponding locations. Slot 104 is offset from the central axis of cylinder 78 to provide more space on one side of the central axis in which to position the recess 118, which is correspondingly offset. Other positions of slot 104 and recess 118 may be provided whether in a cylinder of a conventional lock or a specially manufactured cylinder. When rack and pinion arrangement 103 is assembled in lock 70, screw 108 and spring 107 urge rack extension 106 radially inwardly against rack 105 which is urged into meshing engagement with pinion gear 110.

Lock 70 operates as follows. Referring to FIGS. 10 and 14, which depict lock 70 itself fully assembled and in FIG. 11 assembled into lock assembly 71 as well, the pin tumblers 99 of tumbler sets 98 are urged by springs 100 radially inwardly into keyway 74. The individual pin tumblers 99 of tumbler sets 98 are configured so that the tumbler sets do not form a common tumbler shear line without a key inserted in keyway 74, as depicted in FIG. 10. The adjustable shear line 112 formed by rack and pinion arrangement 103 is adjusted to be positioned between two adjacent cylinders or between outer cylinder 80 and casing 84, depending on the last adjustment of rack 105 and rack extension 106. In the state depicted in FIGS. 8 and 10, the adjustable shear line 112 is positioned in its first position between the inner cylinder 78 and the intermediate cylinder 79. In that state of lock 70, with no key inserted, no common lock shear line is formed between tumbler sets 98 and rack 105/rack extension 106. Accordingly, the inner cylinder 78, to which the locking mechanism 56 is coupled, can not be rotated and lock 70 can not be operated.

Figure 11:
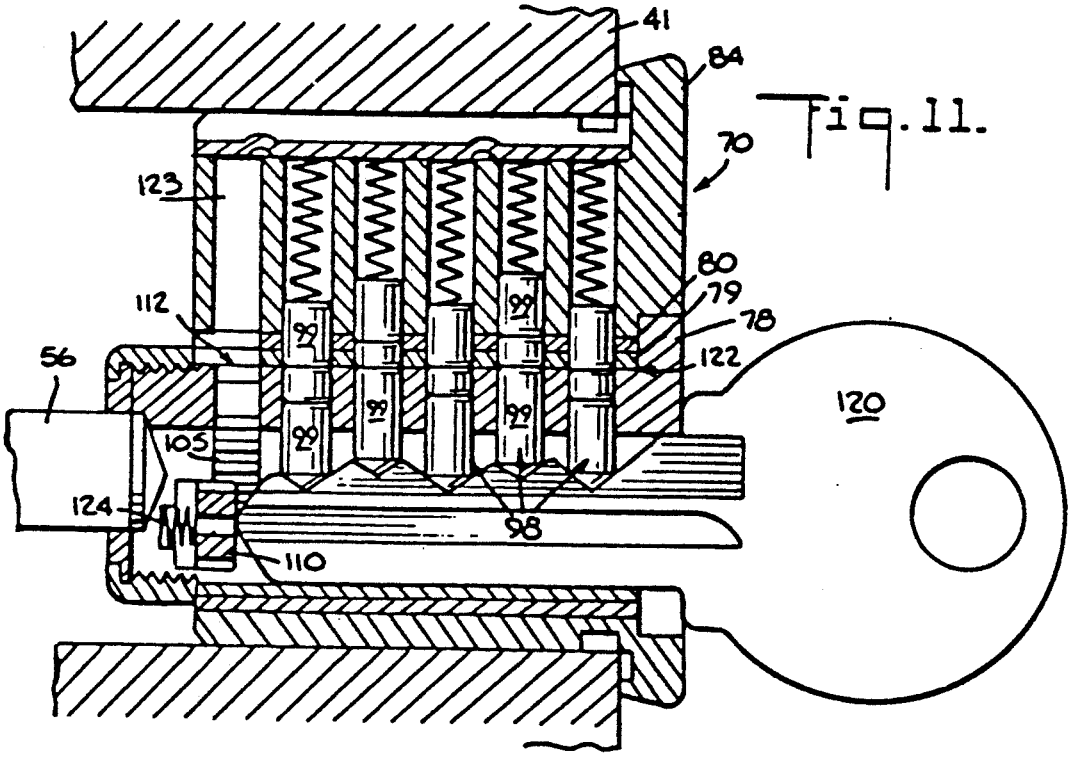
FIG. 11 is a view similar to FIG. 10 depicting the lock in its first keyed position, with a first key inserted in the keyway positioning the pin tumblers to form the first common pin tumbler shear line between the inner cylinder and the intermediate cylinder in alignment with the first position of the adjustable shear line, the first common pin tumbler shear line and the adjustable shear line in its first position together forming the first lock shear line.

Referring to FIGS. 11, 15 and 18, lock 70 is depicted in its first keyed position in which inner cylinder 78 may be rotated. In that first keyed position, a proper first key 120 inserted into keyway 74 positions pin tumblers 99 of the tumbler sets 98 to form the first common pin tumbler shear line 122 aligned with adjustable shear line 112, which together form the first common lock shear line, permiting inner cylinder 78 to be rotated (see FIGS. 15 and 18) by first key 120 to operate the lock. The pin tumblers engage intermediate cylinder 79, outer cylinder 80 and casing 84, and prevent rotation of cylinders 79 and 80 relative to casing 84. In addition, rack extension 106 may also engage cylinders 79 and 80 and casing 84, although that is not necessary. Any of the other authorized keys (the second and third keys) will not position tumblers 99 to form a common tumbler shear line which is aligned with shear line 112 in its first position, and accordingly will not operate lock 70.

As described above, lock 70 is rekeyed to operate with a different key by adjusting the position of adjustable shear line 112 with change key 72. As depicted in FIG. 11, key 120 is a standard key and extends in keyway 74 the full length thereof. Key 120 therefore underlies bore 123 in casing 84 which is from a standard lock which previously housed a tumbler set in bore 123. However, in lock 70, pinion gear 110 is positioned under bore 123, which would prevent key 120 from being fully inserted into lock 70. To permit Standard key 120 to be fully inserted into lock 70 as depicted in FIG. 11, pinion gear 110 is spring loaded by spring 124 to be displaceable longitudinally of keyway 74. Alternatively, a shorter key may be used which when fully inserted does not contact pinion gear 110, or a longer casing may be used so that a standard key when fully inserted does not contact the pinion gear, in which cases pinion gear 110 need not be spring loaded.

Figure 12:
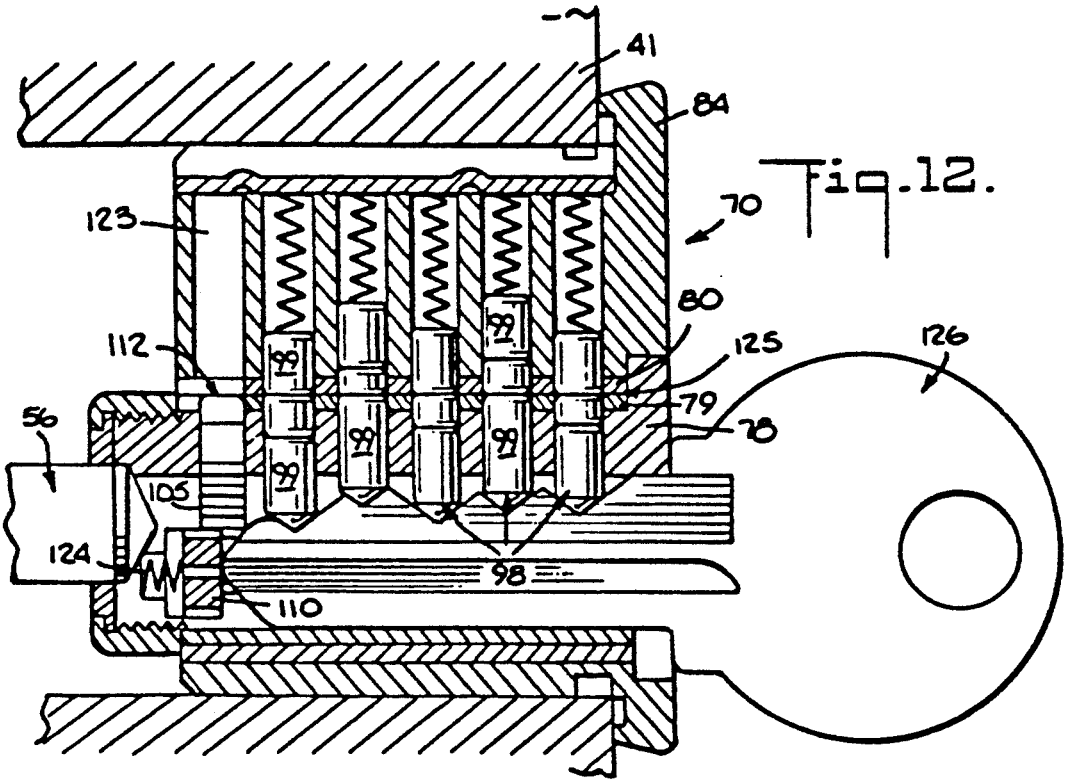
FIG. 12 is a view similar to FIG. 11 depicting the lock rekeyed from the position of FIGS. 10 and 11 to its second keyed position in which the rack is in its second position and the adjustable shear line is in its second position between the intermediate and outer cylinders, and with the second key inserted in the keyway positioning the pin tumblers to form the second common pin tumbler shear line between the intermediate cylinder and outer cylinders in alignment with the second position of the adjustable shear line, the second common pin tumbler shear line and the adjustable shear line in its second position together forming the second lock shear line.

Referring to FIG. 12, lock 70 has been rekeyed to its second keyed position in which the position of adjustable shear line 112 has been adjusted from the FIG. 11 position to place it in its second position between cylinders 79 and 80. See FIG. 9. To operate lock 70 in that state, pin tumblers 99 of tumbler sets 98 must be positioned to form second common pin tumbler shear line 125 which is aligned with adjustable shear line 112 in its second position. Second key 126 inserted in keyway 72 accomplishes that positioning of the pin tumblers which forms second common tumbler shear line 125 in alignment with the second adjusted position of adjustable shear line 112. In that state of lock 70, inner cylinder 78 and intermediate cylinder 79 are engaged by rack 103 and by pin tumblers 99 to rotate together across the second common lock shear line. Therefore, rotation of cylinders 78 and 79, and with them locking mechanism 56, by second key 126 operates lock 70. The pin tumblers prevent rotation of outer cylinder 80 and engage it to casing 84. In addition, rack extension 106 may also engage outer cylinder 80 and casing 84, although that is not necessary. Other authorized keys (first and third keys) will not operate lock 70 since they can not form a common tumbler shear line which is aligned with adjustable shear line 112 in its second position.

Figure 13:
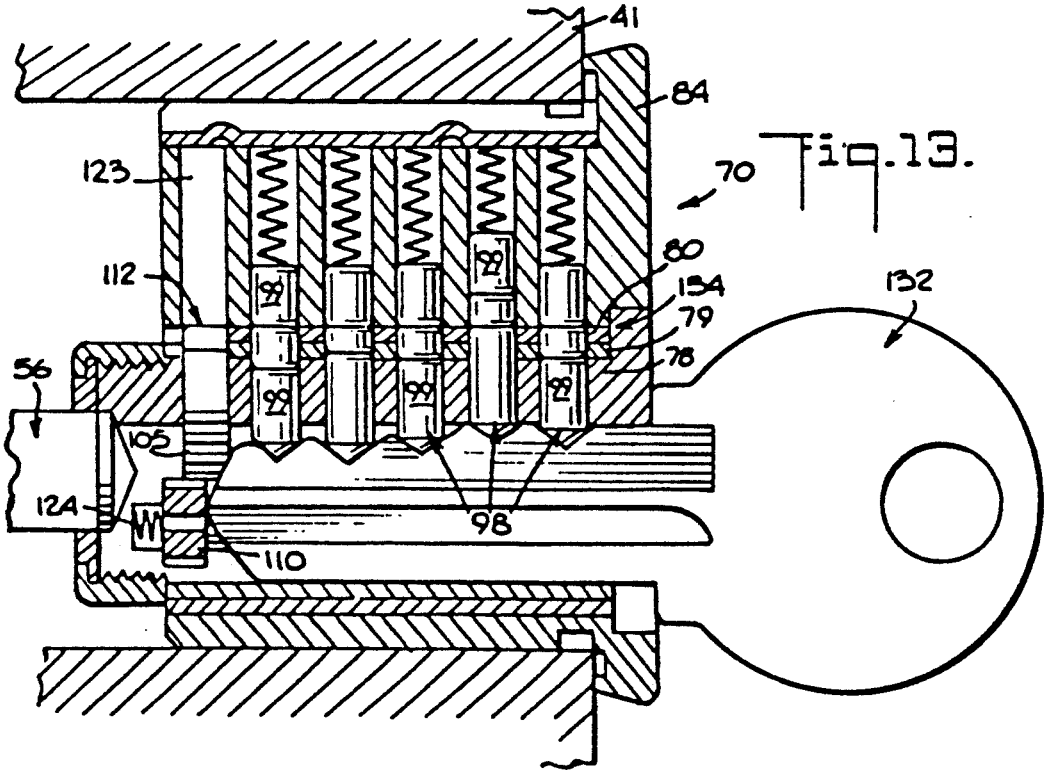
FIG. 13 is a view similar to FIG. 11 depicting the lock rekeyed from the position of FIG. 12 to its third keyed position in which with the rack is in its third position and the adjustable shear line is in its third position between the outer cylinder and the casing, and with the third key inserted in the keyway positioning the pin tumblers to form the third common pin tumbler shear line between the outer cylinder and the casing in alignment with the third position of the adjustable shear line, the third common pin tumbler shear line and the adjustable shear line in its third position together forming the third lock shear line.

Referring to FIG. 13, lock 70 is depicted in its third keyed position in which rack 105 has been adjusted to position adjustable shear line 112 in its third adjusted position between outer cylinder 90 and casing 84. In order to operate lock 70 in that state, pin tumblers 99 must be positioned by a third proper key 132 to form third common pin tumbler shear line 134 aligned with adjustable shear line 112 in its third position between cylinder 80 and casing 84. In that state of lock 70, cylinders 78, 79 and 80 are engaged by rack 105 and also by pin tumblers 99 and rotate together across the third common lock shear line formed by third common pin tumbler shear line 134 and adjustable shear line 112 in its third position.

Because of the configuration and operation of pin tumblers 99, the relationship of the first, second and third keys is not a progressive one in which the bit configuration of the keys would include the same but progressively higher points for progressively moving the common tumbler shear lines. Such a progressive relationship of keys would not unlock lock 70 in its rekeyed positions described above.

FIGS. 16 and 17 illustrate adjustment of the position of adjustable shear line 112 by change key 72. Change key 72 is inserted in keyway 74 from the outside of lock 70 and lock assembly 71 until tip 76 engages recess 114 in pinion gear 110. Change key 72 includes two stops, stop 135 formed by a shoulder in shaft 136 at the transition to tip 76, and stop 137 formed by channel piece 138 connecting shaft 136 to bow 139, the distance between stops 135 and 137 along shaft 136 corresponding to the distance from pinion gear 110 to the outside end 86 of cylinder 78. Rotation of key 72 rotates pinion gear 110 to move rack 105 to thereby move the position of adjustable shear line 112. As depicted in FIG. 5, change key 72 is inserted in generally the center of keyway 74, i.e., in the curved central portion between the two generally straight portions. As can be seen in FIG. 14, Y-shaped recess 114 in pinion gear 110 is aligned with that curved portion of keyway 74. Centering recess 114 with respect to keyway 74 provides the maximum free space in the keyway to accommodate shaft 136 of change key 72 without contact between the shaft and the lock pin tumblers. However, other positioning of recess 114 with respect to keyway 74 may be provided.

A detent arrangement (means for indicating) for indicating the position of rack 105, and correspondingly the position of adjustable shear line 112, is illustrated in FIGS. 8, 9 and 19. Detent arrangement 140 includes a detent member 142, a detent spring 144, detent recesses or seats 146 and bore 148 in inner cylinder 78 to receive detent member 142 and detent spring 144. The tip of detent member 142 is beveled, as are the recesses 146, to facilitate seating and unseating of the the detent member in the recesses as rack 105 is moved. Seating of detent member 142 is perceptible in that a slight resistance to further rotation of change key 72 is provided. The higher the force of detent spring 144, the more perceptible the seating will be. For example, as pinion gear 110 is slowly rotated, one can feel detent member 142 riding up the inclined surface of one recess and then abruptly seating in the next recess as rotation continues. Once detent 142 is properly seated in a recess, one can feel the detent ride up one side of the recess as the change key is rotated in one direction, then feel the detent being seated in the recess when the change key is rotated in the opposite direction, and then feel the detent riding up the opposite surface of the recess as rotation in the opposite direction is continued. In addition, if the force of detent spring 144 is made large enough, seating of detent member 142 may create a sound which may be audibly detected. Other detent arrangements may also be used. For example, a bearing ball may be used as a detent member and correspondingly shaped recesses used to seat the ball.

To increase the security of lock 70 with respect to unauthorized attempts to change the position of adjustable shear line 112, rack 105 may be locked in a given position by set screw 150, as illustrated in FIGS. 8, 9 and 19. In the illustrated embodiment, a threaded bore 152, provided in inner cylinder 78 to receive set screw 150 (means for positively engaging), is positioned to provide access to set screw 152 (see FIGS. 22 and 23) from the exterior of lock 70 in its assembled condition. (Lock 70, however, must be disassembled from lock assembly 71.) Bore 152 is advantageously coaxially aligned with bore 148 to simplify manufacturing.

In accordance with the invention, adjustment of the lock to require operation with a new key is effected from the exterior of lock 70 and lock assembly 71. That is accomplished by insertion of change key 72 (FIG. 6) into keyway 74, which appears conventional, as does the exterior of lock 70. Therefore, lock 70 is not distinguisible from a conventional lock from the exterior thereof. In order to permit change key 72 to be fully inserted into lock 70, the shaft 136 of key 72 must have a small cross section, which presents a problem in securely joining shaft 136 to bow 139. If shaft 136 is simply joined to bow 139 by welding, for example, or shaft 136 and bow 139 are made in one piece, the considerable torque which may be generated by bow 139 during rotation of key 72 when tip 76 is engaged in recess 114 of pinion gear 110 could cause shaft 136 to be severed from bow 139. To prevent that, shaft 136 is mounted to bow 139 so as to rotate, rather than break off, when a predetermined torque is exceeded. Shaft 136 is attached to cylindrical plug 160 by welding, for example, or shaft 136 and plug 160 are formed as one piece. Plug 160 is in turn mounted in cylindrical recess 162 in bow 139. Set screw 164 locks plug 160 in recess 162 and prevents it from rotating upon the application of up to a predetermined torque determined by the sizes of shaft 136, plug 160 and set screw 164. When that predetermined torque is exceeded, set screw 164 permits plug 160 to rotate in recess 162.

As mentioned above, tip 76 of change key 72 may be specially-configured to improve security. FIG. 20 illustrates the presently preferred Y-shape, and FIG. 21 illustrates a semi-cylindrical shape.

FIGS. 22–24 illustrate removal of lock 70 from lock assembly 71 and disassembly of lock 70. Screws 176 are loosened in conventional manner to remove lock 70 from lock assembly 71. Pin 178 in the rear of lock 70 is pushed to release knurled nut 180, which is then loosened to remove locking mechanism 56 and expose the rear of cylinder 78, which may then be withdrawn and the remainder of lock 70 disassembled. As depicted in FIG. 24, set screw 150 is accessible from the rear of lock 70, after lock 70 has been removed from lock assembly 71, to lock rack 105 in a given position.

Figure 25:
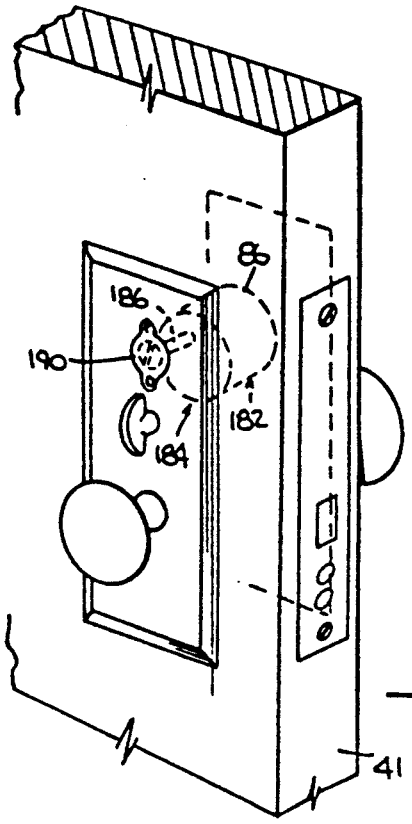
FIG. 25 is a perspective view of a lock according to another embodiment of the invention in which the adjustable shear line is adjusted from the end of the lock opposite the end having the keyway entrance therein, the lock being assembled into a lock assembly installed in a door.
Figure 26:
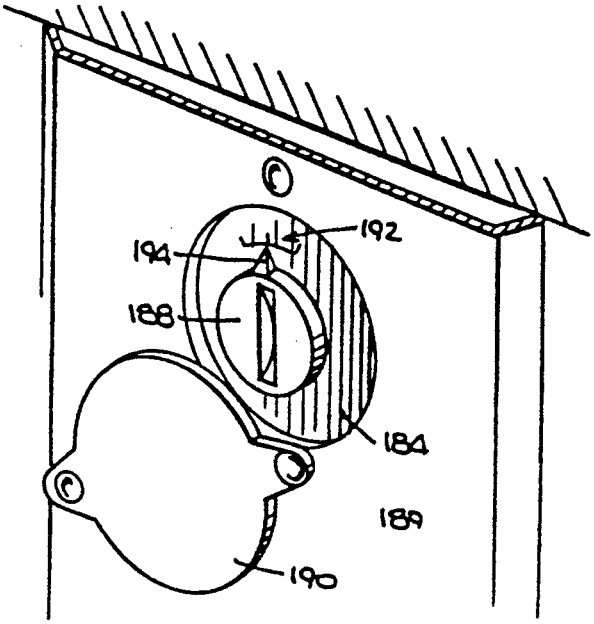
FIG. 26 is an enlarged perspective view of a portion of the assembled and installed lock depicted in FIG. 25 partially exploded to expose a dial used to adjust the position of the adjustable shear line.
Figure 27:
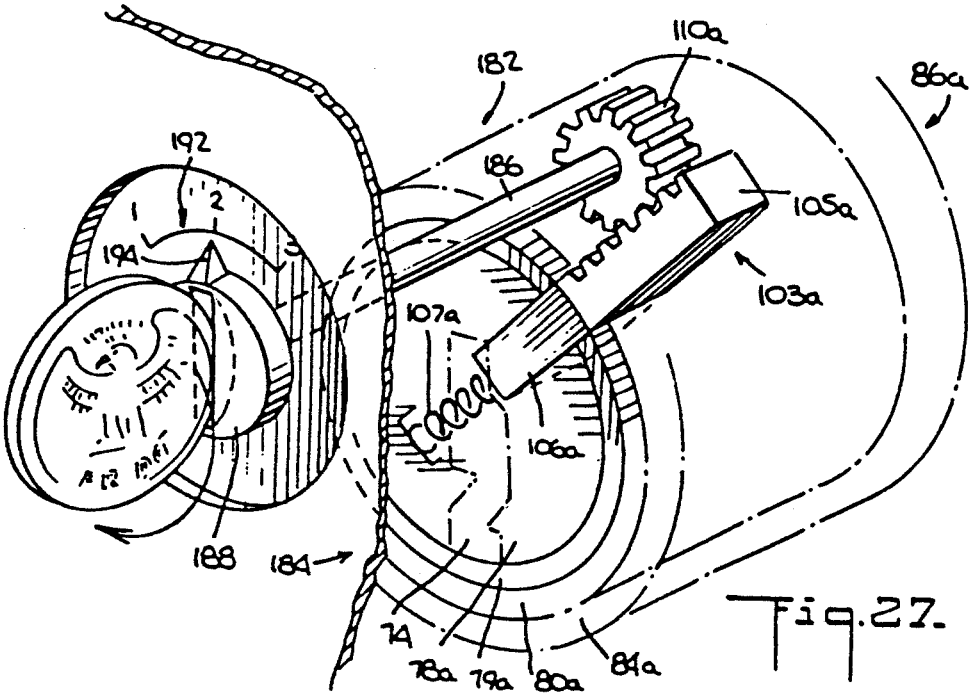
FIG. 27 is an enlarged perspective view of a portion of the lock of FIG. 25 broken away and partially in phantom to illustrate adjustment of the rack by the dial, also depicting a pointer which indicates the position of the rack and the adjustable shear line.
Figure 30:
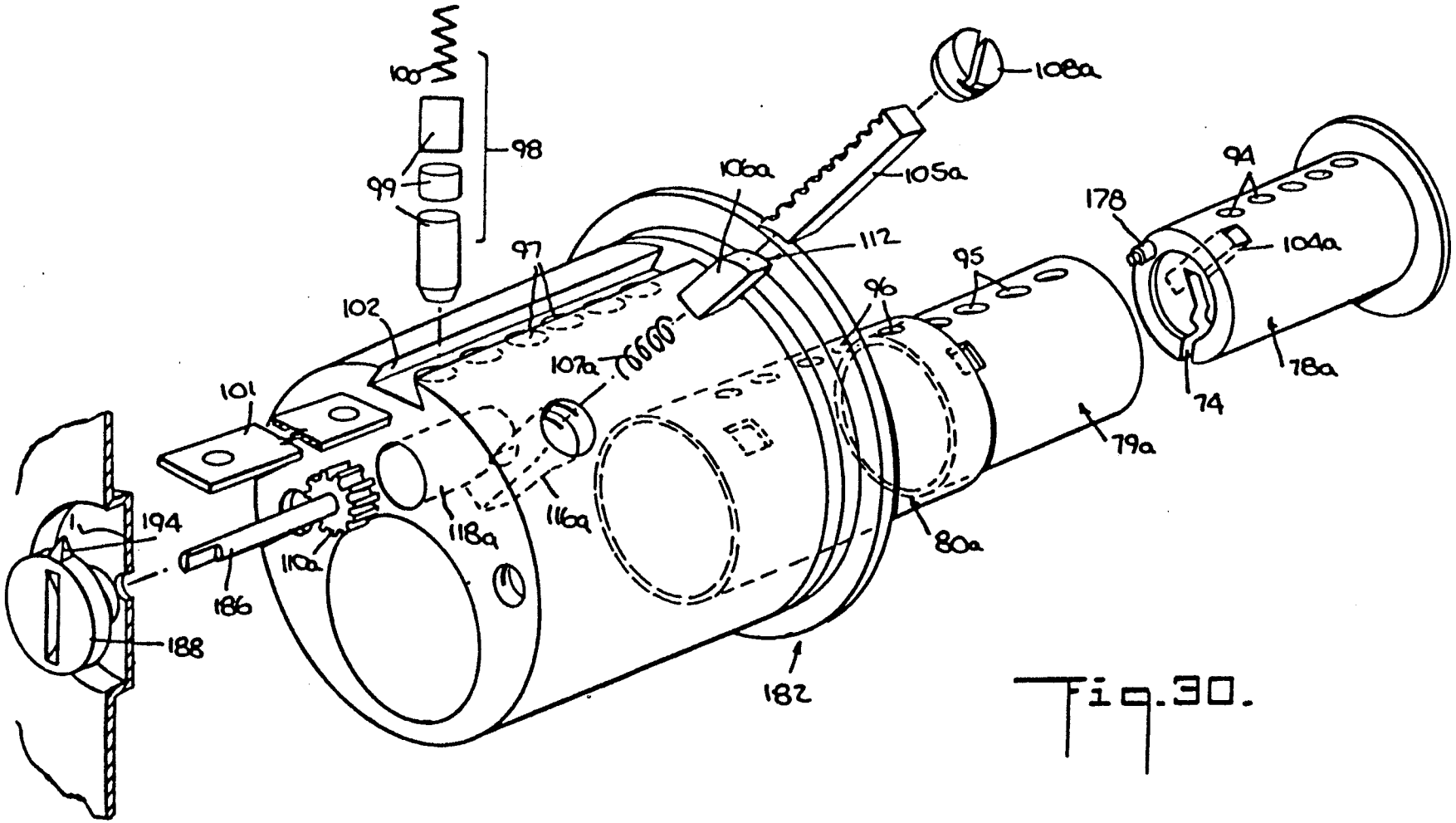
FIG. 30 is an exploded perspective view of the lock of FIG. 25.

Referring now to FIGS. 25–30, a lock according to another embodiment of the invention is depicted in which the adjustable shear line 112 may be changed from the inside of a door 41 in which the lock is installed. Lock 182 internally is constructed similar to lock 70. Specifically, tumbler construction and the rack and pinion arrangement **103*a* of lock 182 are similar to those of lock 70. Pinion gear 110*a* is, however engaged from the end 184 of the lock opposite keyway end 86. Shaft 186 (actuating member) is fastened at one end thereof to pinion gear 110*a* and extends from end 184 of lock 182 to the exterior of the inside of door 41 where dial 188 is fastened to the other end of shaft 186. As depicted in FIGS. 25 and 26, dial 188 is recessed in lock plate 189 so that it may be covered by escutchen plate 190 which is fastened to plate 189 by screws. Dial 188 may be rotated to rotate shaft 186 and pinion gear 110*a* by a suitable implement such as a coin, screwdriver, etc. A knob may be attached to dial 188, if desired, particularly if recessing of the dial is important. Referring to FIG. 27, a scale 192 is provided adjacent dial 188 which includes pointer 194 to indicate the position of adjustable shear line 112 (means for indicating). Scale 192 and pointer 194 replace the detent arrangement 140'of lock 70**, or may be provided in addition to the detent arrangement rather than in lieu of it.

Since lock 182 is rekeyed to operate with a different key from the interior of a door, it is not necessary to provide a set screw or other locking device to lock rack **105*a* in a given position. If desired, however, a set screw or other locking device to lock rack 105*a* may be provided for lock 182**.

Slots **104*a*, 116*a* and recess 118*a* of the rack and pinion arrangement 103*a* in lock 182 are positioned slightly differently as compared to lock 70. In lock 182, recess 118*a* (FIG. 30) in cylinder 78*a* is located above the central axis of the lock and slot 104*a* in cylinder 78*a* and slot 116*a* in casing 84*a* extend at a greater angle with respect to the axis of lock 182 than in lock 70. As indicated above, positioning of recess 118*a* and slot 116*a* are dependant on the availability of space in inner cylinder 78*a***.

Lock 182 operates essentially in the same manner as described above for lock 70.

FIGS. 31-34 depict another embodiment of a lock 200 according to the invention which comprises three cylinders 201-203 (FIGS. 33 and 34), one disposed in the other, similar to the embodiment depicted in FIG. 7. The pin tumbler structure and the bore structure in cylinders 201-203 is generally as described for the embodiment of FIG. 7. However, cylinders 201-203 depicted in FIGS. 33 and 34 differ from cylinders 78-80 of FIG. 7 in that they do not have structure for receiving a rack and pinion. Instead of a rack and pinion structure for engaging the various cylinders and the lock casing, cylinders 202 and 203 and lock casing 205 include structure at an end thereof which is engaged by a set screw 207 to selectively engage cylinders 202, 203 and casing 205 in a manner similar to that described for the embodiment of FIG. 7.

Figure 31:
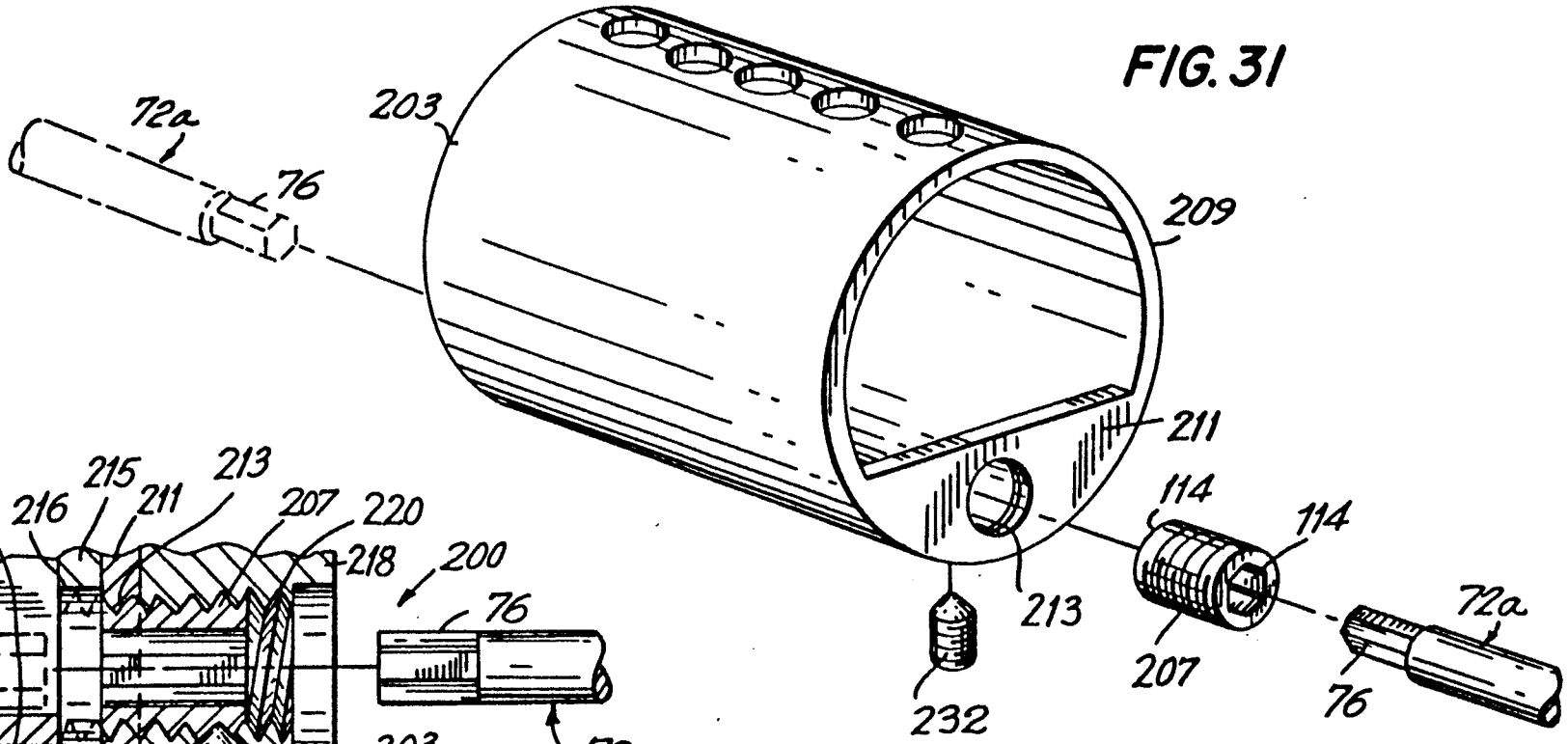
FIG. 31 is an exploded perspective view of a portion of another embodiment of a lock according to the invention which utilizes a set screw as the cylinder engaging means instead of a rack and pinion.

Referring to FIG. 31, cylinder 203 at end 209 thereof includes a radial flange 211 extending from a periphery thereof inwardly a short distance. Flange 211 terminates well short of a diameter of cylinder 203. Flange 211 includes a threaded opening 213 therein which receives set screw 207. Similarly, cylinder 202 (FIG. 34) includes a radial flange 215 having a threaded opening 216 which also receives set screw 207. End 218 of casing 205 also includes a threaded opening 220 which receives set screw 207. Set screw 207 includes shaped openings 114 (hexagonal) at opposed ends thereof by means of which it may be engaged at either end by hexagonal tip 76 of change key 72*a* and advanced into openings 220, 213, 216. For convenience, the shaft tips of all change keys have been designated 76 regardless of shaft tip configuration. Similarly, the openings of the particular rotatable engaging member (pinion gear 110, set screw 207 and cams 251, 251*a*, etc.) which receives and is engaged by a respective shaft tip have been designated 114 regardless of the configuration of the opening. It is understood that change keys are selected for use with a particular rotatable member so that the configurations of a tip 76 and an opening 114 mate.

Figure 34:
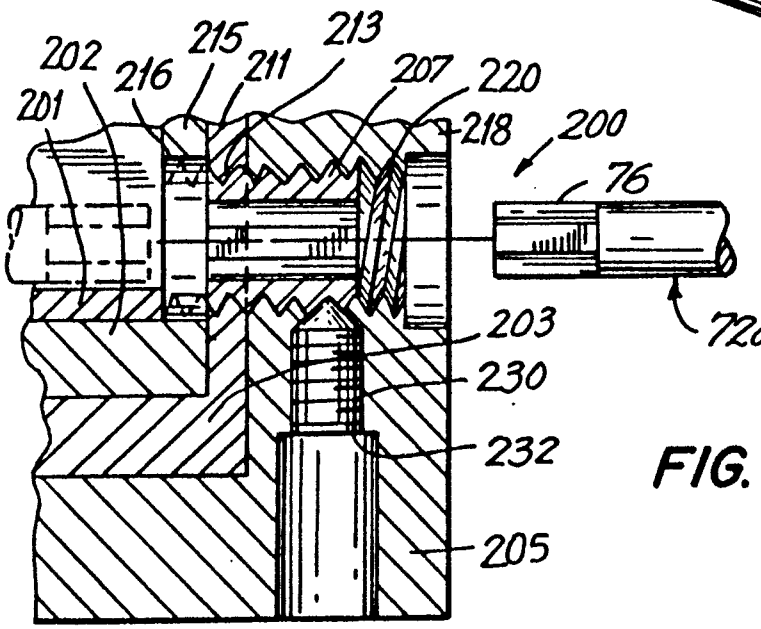
FIG. 34 is a enlarged detail view in section of the portion of the lock of FIG. 33 showing the set screw passing through the lock cylinders.
Figure 33:
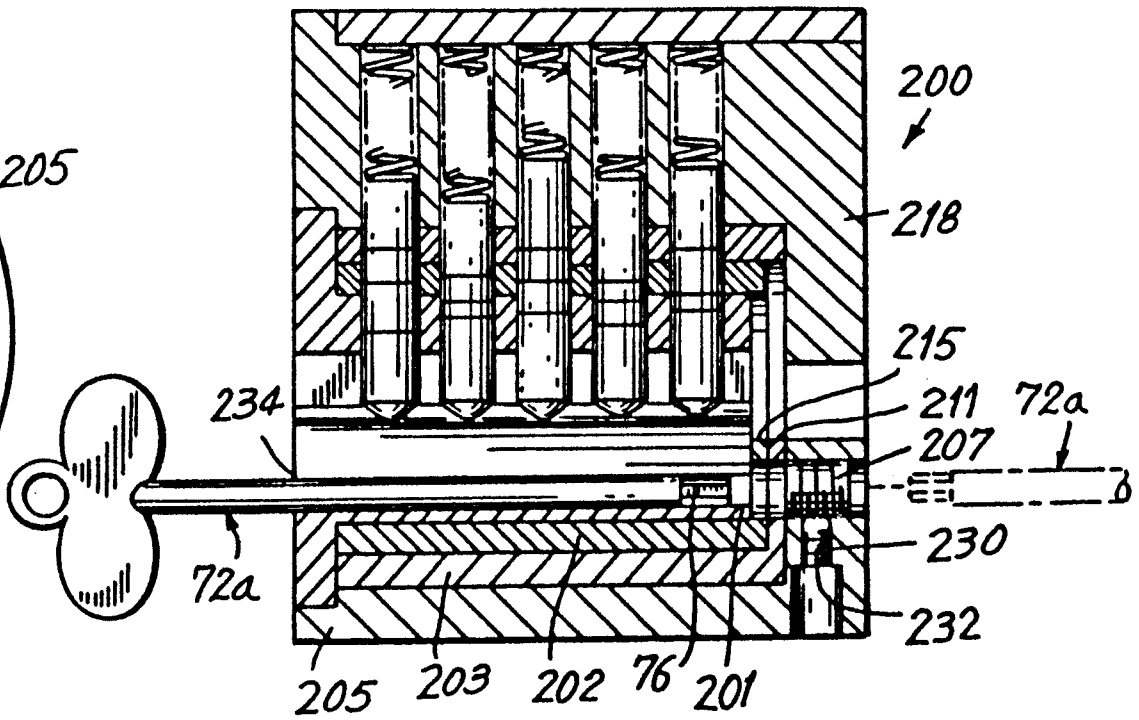
FIG. 33 is a section view of the lock of FIG. 32 taken along line 33—33 thereof with a change key inserted therein.
Figure 32:
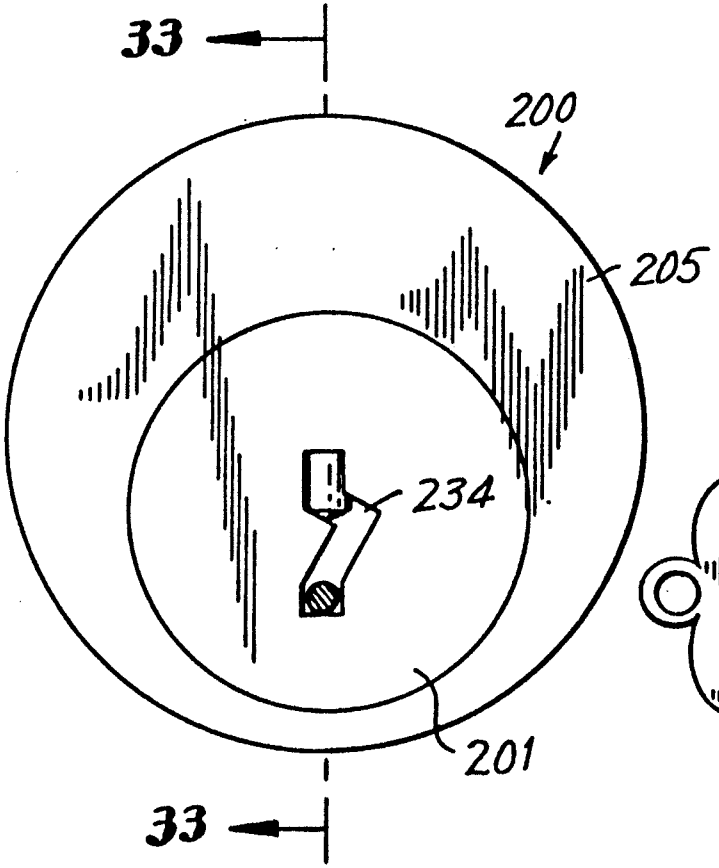
FIG. 32 is a front view of the fully assembled lock of FIG. 31.

As depicted in FIGS. 33 and 34, set screw 207 is received in threaded opening 220 of casing 205 and may be adjusted to extend into and engage only opening 213 of cylinder 203 or both opening 213 and opening 216 of cylinder 202. Engagement of set screw 207 with casing 205, cylinder 203 and/or cylinder 202 causes lock 200 to operate in a manner similar to that described for lock 70 of FIG. 7.

Lock 200 is quite versatile in that it may be adjusted from either end of the lock assembly. Thus, it may be adjusted by inserting change key 72*a* into key hole 234 (broken lines in FIG. 31 and as shown in FIG. 33), or by inserting change key 72*a* into the opposite end of the lock as depicted in FIGS. 31 and 34 in a manner similar to that described for the embodiment of FIGS. 25-57, i.e. access is provided from the interior of a door to opening 220 and set screw 207. End 218 of casing 205 includes another opening 230 extending radially therein and terminating in opening 220. Set screw 232 is threaded into opening 230 so it may be tightened against set screw 207 to lock set screw 207 in place. In order to adjust set screw 232, lock 200 must be disassembled from its lock assembly. This increases security in that once set screw 232 is tightened against set screw 207, the lock cannot be rekeyed without disassembling it from its lock assembly.

Figures 35, 36:
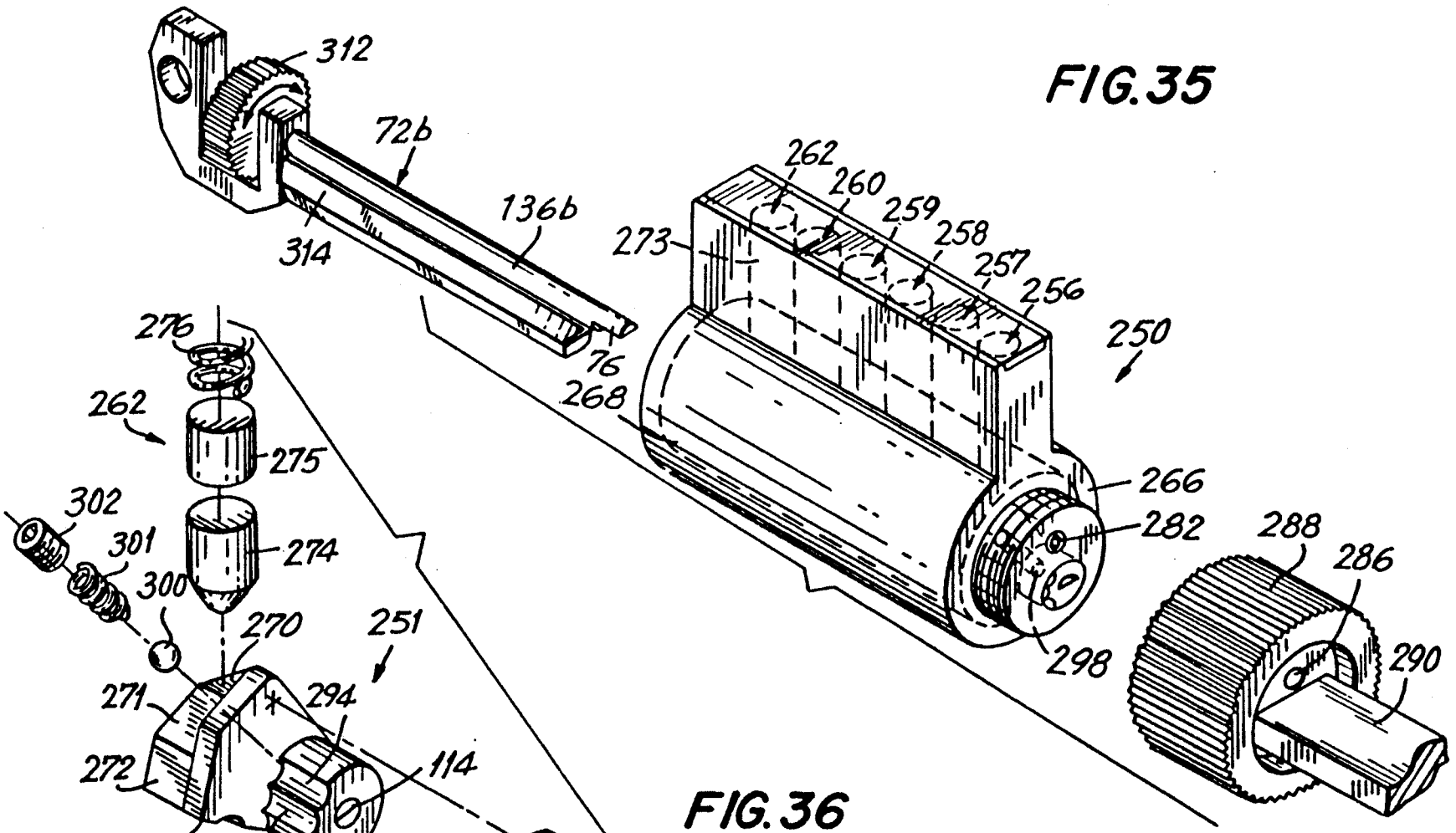
FIG. 35 is an exploded perspective view of a key-in-knob lock according to another embodiment of the invention which utilizes a rotatable cam and a pin tumbler as the engaging means instead of a rack and pinion.
FIG. 36 is an exploded perspective view of the rotatable cam and pin tumbler of the lock of FIG. 35.

Referring next to FIGS. 35-40, the presently preferred embodiment of a lock according to the invention is illustrated. Referring to FIG. 35, lock 250 is similar to lock 70 depicted in FIG. 7 except that a rotatable cam 251 is used to engage the cylinders instead of a rack and pinion structure. FIG. 7 depicts a lock for a rim cylinder and FIGS. 35-40 depict a key-in-knob type lock. The specific type lock assembly, i.e., rim, mortise, key-in-knob, selected for use with a specific type engaging means is illustrative and not limiting, and the rotatable cam structure of lock 250 may be used in a rim cylinder, a mortise cylinder, etc., and the rack and pinion structure of lock 70 may be used in a key-in-knob structure, etc.

Lock 250 includes three cylinders 252-254 (FIGS. 37-40) similar to the cylinders described for lock 70 of FIG. 7. The first five pin tumblers 256-260 (FIG. 35) and bore structure in the cylinders for receiving the pin tumblers is similar to that described for lock 70. In lock 250, sixth pin tumbler 262 replaces structure 112 of lock 70, and rotatable cam 251 replaces pinion 110 of lock of 70. Rotatable cam 251 (FIG. 36) includes three cam surfaces 270, 271 and 272 corresponding to the three keyed positions of lock 250. Pin tumbler 262 includes lower pin tumbler 274 and upper pin tumbler 275. Rotatable cam 251 is rotatably mounted in end 266 of casing 268 so that cam surfaces 270-272 contact lower pin tumbler member 274 in respective rotated positions of cam 251. Casing 268 includes a sixth bore 273 for receiving pin tumbler 262. Pin tumbler 262 is similar to the other pin tumblers and includes a spring 276 urging pin tumbler 275 against pin tumbler 274, and pin tumbler 274 against one of the cam surfaces 270-272.

Figure 38:
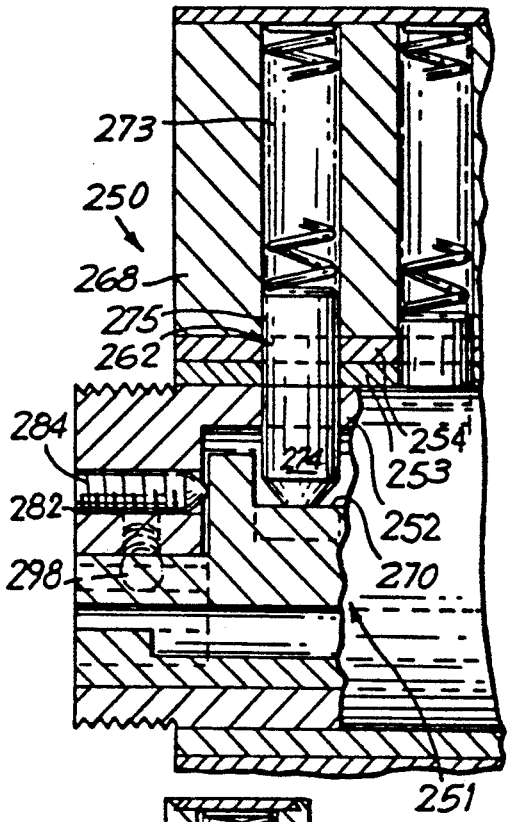
FIG. 38 is a section view of the lock of FIG. 35 taken along line 38—38 of FIG. 37.
Figure 39:
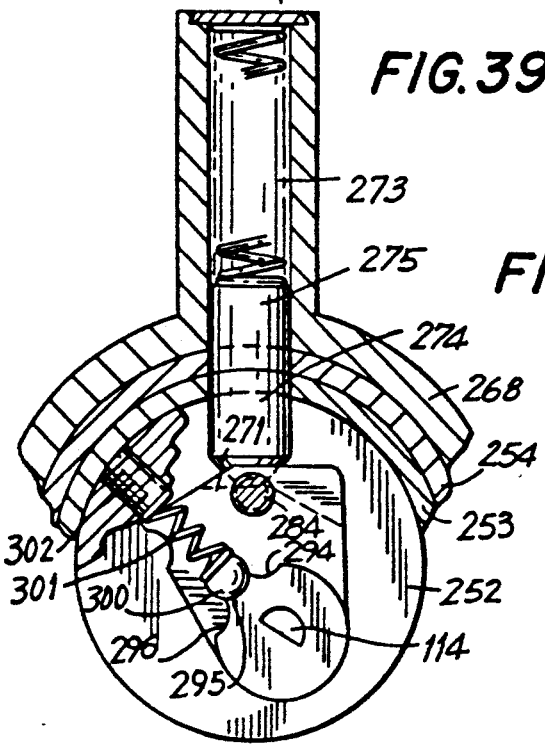
FIGS. 39 and 40 are section views similar to that of FIG. 37 showing the rotatable cam of the lock of FIG. 35 in second and third positions thereof forming shear lines similar those formed in the positions depicted in FIGS. 9 and 13.
Figure 40:
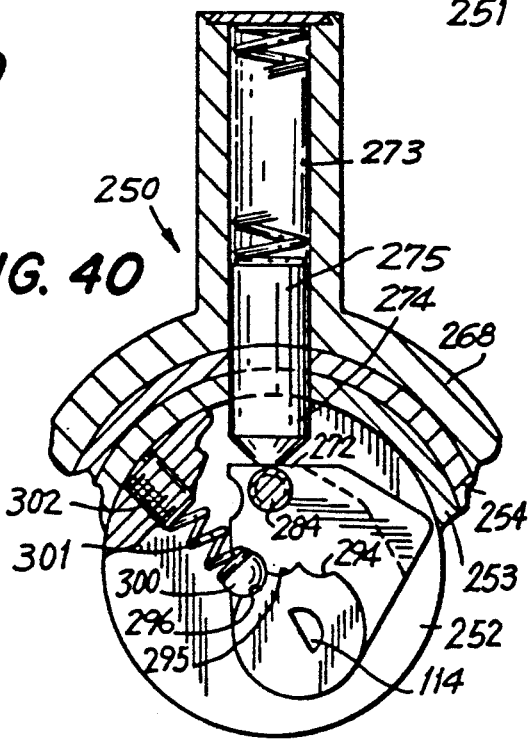
Figure 41:
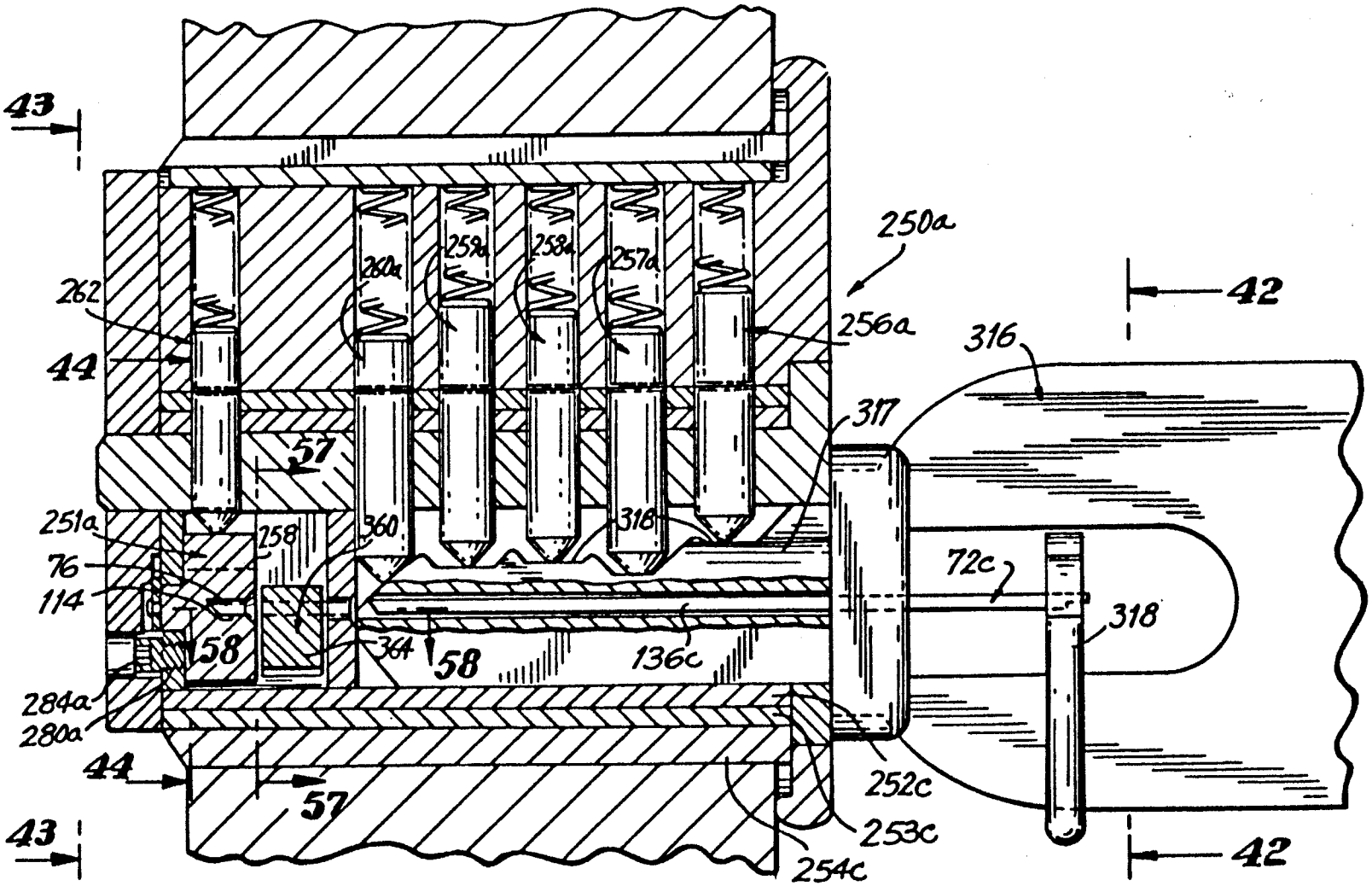
FIG. 41 is an axial section view of a rim lock incorporating a rotatable cam according to the invention and a combined operating and change key therefor.

Cam member 251 also includes a flange or shoulder 280 (FIG. 35), and rear end 266 of casing 268 includes a hole 282 (FIG. 38) which opens adjacent shoulder 280. A set screw 284 is received in hole 282 and may be tightened from the rear of casing 268 to bear against shoulder 280 and lock rotatable cam 251 in a rotated position (FIG. 38). Another hole 286 is provided in end nut 288 which rotatably connects the connecting bar 290 to the bolt mechanism of the lock assembly. Set screw 284 is accessed through hole 286 when lock 250 is disassembled from its lock assembly. It is not, however, necessary to disassemble lock 250 itself to adjust set screw 284. If desired, structure may be provided in the lock assembly to permit set screw 284 to be adjusted from the interior side of a door without disassembling lock 250 from the lock assembly, in a manner similar to that described for rekeying a lock from the interior of a door (embodiment of FIG. 25).

Rotatable cam 251 further includes a hub 293 having three axially grooved detents 294-296, and rear end 266 of casing 268 includes a radial bore 298 (FIG. 35) in which is disposed detent ball bearing 300 (FIG. 36), spring 301 and set screw 302. Bore 298 is threaded to receive set screw 302 which when advanced tightens and compresses spring 301 against ball 300 urging ball 300 into grooved detents 294-296.

Figure 37:
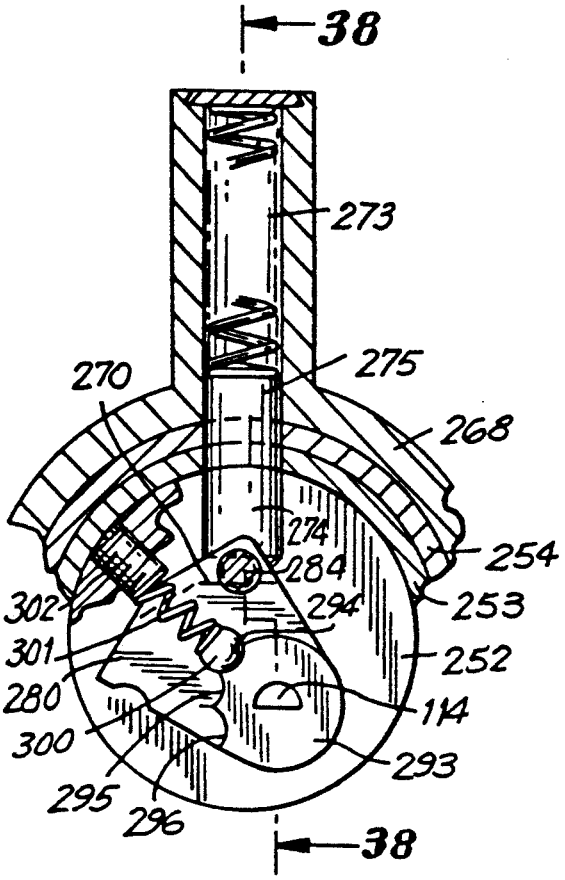
FIG. 37 is a radial section view of the lock of FIG. 35 showing the rotatable cam and pin tumbler in a first position forming a shear line between the inner and middle cylinders similar to the first position depicted in FIG. 8.

As illustrated by the sequence of FIGS. 37-40, cam 251 is rotatable to three positions corresponding to the three keyed positions described in connection with lock 70 of FIG. 7. In FIGS. 37 and 38, rotatable cam 251 is depicted in its first position in which pin tumbler 262 is cammed by first camming surface 270 to form a shear line between inner cylinder 252 and middle cylinder 253, thereby engaging middle cylinder 253, outer cylinder 254 and casing 268, and leaving inner cylinder 252 free to rotate. In that position, ball bearing 300 is urged into the first detent surface 294. Upon rotating cam member 251 to the second rekeyed position depicted in FIG. 39, pin tumbler 262 is cammed by second camming surface 271 and forms a shear line between middle cylinder 253 and outer cylinder 254, thereby engaging inner cylinder 252 and middle cylinder 253 which may be rotated, and engaging outer cylinder 254 and casing 268. In this position, ball bearing 300 is urged against the second detent surface 295. Upon further rotation of rotatable cam 251 (FIG. 40), pin tumbler 262 is cammed by third camming surface 272 to from a shear line between outer cylinder 254 and casing 268. In this position, cylinders 252–254 are locked together and may be rotated.

The detent arrangement provided by ball bearing 300 and detent surfaces 294–296 enables a person rotating cam 251 to feel when cam 251 has been rotated from one detent position to the next. Frequently, seating of ball bearing 300 in a detent groove may be heard as well as felt.

Change key 72*b* depicted in FIG. 35 includes a shaft 136*b* having a tip 76 configured to be received in and engage opening 114 in rotatable cam 251. Shaft 136*b* is connected to a rotatable knurled knob 312 which may be rotated to rotate shaft 136*b* and with it cam 251. Knob 312 is relatively small to limit the torque that can be applied to shaft 136*b* and to rotatable cam 251 to an acceptable value, thereby insuring that the shaft tip 76 will not be damaged by over-torqueing. Change key 72*b* also includes a base shaft 314 which assists in properly positioning change key 72*b* in lock 250.

Cam 251 may be rotated by a change key such as key 76, 76*a* or 76*b* having an appropriately configured tip. Alternatively, a change key 72*c* may be incorporated with an operating key, as illustrated by key 316 depicted in FIG. 41. Lock 250*a* depicted in FIGS. 41–44 is a rim lock (similar to lock 70, FIG. 22) and incorporates a cam 251*a* slightly different from cam 251. Cam 251*a* is also shown in FIG. 53.

Rotatable cam 251*a* differs from rotatable cam 251 by virtue of the detente arrangement for indicating the keyed position of the lock. Specifically, cam 251*b* is comprised essentially of a hub 293*a* in face 358*a* of which circular grooves 294*a*–296*a* are provided rather than in the circumferential periphery thereof as for rotatable cam 251 depicted in FIG. 6. Correspondingly, a detent pin 300*a* (FIG. 53) and spring 301*a* are axially disposed in a bore 298*a* of shield 362 (described below) (or in the lock casing for the embodiment depicted in FIGS. 43–44). Thus, rotation of rotatable cam 251*a* relative to shield 362 (or the lock casing) repositions detent pin 300*a* in different detents 294*b*–296*b*. Cam surfaces 270*a*–272*a* are disposed on the periphery of hub 293*a*.

Key 316 includes conventional key 317 having bites 318 which engage pin tumblers 256*a*–260*a*, and change key 72*c* has a rotatable shaft 136*c* and a properly configured tip 76 configured to be received in and engage opening 114 of cam 251*a* (or opening 114 of cam 251 of lock 250). A lever 318 is connected to shaft 136*c* for rotating it. The length of lever 318 is selected to limit the torque that can conveniently be applied to shaft 136*c* to an acceptable value. Change key 72*c* is operated by placing key 316 in lock 250*a* (or 250), pushing shaft 136*c* axially to seat tip 76 in cam opening 114, and rotating handle 318 as depicted in FIG. 42.

An advantage of the change key 316 is that it is incorporated with an operating key so that anyone having such a key may both unlock and rekey the lock. Preferably key 316 is a master key. Another advantage of combining a change key and an operating key is that such a key may be used with a security means gate mechanism described below in connection with FIGS. 41 and 57–62.

Figure 45:
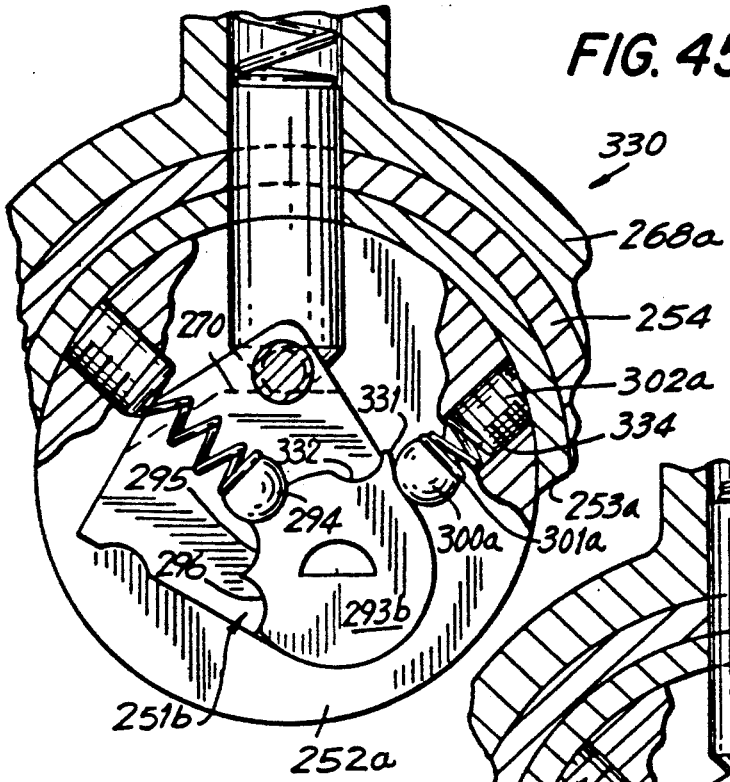
FIG. 45 is a section view of a lock according to another embodiment of the invention which shows a rotatable cam similar to the one depicted in FIG. 37 but in which the lock may be rekeyed from a first position to a second position but not back to the first position, this figure depicting the rotatable cam in its first position.
Figure 46:
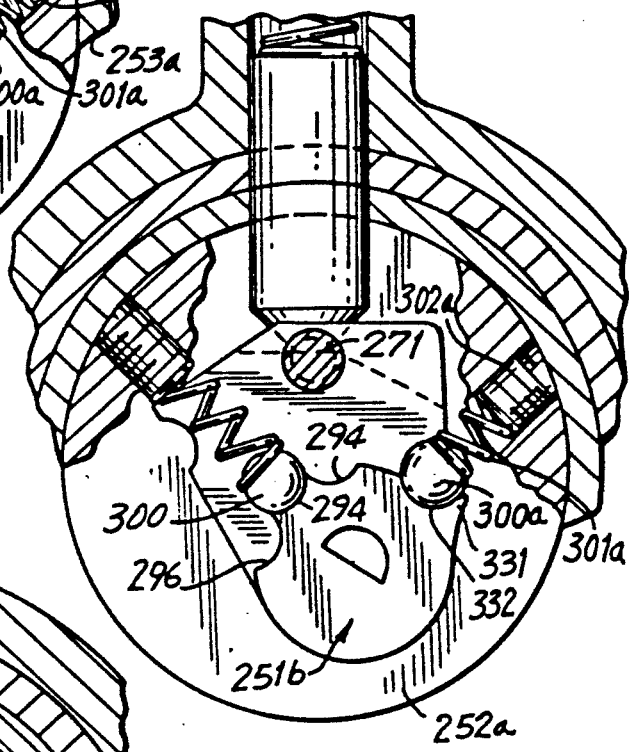
FIG. 46 is a view similar to that of FIG. 45 depicting the rotatable in its second position.
Figure 47:
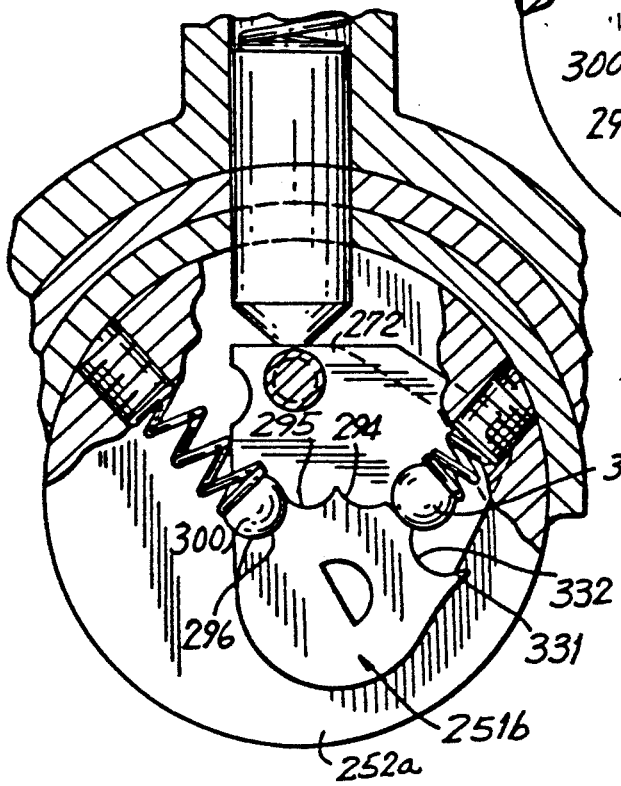
FIG. 47 is a view similar to that of FIG. 45 depicting the rotatable cam in its third position.

FIGS. 45–47 depict a lock 330 similar to lock 250 except that once lock 330 is rekeyed out of its first keyed position, it cannot be rekeyed back into it. Lock 330 includes a rotatable cam 251*b* which includes an additional axially grooved detent 332 as well as detents 294–296. Detent 332 differs from detents 294–296 in that one edge 331 of the detent groove projects radially outwardly to form a stop. Lock 330 further includes an additional radial bore 334 in casing 268*a* in which are disposed an additional ball bearing 300*a*, spring 301*a* and set screw 302*a*. Ball bearing 300*a* in the first position of lock 330 bears against an ungrooved surface portion in the periphery of the hub 293*b*. When rotatable cam 251*b* is rotated clockwise from the position depicted in FIG. 45 to the position depicted in FIG. 46, ball bearing 300*a* seats in detent groove 332, and, as described for lock 250, ball bearing 300 seats in detent groove 295. With ball bearing 300*a* engaged on its clockwise side by projecting detent groove edge or stop 331, it is not possible to rotate the rotatable cam 251*b* counter clockwise from the position depicted in FIG. 46. Thus, lock 330 once keyed out of the first position of FIG. 45 cannot be rekeyed back into that position.

FIG. 47 depicts rotatable cam 251*b* in the third position in which ball bearing 300 is seated in the third detent 296, as described for lock 250, and ball bearing 300*a* is disposed on a smooth peripheral surface portion of hub 293*b*. Cam 251*b* may be rotated counter clockwise from the FIG. 47 position back to the FIG. 46 position since neither ball bearing 300 nor ball bearing 300*a* are restrained by a stop, but not from the FIG. 46 position back to the FIG. 45 position.

As described above, lock 330 may be used as a construction lock, or an equipment lock such as an ignition lock for an automobile.

FIGS. 48 and 49 show a lock 250*c* similar to lock 250 except that cam member 251*c* of lock 250*c* may be rotated only when lock 250*c* has been disassembled from its lock assembly. Cam member 251*c* includes a rod 352 extending radially from shoulder 280*c*, and casing 268*c* includes a slot 354 into which rod 352 extends. Slot 354 extends circumferentially a distance sufficient to accommodate rod 352 therein for rotation of rotatable cam 251*c* to its three positions, as described for cam 251. To rekey lock 250*c*, it is disassembled from its lock assembly and one simply engages rod 352 and rotates rotatable cam member 251*c* into a detent position, as described for lock 250.

FIGS. 41 and 50–70 depict various embodiments of security or blocking or restricting means embodied by a gate or shutter mechanism for restricting or blocking access to an engaging means such as rotatable cam 251 (251*a*,*b*) or a rack and pinion 103, 110.

FIGS. 41 and 50–55 depict a gate or shutter mechanism 360 (FIG. 53) (hereafter "gate mechanism") which is disposed in a lock adjacent rotatable cam 251*a* to inhibit access to cam 251*a* and thereby improve the security of the lock against unauthorized rekeying. Thus, in order to rotate cam 251*a*, it is first necessary for a change key tip to pass through gate mechanism 360. Gate mechanism 360 includes a stationary shield 362 and a movable gate 364.

Figure 50:
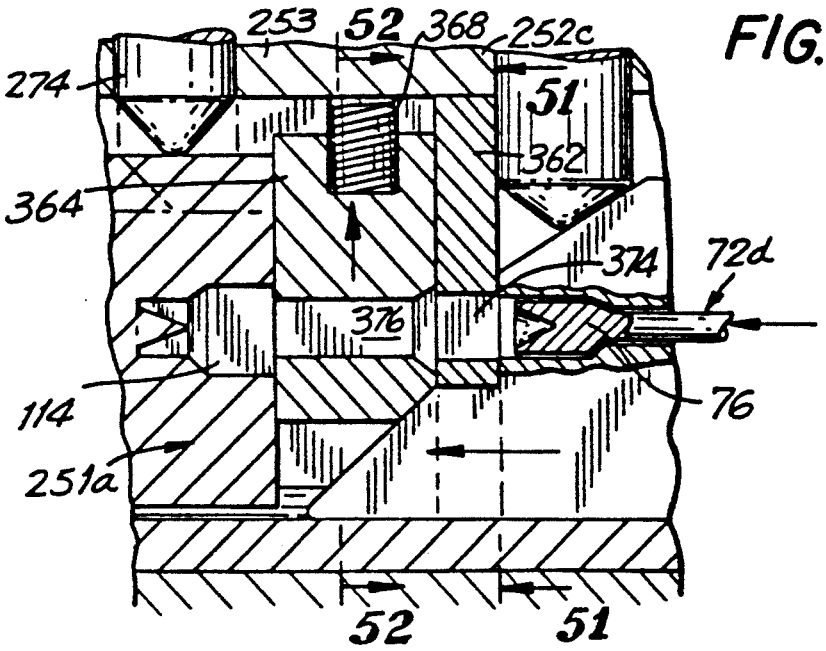
FIG. 50 is an axial section view of a portion of a lock according to another embodiment of the invention incorporating security means in the form of a gate mechanism including a stationary shield and a movable gate which selectively block access to a rotatable cam.
Figure 51:
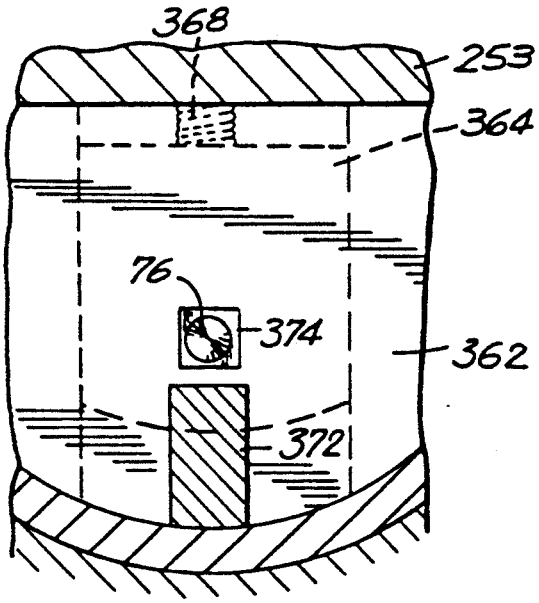
FIG. 51 is a section view of the gate mechanism depicted in FIG. 50 taken along lines 51—51 thereof.
Figure 52:
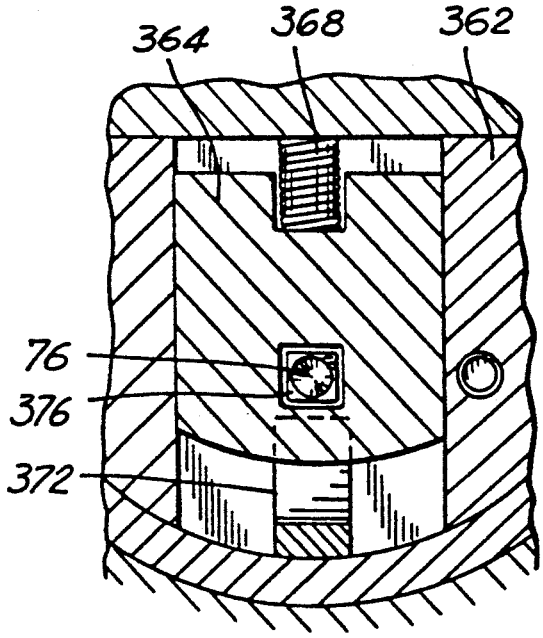
FIG. 52 is a section view of the gate mechanism depicted in FIG. 50 taken along line 52—52 thereof.
Figure 63:
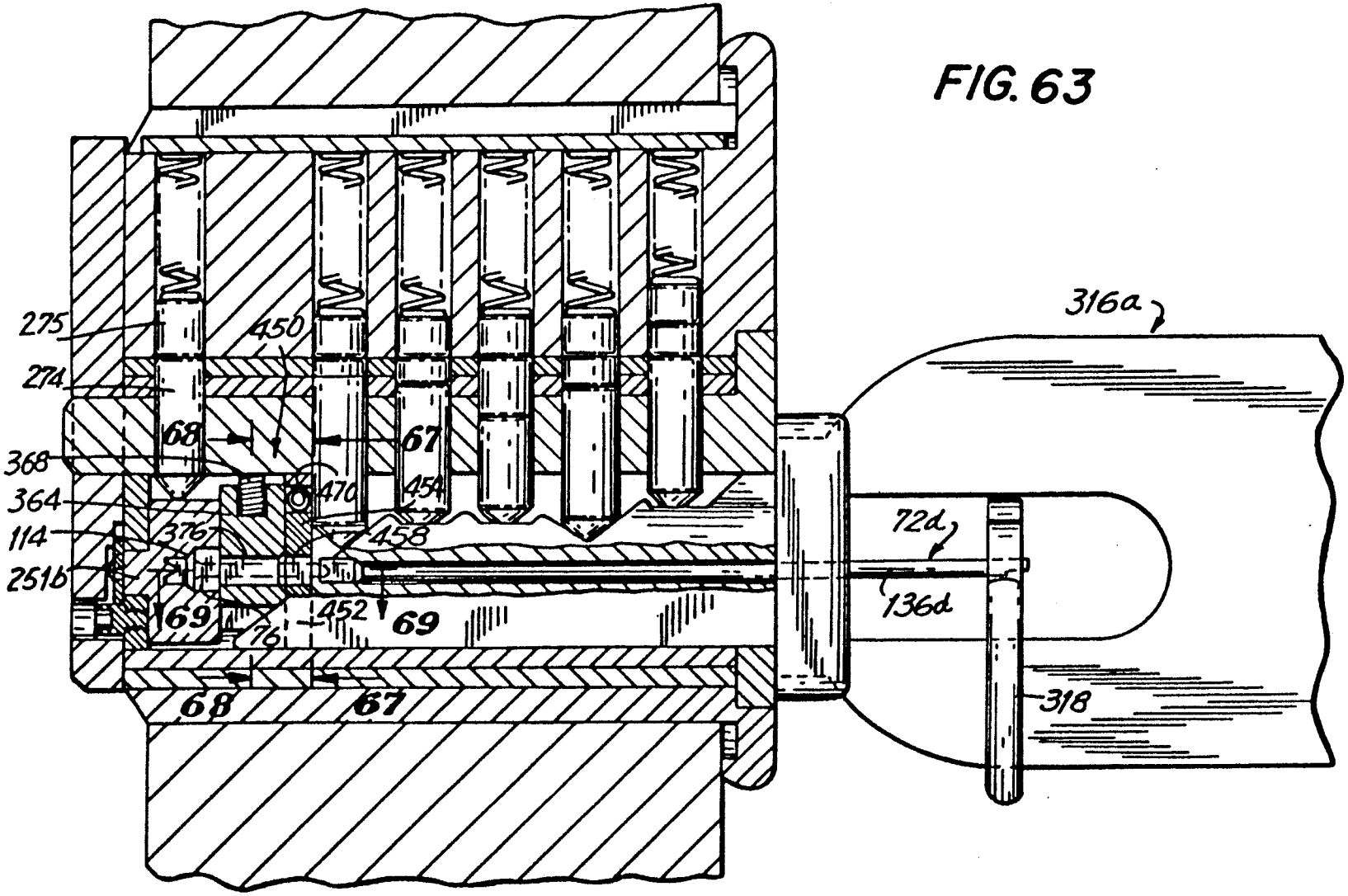
FIG. 63 is an axial section view of a lock according to another embodiment of the invention incorporating security means according to another embodiment comprising a gate mechanism which includes a stationary shield and two movable gates.
Figure 64:
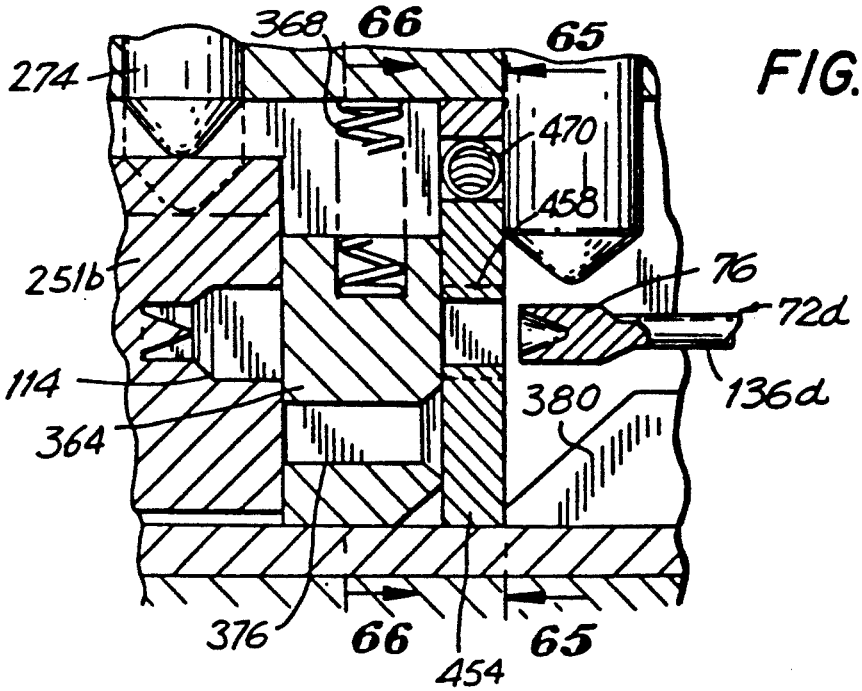
FIG. 64 is an axial sectional view of gate mechanism of the lock of FIG. 63.
Figure 65:
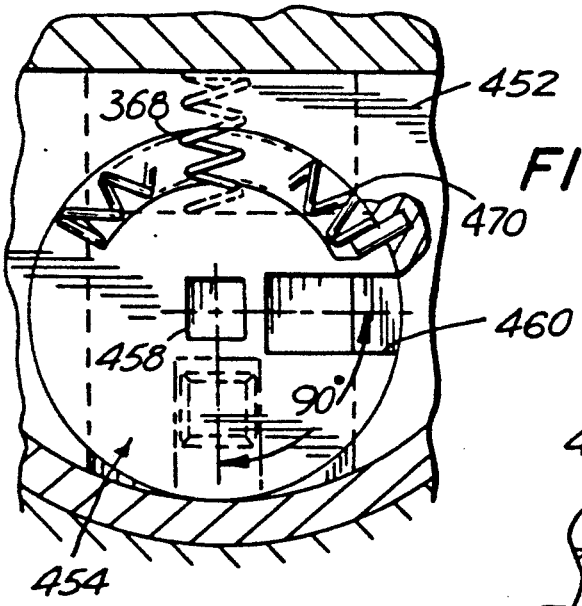
FIG. 65 is a section view of the gate mechanism depicted in FIG. 64 taken along line 65—65 thereof.
Figure 66:
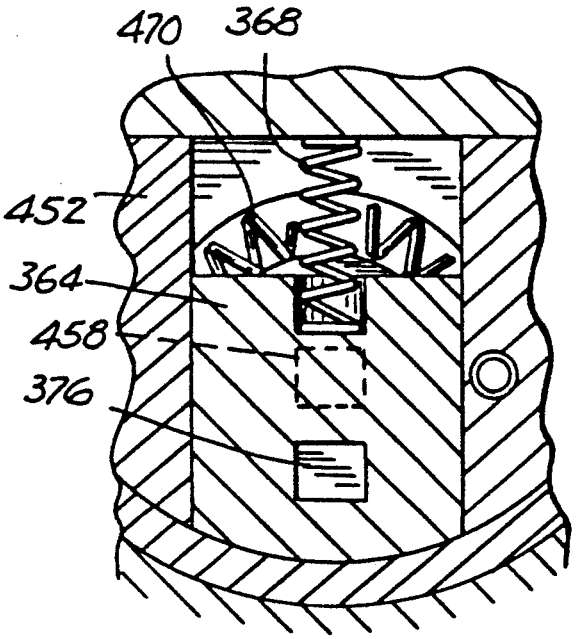
FIG. 66 is a section view of the gate mechanism depicted in FIG. 64 taken along line 66—66 thereof.

Gate 364 is spring loaded in slot 366 of shield 362 by spring 368 received in bore 370 of gate 364 and bears against the inner periphery of inner cylinder 252c (FIG. 50) to urge gate 364 downwardly. Shield 362 includes a camming opening 372 and another opening 374 having the same configuration as and registered with opening 114 of cam 251a. Shield 362 is stationary and opening 374 in shield 362 is always registered with opening 114 in cam 251a. However, gate 364 selectively blocks access to opening 114 of cam 251a. Gate 364 includes an opening 376 having the same configuration as openings 114 and 374 which in its rest position is not registered with openings 114 and 374. In order to provide access to opening 114, gate 364 must be raised to register its opening 376 with openings 114 and 374, as depicted in FIGS. 50–52. This is accomplished by using a key 316a having a change key 72d. Key 316a is similar to key 316 but has a tapered tip 380 as shown in FIG. 53.

Key tip 380 functions as a cam for gate 364 when inserted into camming opening 372 of shield 362. Pushing key tip 380 into opening 372 of shield 362 cams gate 364 upwardly until opening 376 registers with openings 374 and 114. Then tip 76 may be pushed through the registered openings 374, 376 into opening 114 of cam 251a. Rekeying is accomplished simply by rotating shaft 136d as described for key 316. Upon completion of a rekeying operation, shaft 136d is simply withdrawn to reset gate 364. To operate the gate mechanism 360, it is not necessary that a key operate the lock since none of the lock cylinders must be rotated. Thus, a key such as key 76b with an appropriate camming tip 380 may be used.

In the embodiment depicted in FIGS. 55–56, entry to cam 251d is blocked by a gate mechanism 360a similar to gate mechanism 360. Additionally, cam 251d includes an internal locking mechanism which prevents rotation of cam 251d unless a proper key is inserted therein. Tn the embodiment depicted in FIGS. 55–56, a skeleton-type key 390 and appropriate locking structure 392 inside cam 251d cooperate to prevent rotation of cam 251d unless a properly configured skeleton key is inserted therein. Gate mechanism 360a includes openings in shield 362a and in gate 364a which permit key 390 to cam gate 364a upwardly and pass through shield 362a and gate 364a.

Referring next to FIGS. 57–62, a gate mechanism 400 is illustrated which includes a rotatable shield 402 and a gravity actuated gate 404 disposed in a slot 406 of shield 402. Shield 402 is secured to inner cylinder 252d (FIG. 58) by bolts 408 to rotate with inner cylinder 252d.

In the position in FIG. 57, gate 404 simply rests in slot 406 (FIG. 62) of shield 402 against the inner periphery of inner cylinder 252d blocking access to cam 251b. Shield 402 includes a hole 410 (FIGS. 61 and 62) therein which registers with opening 114 of rotatable cam 251b when shield 402 is in its unrotated position depicted in FIG. 62. However, as mentioned, gate 404 blocks access to cam 251b in that position. Gate 404 must be raised to provide access to cam 251b. That is accomplished in the following steps. A key 316 (FIG. 41) including a key 317 which operates the lock and includes a change key 72c therewith is inserted into the lock and rotated 180 degrees. This rotates shield 402 180 degrees and causes gate 404 to be raised, turned upside down and then dropped under gravity to the position depicted in FIG. 59. In that position of shield 402 and gate 404, tip 76 may be inserted through shield 402 past gate 404 which has a circular grove 416 to facilitate this. However, tip 76 may not enter opening 114 of cam 251b because opening 410 of shield 404 is not registered with opening 114. To register openings 410 and 114, key 316 is rotated 180 degrees to bring shield 404 back to its starting position in which opening 410 is registered with opening 114. Now, gate 404 is maintained raised by shaft 136c in groove 416 as shown in FIGS. 60 and 61 so that tip 76 may be inserted into opening 114 to rotate cam 251b.

After rekeying, shaft 136c is simply withdrawn from cam 251b, gate 404 and shield 402, which causes gate 404 to drop and revert to its original position blocking access to cam 251b. As mentioned, a key that operates the lock is necessary in order to rotate shield 402 and gain access to cam 310b.

Figure 67:
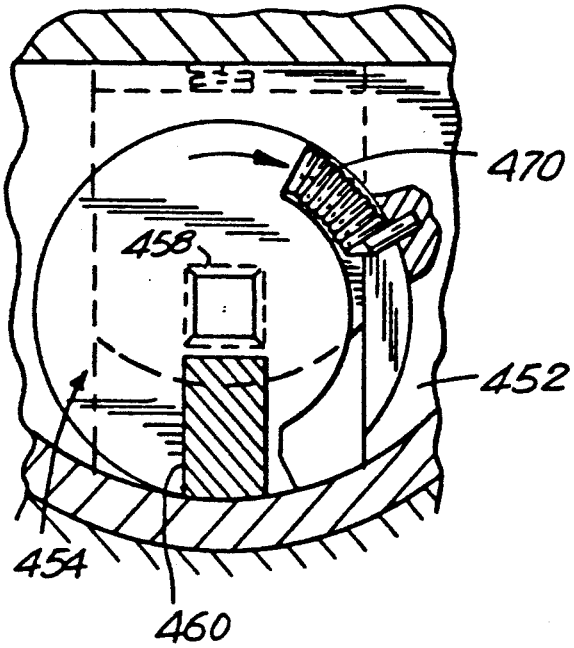
FIG. 67 is a section view of the gate mechanism of the lock depicted in FIG. 63 taken along line 67—67 thereof.
Figure 68:
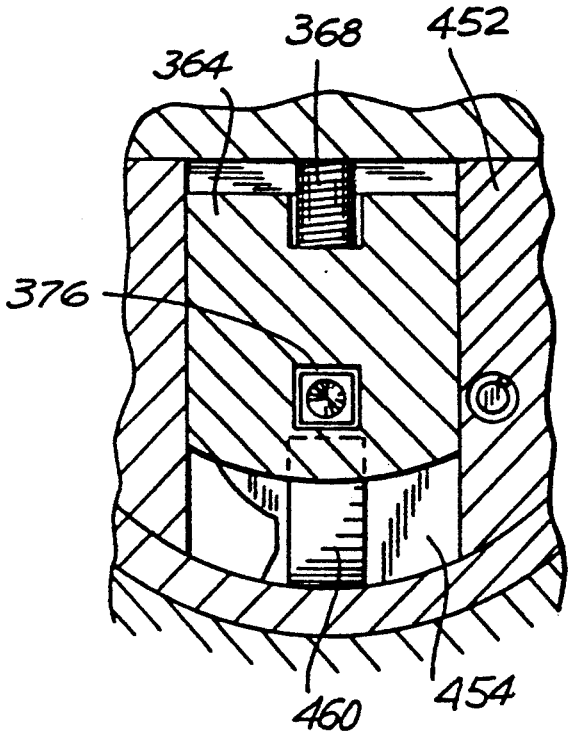
FIG. 68 is a section view of the gate mechanism of the lock of FIG. 63 taken along line 68—68 thereof.
Figure 69:
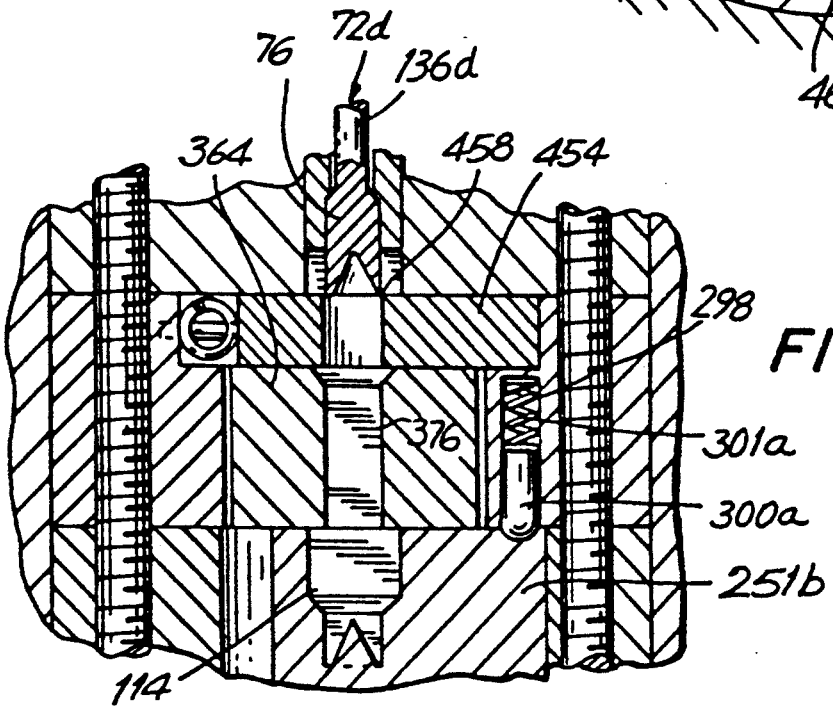
FIG. 69 is a section view of the lock and gate mechanism depicted in FIG. 63 taken along line 69—69 thereof.
Figure 70:
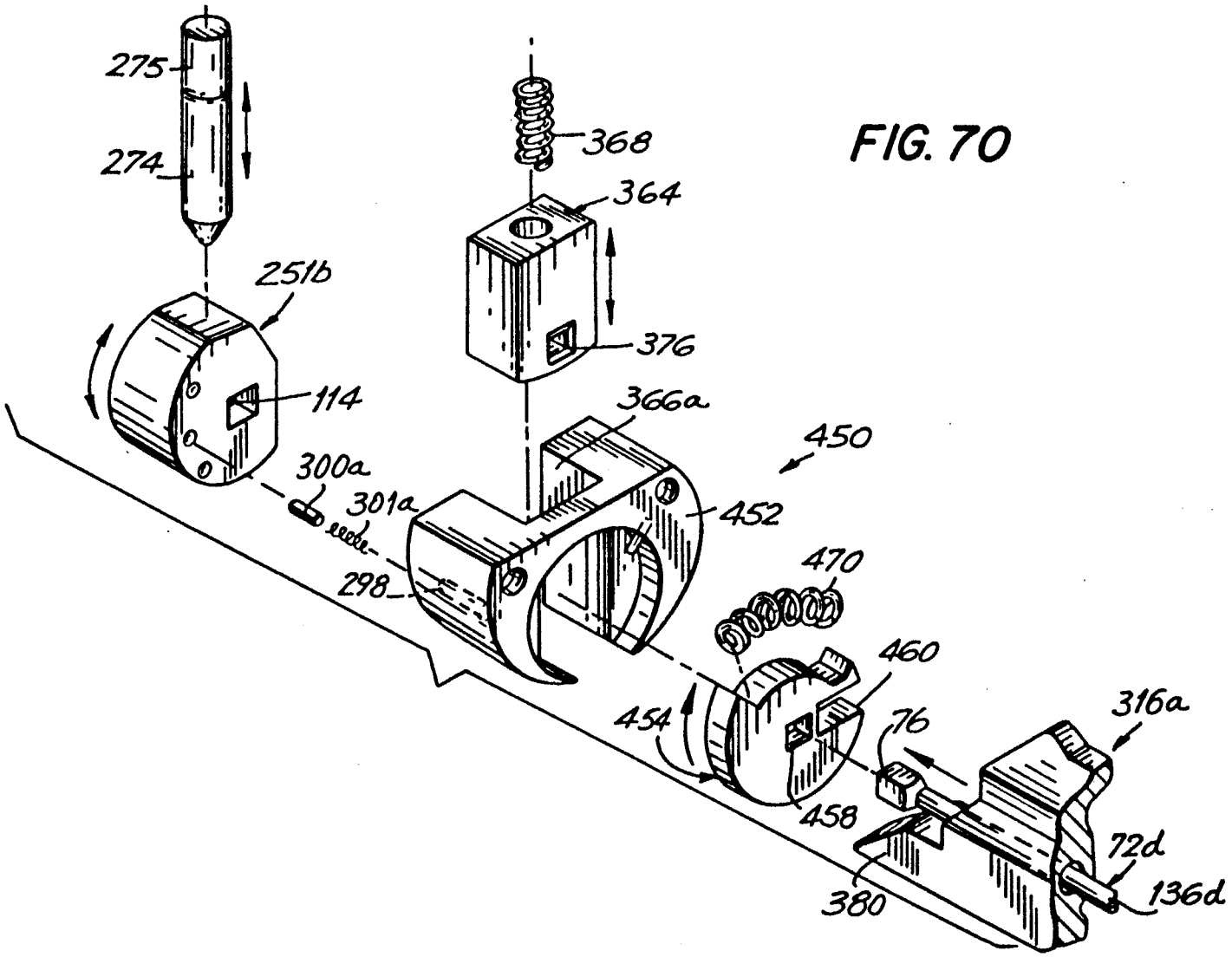
FIG. 70 is an exploded respective view of the gate mechanism and rotatable cam of the lock depicted in FIG. 63.

In the embodiment depicted in FIGS. 63–70, gate mechanism 450 includes a stationary shield 452, a rotatable front gate 454 and a spring loaded gate 364. Spring loaded gate 364 and shield 452 cooperate in the same manner as gate 364 and shield 362 depicted in FIG. 53. Rotatable front gate 454 includes first opening 458, configured to match configuration of change key tip 76 and cam opening 114, and a camming opening 460 at a periphery of gate 454 which functions similar to camming opening 372 of shield 362. Shield 452 includes slot 366a similar to slot 366 of shield 362 for receiving spring-loaded gate 364. In order to provide access to opening 114 of cam 251b, it is necessary to raise gate 364 so that opening 376 of gate 364 is registered with opening 114. To accomplish that, the camming opening 460 of gate 454 must be positioned to permit key 316a to cam gate 364 upwardly, as described in connection with FIGS. 50–53. In other words, circular front gate 454 must be rotated so that camming opening 460 is positioned vertically as shown in broken lines in FIG. 65. To effect that, tip 76 of change key 72d is inserted into opening 458 of circular front gate 454 and rotated to position opening 460 of circular gate 454 as shown in FIG. 67. Key 316a is then inserted into camming opening 460 of circular gate 454 to cam gate 364 upwardly, as described for gate mechanism 360. At that point, openings 458, 376 and 114 are registered so that change key tip 76 may be inserted into cam opening 114 and rotated to rotate cam 251b to rekey the lock. Upon completion of rekeying, shaft 136d is simply withdrawn and gate 364 returns to its starting position under action of spring 368, and circular gate 454 returns to its rest position under action of spring 470.

In the embodiment of FIGS. 63–70 it is not necessary to rotate key 316a to rekey the lock, but a cam tip 380 is necessary, as described in connection with FIGS. 50–53.

While the gate mechanisms of FIGS. 50–70 have been illustrated and described in connection with a rotatable cam, they may also be utilized to restrict access to other engaging means such as a rack and pinion.

Embodiments of the invention illustrated in the drawings and described herein are meant to be exemplary rather than exhaustive. In addition, certain changes may be made to such embodiments which may be apparent to those of skill in the art. It is the intention of the applicants to cover by the claims herein all such changes which do not depart from the spirit and scope of the invention.

We claim:

1. A lock assembleable into a lock assembly and selectively operable therein by each of a plurality of different keys comprising:

a casing;

a plurality of cylinders rotatably disposed one in the other in said casing, said lock including structure closing one end thereof, a keyway being disposed in said one end in which a key may be inserted for operating said lock;

a plurality of pin tumblers;

means in said casing and said plurality of cylinders for movably receiving said plurality of pin tumblers, said pin tumblers being positionable by a key inserted in said keyway, said tumblers being configured to form a first common pin tumbler shear line between a first and a second of said plurality of cylinders when said pin tumblers are positioned by a first key inserted in said keyway, said first common pin tumbler shear line permitting rotation of said first cylinder relative to said second cylinder, said pin tumblers also being configured to form a second common pin tumbler shear line between said second cylinder and said casing when said pin tumblers are positioned by a second key different from said first key inserted in said keyway, said second common pin tumbler shear line permitting rotation of said second cylinder relative to said casing; and means actuable from the exterior of said lock assembly when said lock is assembled therein for selectively engaging said first and said second cylinders independently of the positioning of said pin tumblers, whereby said first key but not said second key is operable to rotate said first cylinder relative to said second cylinder and said casing across said first common pin tumbler shear line when said means for engaging does not engage said first and second cylinders, and said second key but not said first key is operable to rotate said first and second cylinders together relative to said casing across said second common pin tumbler shear line when said means for engaging engages said first and second cylinders;

said means for engaging comprises at least one movable engaging member and means in at least said first and second cylinders for movably receiving said at least one engaging member, said at least one engaging member defining an adjustable shear line, said means for engaging including movable structure for moving said at least one engaging member between a first position placing said adjustable shear line in a first position between said first and second cylinders, and a second position engaging said first and second cylinders and placing said adjustable shear line in a second position between said second cylinder and said casing;

said means for engaging comprises an actuating member which is removably coupleable to said moving structure through said keyway from said one end of said lock, said movable structure and said actuating member including mutually engageable structure for engaging and moving said movable structure upon selected movement of said actuating member.

2. The lock according to claim 1 wherein said means actuable from the exterior of the lock is actuable through said keyway, said lock including means in said lock for selectively blocking access from the exterior of said lock through said keyway to operating said movable means.

3. A lock assemblable into a lock assembly and selectively operable therein by each of a plurality of different keys comprising:

a casing;

a plurality of cylinders rotatably disposed one in the other in said casing, said lock including structure closing one end thereof, a keyway being disposed in said one end in which a key may be inserted for operating said lock;

a plurality of pin tumblers;

means in said casing and said plurality of cylinders for movably receiving said plurality of pin tumblers, said pin tumblers being positionable by a key inserted in said keyway, said tumblers being configured to form a first common pin tumbler shear line between a first and a second of said plurality of cylinders when said pin tumblers are positioned by a first key inserted in said keyway, said first common pin tumbler shear line permitting rotation of said first cylinder relative to said second cylinder, said pin tumblers also being configured to form a second common pin tumbler shear line between said second cylinder and said casing when said pin tumblers are positioned by a second key different from said first key inserted in said keyway, said second common pin tumbler shear line permitting rotation of said second cylinder relative to said casing; and means actuable from the exterior of said lock assembly when said lock is assembled therein for selectively engaging said first and said second cylinders independently of the positioning of said pin tumblers, whereby said first key but not said second key is operable to rotate said first cylinder relative to said second cylinder and said casing across said first common pin tumbler shear line when said means for engaging does not engage said first and second cylinders, and said second key but not said first key is operable to rotate said first and second cylinders together relative to said casing across said second common pin tumbler shear line when said means for engaging engages said first and second cylinders;

said means for engaging comprises at least one movable engaging member and means in at least said first and second cylinders for movably receiving said at least one engaging member, said at least one engaging member defining an adjustable shear line, said means for engaging including movable structure for moving said at least one engaging member between a first position placing said adjustable shear line in a first position between said first and second cylinders, and a second position engaging said first and second cylinders and placing said adjustable shear line in a second position between said second cylinder and said casing;

said means for engaging comprises an actuating member which is removably coupleable to said moving structure through said keyway from said one end of said lock, said movable structure and said actuating member including mutually engageable structure for engaging and moving said movable structure upon selected movement of said actuating member;

said means for engaging comprising an actuating member coupled to said movable structure for moving said movable structure upon selected movement of said actuating member, said actuating member when coupled to said movable structure extending beyond an end of said lock opposite said one end and being movable from the exterior of said lock assembly.

4. The lock according to claim 1 or 3 including means operable from an end of said lock opposite said closed end for selectively positively engaging said at least one engaging member or said moving structure to resist movement thereof and thereby lock said at least one engaging member in a selected position, thereby preventing readjustment of the at least one engaging member.

5. The lock according to claim 4 wherein said means for positively engaging comprises a set screw and a threaded hole in said lock positioned to open adjacent said at least one engaging member or said movable structure, said set screw being selectively tightenable in said hole into engagement with said at least one engaging member or said movable structure.

6. The lock according to claim 1 or 3 including means cooperating with said at least one engaging member or said movable structure for indicating at least when said at least one engaging member is in one of said positions.

7. The lock according to claim 6 wherein said means for indicating comprises a detent arrangement including a spring-loaded detent member urged against said at least one engaging member or against said movable structure and structure on said at least one engaging member or on said movable structure which receives and seats said detent member in said positions of said at least one engaging member.

8. The lock according to claim 6 wherein said means for indicating comprises a pointer and a scale which visually indicate, from a secure side of said lock, the position of said at least one engaging member, said pointer being moved upon movement of said at least one engaging member to uniquely indicate positions corresponding to the positions of said at least one engaging member.

9. The lock according to claim 1 or 3 including a third cylinder, said first and second cylinders being rotatably disposed in said third cylinder, means in said third cylinder for movably receiving said pin tumblers, said pin tumblers being configured to form said first common pin tumbler shear line between said first and second cylinders to permit rotation of said first cylinder relative to said second and third cylinders and said casing across said first common pin tumbler shear line when said pin tumblers are positioned by said first key, said pin tumblers also being configured to form said second common pin tumbler shear line between said second and third cylinders to permit said second cylinder to rotate relative to said third cylinder and said casing across said second common pin tumbler shear line when said pin tumblers are positioned by said second key, said pin tumblers also being configured to form a third common pin tumbler shear line between said third cylinder and said casing when said tumblers are positioned by a third key different from said first and second keys inserted in said keyway, said third common pin tumbler shear line permitting rotation of said third cylinder relative to said casing across said third common pin tumbler shear line, said means for selectively engaging also selectively engaging said first, second and third cylinders independently of the positions of said pin tumblers, whereby said first key but not said second and third keys is operable to rotate said first cylinder relative to said second and third cylinders and said casing across said first common pin tumbler shear line when said means for engaging does not engage said first, second and third cylinders, said second key but not said first and third keys is operable to rotate said first and second cylinders together relative to said third cylinder and said casing across said second common pin tumbler shear line when said means for engaging engages said first and second cylinders, and said third key but not said first and second keys is operable to rotate said first, second and third cylinders together relative to said casing across said third common pin tumbler shear line when said means for engaging engages said first, second and third cylinders.

10. The lock according to claim 1 or 3 wherein said means actuable from the exterior of the lock is actuable through said keyway, said lock including means inside said lock for selectively blocking access from the exterior of said lock through said keyway to operating said means actuable from the exterior of the lock.

11. A lock assemblable into a lock assembly and selectively operable therein by each of a plurality of different keys comprising:

a casing;

a plurality of cylinders rotatably disposed one in the other in said casing, said lock including structure closing one end thereof, a keyway being disposed in said one end in which a key may be inserted for operating said lock;

a plurality of pin tumblers;

means in said casing and said plurality of cylinders for movably receiving said plurality of pin tumblers, said pin tumblers being positionable by a key inserted in said keyway, said tumblers being configured to form a first common pin tumbler shear line between a first and a second of said plurality of cylinders when said pin tumblers are positioned by a first key inserted in said keyway, said first common pin tumbler shear line permitting rotation of said first cylinder relative to said second cylinder, said pin tumblers also being configured to form a second common pin tumbler shear line between said second cylinder and said casing when said pin tumblers are positioned by a second key different from said first key inserted in said keyway, said second common pin tumbler shear line permitting rotation of said second cylinder relative to said casing; and means actuable from the exterior of said lock assembly when said lock is assembled therein for selectively engaging said first and said second cylinders independently of the positioning of said pin tumblers, whereby said first key but not said second key is operable to rotate said first cylinder relative to said second cylinder and said casing across said first common pin tumbler shear line when said means for engaging does not engage said first and second cylinders, and said second key but not said first key is operable to rotate said first and second cylinders together relative to said casing across said second common pin tumbler shear line when said means for engaging engages said first and second cylinders;

said means for engaging comprises at least one movable engaging member and means in at least said first and second cylinders for movably receiving said at least one engaging member, said at least one engaging member defining an adjustable shear line, said means for engaging including movable structure for moving said at least one engaging member between a first position placing said adjustable shear line in a first position between said first and second cylinders, and a second position engaging said first and second cylinders and placing said adjustable shear line in a second position between said second cylinder and said casing;

said means for engaging comprising an actuating member which is removably coupleable to said moving structure through said keyway from said one end of said lock, said movable structure and said actuating member including mutually engageable structure for engaging and moving said movable structure upon selected movement of said actuating member;

said movable structure in said means for engaging comprising an adjustable cam and said at least one engaging member comprises a pin tumbler positioned relative to said cam to be moved between said first and second positions by adjustment of said cam.

12. A lock assemblable into a lock assembly and selectively operable therein by each of a plurality of different keys comprising:

a casing;

a plurality of cylinders rotatably disposed one in the other in said casing, said lock including structure closing one end thereof, a keyway being disposed in said one end in which a key may be inserted for operating said lock;

a plurality of pin tumblers;

means in said casing and said plurality of cylinders for movably receiving said plurality of pin tumblers, said pin tumblers being positionable by a key inserted in said keyway, said tumblers being configured to form a first common pin tumbler shear line between a first and a second of said plurality of cylinders when said pin tumblers are positioned by a first key inserted in said keyway, said first common pin tumbler shear line permitting rotation of said first cylinder relative to said second cylinder, said pin tumblers also being configured to form a second common pin tumbler shear line between said second cylinder and said casing when said pin tumblers are positioned by a second key different from said first key inserted in said keyway, said second common pin tumbler shear line permitting rotation of said second cylinder relative to said casing; and means actuable from the exterior of said lock assembly when said lock is assembled therein for selectively engaging said first and said second cylinders independently of the positioning of said pin tumblers, whereby said first key but not said second key is operable to rotate said first cylinder relative to said second cylinder and said casing across said first common pin tumbler shear line when said means for engaging does not engage said first and second cylinders, and said second key but not said first key is operable to rotate said first and second cylinders together relative to said casing across said second common pin tumbler shear line when said means for engaging engages said first and second cylinders;

said means for engaging comprises at least one movable engaging member and means in at least said first and second cylinders for movably receiving said at least one engaging member, said at least one engaging member defining an adjustable shear line, said means for engaging including movable structure for moving said at least one engaging member between a first position placing said adjustable shear line in a first position between said first and second cylinders, and a second position engaging said first and second cylinders and placing said adjustable shear line in a second position between said second cylinder and said casing;

said means for engaging comprises an actuating member which is removably coupleable to said moving structure through said keyway from said one end of said lock, said movable structure and said actuating member including mutually engageable structure for engaging and moving said movable structure upon selected movement of said actuating member;

said movable structure in said means for engaging comprising an adjustable threaded member and structure in said cylinders for axially receiving said threaded member therein for axial adjustment thereof.

13. A lock assemblable into a lock assembly and selectively operable therein by each of a plurality of different keys comprising:

a casing;

a plurality of cylinders rotatably disposed one in the other in said casing, said lock including structure closing one end thereof, a keyway being disposed in said one end in which a key may be inserted for operating said lock;

a plurality of pin tumblers;

means in said casing and said plurality of cylinders for movably receiving said plurality of pin tumblers, said pin tumblers being positionable by a key inserted in said keyway, said tumblers being configured to form a first common pin tumbler shear line between a first and a second of said plurality of cylinders when said pin tumblers are positioned by a first key inserted in said keyway, said first common pin tumbler shear line permitting rotation of said first cylinder relative to said second cylinder, said pin tumblers also being configured to form a second common pin tumbler shear line between said second cylinder and said casing when said pin tumblers are positioned by a second key different from said first key inserted in said keyway, said second common pin tumbler shear line permitting rotation of said second cylinder relative to said casing; and at least one movable engaging member and means in at least said first and second cylinders for movably receiving said at least one engaging member, said at least one engaging member defining an adjustable shear line, a rotatable member disposed adjacent said at least one engaging member, said at least one engaging member and said rotatable member including mutually engaging structure for moving, upon rotation of said rotatable member, said at least one engaging member between a first position not engaging said first and second cylinders and placing said adjustable shear line between said first and second cylinders, and a second position engaging said first and second cylinders and placing said adjustable shear line between said second cylinder and said casing, whereby said first key but not said second key is operable to rotate said first cylinder relative to said second cylinder and said casing across said first common pin tumbler shear line when said at least one engaging member is in its first position and said second key but not said first key is operable to rotate said first and second cylinders together relative to said casing across said second common pin tumbler shear line when said at least one engaging member is in said second position thereof;

said rotatable member comprises a cam and said at least one engaging member comprising a pin tumbler positioned relative to said cam to be moved between said first and second positions by rotation of said cam.

14. A lock assemblable into a lock assembly and selectively operable therein by each of a plurality of different keys comprising:

a casing;

a plurality of cylinders rotatably disposed one in the other in said casing, said lock including structure closing one end thereof, a keyway being disposed in said one end in which a key may be inserted for operating said lock;

a plurality of pin tumblers;

means in said casing and said plurality of cylinders for movably receiving said plurality of pin tumblers, said pin tumblers being positionable by a key inserted in said keyway, said tumblers being configured to form a first common pin tumbler shear line between a first and a second of said plurality of cylinders when said pin tumblers are positioned by a first key inserted in said keyway, said first common pin tumbler shear line permitting rotation of said first cylinder relative to said second cylinder, said pin tumblers also being configured to form a second common pin tumbler shear line between said second cylinder and said casing when said pin tumblers are positioned by a second key different from said first key inserted in said keyway, said second common pin tumbler shear line permitting rotation of said second cylinder relative to said casing; and at least one movable engaging member and means in at least said first and second cylinders for movably receiving said at least one engaging member, said at least one engaging member defining an adjustable shear line, a rotatable member disposed adjacent said at least one engaging member, said at least one engaging member and said rotatable member including mutually engaging structure for moving, upon rotation of said rotatable member, said at least one engaging member between a first position not engaging said first and second cylinders and placing said adjustable shear line between said first and second cylinders, and a second position engaging said first and second cylinders and placing said adjustable shear line between said second cylinder and said casing, whereby said first key but not said second key is operable to rotate said first cylinder relative to said second cylinder and said casing across said first common pin tumbler shear line when said at least one engaging member is in its first position and said second key but not said first key is operable to rotate said first and second cylinders together relative to said casing across said second common pin tumbler shear line when said at least one engaging member is in said second position thereof.

15. The lock according to claim 14 wherein said cam includes structure engageable by a specially-configured key inserted in said keyway or from an end of said lock opposite said keyway.

16. The lock according to claim 15 wherein said specially-configured key comprises a bit having a specially-configured tip which engages said structure of said cam or said pinion gear for rotating it, said bit when engaged with said cam or said pinion gear not moving said tumblers from a rest position thereof.

17. A lock assemblable into a lock assembly and selectively operable therein by each of a plurality of different keys comprising:

a casing;

a plurality of cylinders rotatably disposed one in the other in said casing, said lock including structure closing one end thereof, a keyway being disposed in said one end in which a key may be inserted for operating said lock;

a plurality of pin tumblers;

means in said casing and said plurality of cylinders for movably receiving said plurality of pin tumblers, said pin tumblers being positionable by a key inserted in said keyway, said tumblers being configured to form a first common pin tumbler shear line between a first and a second of said plurality of cylinders when said pin tumblers are positioned by a first key inserted in said keyway, said first common pin tumbler shear line permitting rotation of said first cylinder relative to said second cylinder, said pin tumblers also being configured to form a second common pin tumbler shear line between said second cylinder and said casing when said pin tumblers are positioned by a second key different from said first key inserted in said keyway, said second common pin tumbler shear line permitting rotation of said second cylinder relative to said casing; and at least one movable engaging member and means in at least said first and second cylinders for movably receiving said at least one engaging member, said at least one engaging member defining an adjustable shear line, a rotatable member disposed adjacent said at least one engaging member, said at least one engaging member and said rotatable member including mutually engaging structure for moving, upon rotation of said rotatable member, said at least one engaging member between a first position not engaging said first and second cylinders and placing said adjustable shear line between said first and second cylinders, and a second position engaging said first and second cylinders and placing said adjustable shear line between said second cylinder and said casing, whereby said first key but not said second key is operable to rotate said first cylinder relative to said second cylinder and said casing across said first common pin tumbler shear line when said at least one engaging member is in its first position and said second key but not said first key is operable to rotate said first and second cylinders together relative to said casing across said second common pin tumbler shear line when said at least one engaging member is in said second position thereof;

said rotatable member comprises a cam and said at least one engaging member comprising a pin tumbler positioned relative to said cam to be moved between said first and second positions by rotation of said cam;

said rotatable member including structure engageable transversely from said a side of said lock not accessible when said lock is assembled in its lock assembly.

18. A pin tumbler lock adjustable to operate with different ones of a plurality of selected keys, said lock adapted to being assembled into a lock assembly, a pin tumbler system including a plurality of pin tumblers and a plurality of rotatable members which cooperate to define a plurality of common shear lines across which a selected rotatable member or members may be rotated by said plurality of selected keys, means defining an adjustable shear line adjustable from the exterior of said lock such that after adjustment of said adjustable shear line said lock is operable with a one of said plurality of selected keys which positions said pin tumblers to form a common shear line aligned with said adjustable shear line, and means not accessible from the exterior of said lock assembly but accessible from the exterior of said lock without disassembling said lock which engage said means defining said adjustable shear line for adjusting it.

19. The lock according to claim 18 wherein said pin tumblers are positioned axially aligned in said lock.

20. The lock according to claim 18 wherein said rotatable members are cylinders.

21. A pin tumbler lock assemblable into a lock assembly adjustable to operate with different ones of a plurality of selected keys, said lock comprising a pin tumbler system including a plurality of pin tumblers and a plurality of rotatable members which cooperate upon positioning of said pin tumblers by said plurality of selected keys to define a plurality of common shear lines across which a selected rotatable member or members may be rotated by said plurality of selected keys to operate said lock, and means defining an adjustable shear line adjustable from the exterior of said lock assembly into a plurality of adjusted positions, without requiring use of any of said plurality of selected keys which operate said lock, such that after adjustment of said adjustable shear line to a one of said adjusted positions, said lock is only operable with a one of said plurality of selected keys which positions said pin tumblers to form a common shear line aligned with said adjustable shear line in said one adjusted position thereof, said lock including means preventing readjustment of said adjustable shear line defining means to a position thereof after said adjustable shear line defining means has been adjusted out of that position.

22. A pin tumbler lock assemblable into a lock assembly adjustable to operate with different ones of a plurality of selected keys, said lock comprising a keyway into which each of said plurality of keys is inserted to operate said lock, a pin tumbler System including a plurality of pin tumblers and a plurality of rotatable members which cooperate upon positioning of said pin tumblers by said plurality of selected keys to define a plurality of common shear lines across which a selected rotatable member or members may be rotated by said plurality of selected keys, means defining an adjustable shear line adjustable through an opening in said lock from the exterior of said lock assembly into a plurality of positions such that after adjustment of said adjustable shear line to a one of said adjusted positions, said lock is operable with a one of said plurality of selected keys which positions said pin tumblers to form a common shear line aligned with said adjustable shear line in said one adjusted position thereof, said lock including means inside said lock for selectively restricting access from the exterior of said lock through said opening to operating said means actuable from the exterior of the lock.

23. The lock according to claim 22 wherein said opening is said keyway and said restricting means is disposed to block access to said means actuable from the exterior of the lock through said keyway.

24. The lock according to claim 23 wherein said restricting means comprises at least one movable gate which in one position blocks access to operating said movable means and in another position permits access to operating said movable means.

25. The lock according to claim 24 wherein said restricting means includes means spring-loading said gate and urging it to said one position, said gate having a camming surface for camming said gate under action of a cam inserted in said keyway from said one position to said another position against the action of said spring.

26. The lock according to claim 25 wherein said restricting means includes a shield disposed adjacent said gate, said gate and said shield each including an opening therein, said openings being unregistered in said one position of said gate and being registered in said another position of said gate to provide access to operating said means actuable from the exterior of the lock, said shield having another opening providing access to said gate camming surface.

27. The lock according to claim 25 wherein said restricting means includes another spring-loaded gate rotatably mounted in said lock adjacent said gate, said another gate being urged into an unrotated position thereof, said gate and said another gate each including an opening therein, said openings being unregistered in said one position of said gate and being registered in said another position of said gate to provide access to operating said means actuable from the exterior of the lock, said another gate having another opening therein providing access to said gate camming surface in a rotated position of said another gate and blocking access to said gate camming surface in an unrotated position of said another gate.

28. The lock according to claim 24 wherein said restricting means includes a shield rotatably mounted in said lock adjacent said gate, said gate being slidably mounted in said shield, said shield including an opening therein, said gate in one position thereof blocking said opening, and said gate in a rotated position of said shield not blocking said opening.

29. The lock according to claim 24 wherein said restricting means includes a shield rotatably in said lock adjacent said gate, said gate being slidably mounted in said shield, said shield including an opening therein, said opening in said shield in an unrotated position thereof being registered with said means actuable from the exterior of said lock and said gate in said one position thereof blocking said shield opening in said unrotated position of said shield, said gate in a rotated position of said shield not blocking said shield opening and permitting entry therethrough to engage said gate of an implement which cooperates with and operates said means actuable from the exterior of said lock, said gate being structured such that when engaged by said implement it is prevented from sliding when said shield is rotated, said shield opening in said rotated position of said shield not being registered with said means actuable from the exterior of the lock, whereby said gate may be engaged by said implement and prevented from sliding when said shield is rotated back to said unrotated position to thereby provide access to said means actuable from the exterior of the lock.

30. A combination key for locking and unlocking a pin tumbler lock and for rekeying said lock, said key including pin tumbler engaging surfaces for positioning said pin tumblers when inserted into said lock and a shaft movably mounted to said key for movement independently of said tumbler positioning surfaces for engaging rekeying structure in said lock accessible through the keyway of said lock.

31. The combination key according to claim 30 wherein said shaft is mounted to said key for longitudinal movement thereof.

32. The combination key according to claim 30 wherein said shaft is mounted to said key for rotational movement thereof.

33. The combination key according to claim 30 wherein said shaft is mounted to said key for longitudinal and rotational movement thereof.

34. A pin tumbler lock assemblable into a lock assembly adjustable to operate with different ones of a plurality of selected keys, said lock comprising a keyway into which each of said plurality of keys is inserted to operate said lock, a pin tumbler system including a plurality of pin tumblers and a plurality of rotatable members which cooperate upon positioning of said pin tumblers by said plurality of selected keys to define a plurality of common shear lines across which a selected rotatable member or members may be rotated by said plurality of selected keys, means defining an adjustable shear line adjustable through an opening in said lock from the exterior of said lock assembly into a plurality of positions such that after adjustment of said adjustable shear line to a one of said adjusted positions, said lock is operable with a one of said plurality of selected keys which positions said pin tumblers to form a common shear line aligned with said adjustable shear line in said one adjusted position thereof, said lock including means inside said lock for locking said adjustable shear line means and a key insertable from the exterior of said lock for unlocking said locking means.

35. The lock according to claim 34 wherein said adjustable shear line defining means comprises an adjustable member and at least one engaging member for engaging selected rotatable members, said adjustable member being adjustable from the exterior of said lock to adjust the position of said at least one engaging member, and wherein said locking means includes structure selectively locking said adjustable member.

36. The lock according to claim 35 wherein said adjustable member comprises a rotatable cam or gear.

* * * * *